US006619393B1

(12) United States Patent
Olivera

(10) Patent No.: US 6,619,393 B1
(45) Date of Patent: Sep. 16, 2003

(54) METHOD FOR LOCATING OIL WELLS

(76) Inventor: Fernando Olivera, La Llanura #142 Fraccionamiento Pastores, C.P. 53340 Estado de Mexico (MX)

( * ) Notice: Subject to any disclaimer, the term of this patent is extended or adjusted under 35 U.S.C. 154(b) by 30 days.

(21) Appl. No.: 09/804,456

(22) Filed: Mar. 12, 2001

Related U.S. Application Data

(63) Continuation-in-part of application No. 09/487,280, filed on Jan. 19, 2000, now Pat. No. 6,206,099.

(51) Int. Cl.[7] ..... E21B 47/00
(52) U.S. Cl. ..... 166/245; 73/152.01; 166/250.16
(58) Field of Search ..... 166/245, 250.16, 166/52, 250.01; 73/152.01; 175/40

(56) References Cited

U.S. PATENT DOCUMENTS

| | | | |
|---|---|---|---|
| 1,872,906 A | 8/1932 | Doherty | 166/52 |
| 3,093,190 A | 6/1963 | Hoyt | 166/245 |
| 3,524,346 A | 8/1970 | Schmidt | 166/250.1 |
| 3,921,126 A | 11/1975 | Waters | 166/250.1 |
| 5,388,456 A | 2/1995 | Kettel | 73/152.02 |

OTHER PUBLICATIONS

Brochure, "ResGram Spatial Data Analysis", Author and Date unknown.
Brochure, "Wbgeos–Geostatistics for the Reservoir Engineer and Geoscientist", Scientific Software Intercomp, 1994.
Brochure, No Title, The Andrews Group International, 1997 and including 2 sheets regarding Semi–Variogram program.

*Primary Examiner*—Hoang Dang
(74) *Attorney, Agent, or Firm*—Holland & Knight LLP

(57) ABSTRACT

The present invention relates to a method whereby two well locations are employed to find a distribution of points where additional well locations can be found. The distribution of points form an arc defined as a trap slice. This distribution is determined in accordance with the equation $$A_n = Ae^{\theta \cot \alpha}$$

wherein cot α is a constant value determined on the basis of geometric data complied from existing well locations.

9 Claims, 96 Drawing Sheets

*FIG. 9*

THE OSEBERG FIELD IN THE VIKING BASIN OF NORWAY

| DATA # | WELLS PAIR | X DISTANCES | WELLS PAIR | Y DISTANCES |
|---|---|---|---|---|
| 1 | □03-□0912 | 17095.86 | □01-□0901 | 10575.76 |
| 2 | □17-□0912 | 16563.34 | □01-□0902 | 5813.077 |
| 3 | □17-□0912 | 16563.34 | □01-□21 | 10229.76 |
| 4 | □C01-□0902 | 16146.62 | □12-□0902 | 9980.013 |
| 5 | □06-□0901 | 15637.63 | □17-□09B01 | 9669.314 |
| 6 | □12-□0912 | 13739.32 | □02-□0902 | 8484.379 |
| 7 | □06-□09B01 | 13225.67 | □07-□017 | 8166.117 |
| 8 | □03-□0901 | 13096.64 | □C01-□C27H | 8097.879 |
| 9 | □03-□0901 | 13096.64 | □17-□21 | 8092.649 |
| 10 | □C01-□09B01 | 13096.53 | □C01-□C27H | 8097.879 |
| 11 | □C01-□09B01 | 13096.53 | □17-□21 | 8092.649 |
| 12 | □12-□14 | 12948.45 | □C27H-□09B01 | 7997.202 |
| 13 | □12-□14 | 12948.45 | □09-□17 | 7992.923 |
| 14 | □02-□0912 | 12612.4 | □06-□09B49 | 7794.509 |
| 15 | □07-□12 | 10616.81 | □06-□21 | 6552.38 |
| 16 | □01-□21 | 10229.76 | □09-012 | 6314.556 |
| 17 | □02-□0901 | 9248.767 | □03-0C27H | 5722.664 |
| 18 | □02-□0901 | 9248.767 | □12-□C27H | 5720.433 |
| 19 | □02-□06 | 9054.166 | □09-□C27H | 5597.858 |
| 20 | □02-□0902 | 8484.379 | □02-□04 | 5243.587 |
| 21 | □10st-□09B49 | 8148.059 | □02-□03 | 5034.264 |
| 22 | □01-□06 | 7101.335 | □04-□0901 | 4383.934 |
| 23 | □0912-□09B01 | 6985.999 | □03-□06 | 4311.281 |
| 24 | □10st-□12 | 6519.746 | □02-□09 | 4031.801 |
| 25 | □06-□07 | 5479.986 | □0901-□0902 | 3392.159 |
| 26 | □06-□07 | 5479.986 | □02-□12 | 3387.389 |
| 27 | □04-□12 | 5184.451 | □06-□10st | 3213.695 |
| 28 | □0902-□09B01 | 3218.047 | □01-□02 | 1991.231 |
| 29 | □06-□10st | 3213.695 | □01-□02 | 1991.231 |

*FIG. 11*

THE OSEBERG FIELD IN THE VIKING BASIN OF NORWAY

| X DISTANCE | Y DISTANCE | Y' DISTANCE | Y-Y' DISTANCE |
|---|---|---|---|
| 17095.86 | 10575.76 | 10564.15 | 11.61133 |
| 16563.34 | 5813.077 | 10235.16 | 5.203125 |
| 16563.34 | 10229.76 | 10235.16 | -5.397461 |
| 16146.62 | 9980.013 | 9977.707 | 2.305664 |
| 15637.63 | 9669.314 | 9663.252 | 6.0625 |
| 13739.32 | 8484.379 | 8490.473 | -6.09375 |
| 13225.67 | 8166.117 | 8173.139 | -7.021484 |
| 13096.64 | 8097.879 | 8093.424 | 4.455078 |
| 13096.64 | 8092.649 | 8093.424 | -0.7749023 |
| 13096.53 | 8097.879 | 8093.356 | 4.522949 |
| 13096.53 | 8092.649 | 8093.356 | -0.7070313 |
| 12948.45 | 7997.202 | 8001.872 | -4.669922 |
| 12948.45 | 7992.923 | 8001.872 | -8.949219 |
| 12612.4 | 7794.509 | 7794.26 | 0.2490234 |
| 10616.81 | 6552.38 | 6561.38 | -9.000488 |
| 10229.76 | 6314.556 | 6322.261 | -7.694824 |
| 9248.767 | 5722.664 | 5716.201 | 6.462891 |
| 9248.767 | 5720.433 | 5716.201 | 4.231934 |
| 9054.166 | 5597.858 | 5595.977 | 1.881348 |
| 8484.379 | 5243.587 | 5243.961 | -0.3745117 |
| 8148.059 | 5034.264 | 5036.183 | -1.918457 |
| 7101.335 | 4383.934 | 4389.515 | -5.580566 |
| 6985.999 | 4311.281 | 4318.26 | -6.979004 |
| 6519.746 | 4031.801 | 4302.08 | 1.593018 |
| 5479.986 | 3392.159 | 3387.842 | 4.31665 |

FIG. 15

THE CAPTAIN FIELD IN THE MORAY OFFSHORE BASIN OF THE UNITED KINGDOM

| DATA # | WELLS PAIR | X DISTANCES | WELLS PAIR | Y DISTANCES |
|---|---|---|---|---|
| 1 | C08-C15 | 6454.585 | C06-C15 | 3991.864 |
| 2 | C16-C17 | 6122.529 | C05-C09A | 3780.627 |
| 3 | C11st-C12s | 4899.439 | C01-C03 | 3029.759 |
| 4 | C10-C15 | 4845.862 | C06-C11st | 2997.25 |
| 5 | C03-C15 | 4192.595 | C07-C16 | 2596.091 |
| 6 | C06-C14 | 4037.261 | C09A-C12s | 2493.615 |
| 7 | C06-C14 | 4037.261 | C09A-C12s | 2490.465 |
| 8 | C06-C13 | 4036.438 | C09A-C12s | 2493.615 |
| 9 | C06-C13 | 4036.438 | C09A-C17 | 2490.465 |
| 10 | C06-C13 | 4036.438 | C09A-C11st | 2489.985 |
| 11 | C09A-C16 | 4025.995 | C09A-C17 | 2490.465 |
| 12 | C09A-C16 | 4025.995 | C09A-C11st | 2489.985 |
| 13 | C09A-C16 | 4025.995 | C06-C12s | 2487.081 |
| 14 | C06-C15 | 3991.864 | C01-C10 | 2469.635 |
| 15 | C10-C17 | 3715.292 | C06-C07 | 2299.804 |
| 16 | C10-C17 | 3715.292 | C02-C10 | 2295.783 |
| 17 | C10-C16 | 3513.501 | C03-C13 | 2172.584 |
| 18 | C06-C17 | 3488.957 | C15-C17 | 2152.788 |
| 19 | C06-C11st | 2997.25 | C08-C10 | 1851.004 |
| 20 | C10-C13 | 2782 | C12s-C14 | 1723.909 |
| 21 | C03-C11st | 2747.604 | C03-C09A | 1699.916 |
| 22 | C01-C14 | 2729.472 | C02-C12s | 1687.035 |
| 23 | C03-C13 | 2172.584 | C10-C12s | 1342.856 |
| 24 | C05-C12s | 2009.895 | C02-C16 | 1240.101 |
| 25 | C08-C10 | 1851.004 | C01-C13 | 1146.563 |
| 26 | C12s-C14 | 1723.909 | C02-C05 | 1060.552 |
| 27 | C01-C07 | 1549.059 | C07-C08 | 959.0715 |

FIG. 17

THE CAPTAIN FIELD IN THE MORAY BASIN OF UNITED KINGDOM

| X DISTANCES | Y DISTANCES | Y' DISTANCES | Y-Y'DISTANCES |
|---|---|---|---|
| 6454.585 | 3991.864 | 3989.43 | 2.434326 |
| 6122.529 | 3780.627 | 3784.18 | -3.552979 |
| 4899.439 | 3029.759 | 3028.167 | 1.592529 |
| 4845.862 | 2997.25 | 2995.05 | 2.200439 |
| 4192.595 | 2596.091 | 2591.254 | 4.837158 |
| 4037.261 | 2493.615 | 2495.239 | -1.624268 |
| 4037.261 | 2490.465 | 2495.239 | -4.77417 |
| 4036.438 | 2493.615 | 2494.73 | -1.115479 |
| 4036.438 | 2490.465 | 2494.73 | -4.265381 |
| 4036.438 | 2489.985 | 2494.73 | -4.745361 |
| 4025.995 | 2490.465 | 2488.276 | 2.189453 |
| 4025.995 | 2489.985 | 2488.276 | 1.709473 |
| 4025.995 | 2487.081 | 2488.276 | -1.19458 |
| 3991.864 | 2469.635 | 2467.178 | 2.456543 |
| 3715.292 | 2299.804 | 2296.224 | 3.57959 |
| 3715.292 | 2295.783 | 2296.224 | -0.4414063 |
| 3513.501 | 2172.584 | 2171.494 | 1.090088 |
| 3488.957 | 2152.788 | 2156.323 | -3.534668 |
| 2997.25 | 1851.004 | 1852.39 | -1.385986 |
| 2782 | 1723.909 | 1719.34 | 4.568848 |
| 2747.604 | 1699.916 | 1698.079 | 1.836548 |
| 2729.472 | 1687.035 | 1686.872 | 0.163301 |
| 2172.584 | 1342.856 | 1342.649 | 0.206543 |
| 2009.895 | 1240.101 | 1242.089 | -1.987549 |
| 1851.004 | 1146.563 | 1143.875 | 2.687744 |
| 1723.909 | 1060.552 | 1065.316 | -4.76355 |
| 1549.059 | 959.0715 | 957.2376 | 1.833862 |

*FIG. 20*

THE IZOZOG FIELD IN THE TARIJA BASIN OF ARGENTINA-BOLIVIA

| DATA # | WELLS PAIR | X DISTANCES | WELLS PAIR | Y DISTANCES |
|---|---|---|---|---|
| 1 | IZ4-IZ12 | 49466.57 | IZ8-IZ12 | 42937.67 |
| 2 | IZ6-IZ9 | 61657.9 | IZ6-IZ7 | 38135.56 |
| 3 | IZ3-IZ5 | 56172.48 | IZ1-IZ6 | 34723.59 |
| 4 | IZ2-IZ9 | 46442.02 | IZ2-IZ12 | 28702.02 |
| 5 | IZ2-IZ8 | 37324.62 | IZ6-IZ10 | 23111.01 |
| 6 | IZ3-IZ7 | 35730.16 | IZ3-IZ8 | 22115.69 |
| 7 | IZ1-IZ3 | 22812.23 | IZA-IZ6 | 14142.98 |
| 8 | IZ2-IZ7 | 22115.69 | IZ3-IZ7 | 13626.13 |
| 9 | IZ2-IZ11 | 11157.18 | IZ3-IZ11 | 6861.518 |

*FIG. 22*

STATISTICAL CALCULATIONS

THE IZOZOG FIELD IN THE TARIJA BASIN OF ARGENTINA-BOLIVIA

| X DISTANCES | Y DISTANCES | Y' DISTANCES | Y-Y'DISTANCES |
|---|---|---|---|
| 49466.57 | 42937.67 | 42956.81 | -19.13672 |
| 61657.9 | 38135.56 | 38126.85 | 8.710938 |
| 56172.48 | 34723.59 | 34733.91 | -10.31641 |
| 46442.02 | 28702.02 | 28715.25 | -13.22656 |
| 37324.62 | 23111.01 | 23075.79 | 35.22266 |
| 35730.16 | 22115.69 | 22089.55 | 26.13867 |
| 22812.23 | 14142.98 | 14099.32 | 43.66211 |
| 22115.69 | 13626.13 | 13668.48 | -42.35156 |
| 11157.18 | 6861.518 | 6890.224 | -28.70605 |

*FIG. 23*

| COUNTRY | No. OF WELLS | OIL FIELD | DISTANCE PAIRS | CONSTANT OR SLOPE B |
|---|---|---|---|---|
| NORWAY | 19 | OSEBERG | 29 | 0.6178017 |
| NORWAY | 26 | GULLFAKS | 106 | 0.6181161 |
| NORWAY | 28 | TROLL | 65 | 0.6181058 |
| UNITED KINGDOM | 16 | CAPTAIN | 27 | 0.6181176 |
| BRAZIL | 25 | ALBACORA | 126 | 0.6180876 |
| BRAZIL | 24 | MARLIN | 68 | 0.6179149 |
| ARGENTINA | 12 | IZOZOG | 9 | 0.6185382 |
| ARGENTINA | 37 | TSX,P | 37 | 0.6179236 |
| MEXICO | 31 | CASTARRICAL | 187 | 0.6178003 |
| MEXICO | 38 | MECOACAN | 226 | 0.6178003 |
| AVERAGE = 0.61804 | | | | |

CAPTAIN FIELD IN UNITED KINGDOM, 16 WELLS

SELECTING ANY FIRST ORIGIN WELL C07 AND ANY SECOND WELL C14, FROM OIL CAPTAIN FIELD.

SELECTING ANY FIRST ORIGIN WELL C07 AND ANY SECOND WELL C14, THE DISTANCE IS CALCULATING BETWEEN BOTH WITH THE DISTANCE FORMULA (EQ. 1).

THE DISTANCE BETWEEN C07 AND C14 WELLS IS DIVIDED IN THE DISTANCE A, USING THE CLAIMED EQUATION.

USING THE DISTANCE A, IN THE EXPONENTIAL EQUATION TO OBTAIN A SEQUENCE GROWTH FROM THE ORIGIN C14 WELL.

USING THE DISTANCES An, THE EXPONENTIAL EQUATION TO OBTAIN A SEQUENCE GROWTH FROM THE SECOND C07 WELL.

BOTH SEQUENCES OF GROWTH MATCH A POINTS SEQUENCE.

THESE POINTS DISTRIBUTION FROM 1 TO 60 , MATCH THE GEOGRAPHICAL PLACE OF SOME THIRD PRODUCING C12 WELL.

FIG. 31A

THE COORDINATES BELONG TO THE POINTS DISTRIBUTION BETWEEN THE C14 AND C07 WELLS IN THE FIELD OIL CAPTAIN

| POINT | X (UTM) | Y (UTM) | POINT | X (UTM) | Y (UTM) |
|---|---|---|---|---|---|
| 1 | 572717 | 6464194 | 31 | 573239 | 6464879 |
| 2 | 572749 | 6464253 | 32 | 573254 | 6464893 |
| 3 | 572776 | 6464299 | 33 | 573270 | 6464907 |
| 4 | 572799 | 6464338 | 34 | 573286 | 6464921 |
| 5 | 572820 | 6464372 | 35 | 573301 | 6464935 |
| 6 | 572840 | 6464403 | 35 | 573317 | 6464949 |
| 7 | 572859 | 6464431 | 37 | 573333 | 6464963 |
| 8 | 572877 | 6464458 | 38 | 573349 | 6464977 |
| 9 | 572895 | 6464483 | 39 | 573365 | 6464990 |
| 10 | 572912 | 6464507 | 40 | 573382 | 6465003 |
| 11 | 572929 | 6464530 | 41 | 573398 | 6465016 |
| 12 | 572945 | 6464552 | 42 | 573414 | 6465029 |
| 13 | 572961 | 6464573 | 43 | 573431 | 6465042 |
| 14 | 572977 | 6464593 | 44 | 573448 | 6465055 |
| 15 | 572993 | 6464613 | 45 | 573464 | 6465068 |
| 16 | 573009 | 6464632 | 46 | 573481 | 6465080 |
| 17 | 573024 | 6464651 | 47 | 573498 | 6465093 |
| 18 | 573040 | 6464669 | 48 | 573516 | 6465105 |
| 19 | 573055 | 6464687 | 49 | 573533 | 6465117 |
| 20 | 573070 | 6464705 | 50 | 573550 | 6465129 |
| 21 | 573086 | 6464722 | 51 | 573568 | 6465141 |
| 22 | 573101 | 6464739 | 52 | 573586 | 6465153 |
| 23 | 573116 | 6464755 | 53 | 573604 | 6465165 |
| 24 | 573131 | 6464772 | 54 | 573622 | 6465177 |
| 25 | 573147 | 6464787 | 55 | 573640 | 6465188 |
| 26 | 573162 | 6464803 | 56 | 573658 | 6465200 |
| 27 | 573177 | 6464819 | 57 | 573677 | 6465211 |
| 28 | 573192 | 6464834 | 58 | 573696 | 6465222 |
| 29 | 573208 | 6464849 | 59 | 573715 | 6465233 |
| 30 | 573223 | 6464864 | 60 | 573734 | 6465244 |

TAKING ANY TWO PRODUCING WELLS A TRAPSLICE IS FINDING ANY THIRD WELL THAT IS KNOWN TO PRODUCE A FOSSIL FUEL.

THESE POINTS DISTRIBUTION FROM 1 TO 70, MATCH THE GEOGRAPHICAL PLACE OF SOME THIRD PRODUCING C17 WELL.

FIG. 33A

THE COORDINATES BELONG TO THE POINTS DISTRIBUTION BETWEEN THE C03 AND C06 WELLS IN THE FIELD OIL CAPTAIN

| POINT | X (UTM) | Y (UTM) | POINT | X (UTM) | Y (UTM) |
|---|---|---|---|---|---|
| 1 | 575653 | 6463221 | 36 | 576895 | 6463076 |
| 2 | 575741 | 6463226 | 37 | 576821 | 6463068 |
| 3 | 575809 | 6463229 | 38 | 576947 | 6463060 |
| 4 | 575868 | 6463229 | 39 | 576973 | 6463051 |
| 5 | 575920 | 6463229 | 40 | 576999 | 6463042 |
| 6 | 575967 | 6463229 | 41 | 577024 | 6463033 |
| 7 | 576012 | 6463227 | 42 | 577050 | 6463024 |
| 8 | 576054 | 6463225 | 43 | 577075 | 6463015 |
| 9 | 576093 | 6463223 | 44 | 577101 | 6463005 |
| 10 | 576131 | 6463221 | 45 | 577126 | 6462995 |
| 11 | 576168 | 6463218 | 46 | 577152 | 6462985 |
| 12 | 576203 | 6463215 | 47 | 577177 | 6462975 |
| 13 | 576238 | 6463211 | 48 | 577202 | 6462964 |
| 14 | 576271 | 6463208 | 49 | 577227 | 6462953 |
| 15 | 576304 | 6463204 | 50 | 577253 | 6462942 |
| 16 | 576335 | 6463200 | 51 | 577278 | 6462931 |
| 17 | 576367 | 6463195 | 52 | 577303 | 6462920 |
| 18 | 576397 | 6463191 | 53 | 577328 | 6462908 |
| 19 | 576428 | 6463186 | 54 | 577354 | 6462896 |
| 20 | 576457 | 6463181 | 55 | 577379 | 6462884 |
| 21 | 576487 | 6463176 | 56 | 577404 | 6462871 |
| 22 | 576516 | 6463171 | 57 | 577429 | 6462859 |
| 23 | 576544 | 6463165 | 58 | 577454 | 6462846 |
| 24 | 576572 | 6463160 | 59 | 577479 | 6462833 |
| 25 | 576600 | 6463154 | 60 | 577504 | 6462819 |
| 26 | 576628 | 6463148 | 61 | 577529 | 6462805 |
| 27 | 576656 | 6463141 | 62 | 577555 | 6462791 |
| 28 | 576683 | 6463135 | 63 | 577580 | 6462777 |
| 29 | 576710 | 6463128 | 64 | 577605 | 6462762 |
| 30 | 576737 | 6463121 | 65 | 577630 | 6462747 |
| 31 | 576764 | 6463114 | 66 | 577655 | 6462732 |
| 32 | 576790 | 6463107 | 67 | 577680 | 6462717 |
| 33 | 576817 | 6463100 | 68 | 577705 | 6462701 |
| 34 | 576843 | 6463092 | 69 | 577730 | 6462685 |
| 35 | 576869 | 6463084 | 70 | 577755 | 6462668 |

TAKING ANY TWO PRODUCING WELLS A TRAPSLICE IS FINDING ANY THIRD PRODUCING WELL. THIS MEAN THAT THE TRAPSLICE FIND THE OIL DISTRIBUTION.

SELECTING THE C13 WELL AS ORIGIN AND C12s WELL AS SECOND, AS WELL AS C12s WELL AS ORIGIN AND C13 WELL AS SECOND, THERE ARE TWO TRAPSLICES THAT ARE FINDING TWO WELLS; C01 AND C08 REPECTIVELY.

SELECTING ANY TWO WELLS, THERE ARE TWO SYMMETRCAL TRAPSLICES TO THE HALF DISTANCE BETWEEN THE WELLS.

SELECTING ANY TWO WELLS, THERE ARE TWO SYMMETRICAL TRAPSLICES TO THE DISTANCE BETWEEN THE WELLS, THE C09 AND C06 WELLS ARE GEOGRAPHICAL MATCHING TOO.

IN GENERAL, ANY TWO WELLS HAVE FOUR SEQUENCES OF TRAP WITH SHAPE, DIRECTION AND SYMMETRICAL TO THE DISTANCE BETWEEN THE WELLS. THE FIVE CONDITIONS OF PRODUCING OIL TRAP ARE ON THESE TRAPSLICES.

THE CAPTAIN FIELD HAS THESE TRAPSLICES BETWEEN ALL POSSIBLE TWO WELLS AND MATCHING THE GEOGRAPHICAL PLACES OF THE PRODUCTION OF FOSSIL FUEL.

FIG. 40

THE ANGLE IS THE INDEPENDENT VARIABLE AND THE DEPENDENT VARIABLE THE DISTANCES FROM THE ORIGIN WELL TO THE PLACES OF WELLS THAT ARE BETWEEN TWO WELLS, ADJUST ONE LINEAL FUNCTION.
THE C03 AND C06 WELLS BELONG TO THE CAPTAIN FIELD IN U. KINGDOM.

| ANGLE ⊖ | SEQUENCE1 | ANGLE ⊖ | SEQUENCE 2 | ANGLE ⊖ | SEQUENCE1 |
|---|---|---|---|---|---|
| 1 | 2111 | 30 | 2664 | 59 | 3362 |
| 2 | 2128 | 31 | 2685 | 60 | 3389 |
| 3 | 2145 | 32 | 2707 | 61 | 3416 |
| 4 | 2162 | 33 | 2729 | 62 | 3443 |
| 5 | 2180 | 34 | 2751 | 63 | 3471 |
| 6 | 2197 | 35 | 2773 | 64 | 3499 |
| 7 | 2215 | 36 | 2795 | 65 | 3527 |
| 8 | 2233 | 37 | 2818 | 66 | 3556 |
| 9 | 2251 | 38 | 2840 | 67 | 3584 |
| 10 | 2269 | 39 | 2863 | 68 | 3613 |
| 11 | 2287 | 40 | 2886 | 69 | 3642 |
| 12 | 2306 | 41 | 2910 | 70 | 3672 |
| 13 | 2324 | 42 | 2933 | | |
| 14 | 2343 | 43 | 2957 | | |
| 15 | 2362 | 44 | 2980 | | |
| 16 | 2381 | 45 | 3004 | | |
| 17 | 2400 | 46 | 3029 | | |
| 18 | 2419 | 47 | 3053 | | |
| 19 | 2439 | 48 | 3078 | | |
| 20 | 2458 | 49 | 3102 | | |
| 21 | 2478 | 50 | 3127 | | |
| 22 | 2498 | 51 | 3153 | | |
| 23 | 2518 | 52 | 3178 | | |
| 24 | 2539 | 53 | 3204 | | |
| 25 | 2559 | 54 | 3229 | | |
| 26 | 2580 | 55 | 3255 | | |
| 27 | 2600 | 56 | 3282 | | |
| 28 | 2621 | 57 | 3308 | | |
| 29 | 2643 | 58 | 3335 | | |

THE RELATIONSHIP BETWEEN BOTH VARIABLES IS LINEAL UNDER THE Ln FUNCTION, THEN r=1.000001, THE SLOPE IS 1.139996 RADIAN, GETTING THIS AS A CONSTANT TO EVERY TWO WELLS OF ANY OIL FIELD.

FIG. 42

THE ANGLE IS THE INDEPENDENT VARIABLE AND AS DEPENDENT VARIABLE THE DISTANCES FROM THE ORIGIN WELL TO THE PLACES OF WELLS THAT ARE BETWEEN TWO WELLS, ADJUST ONE LINEAL FUNCTION.
THE C07 AND C14 WELLS BELONG TO THE CAPTAIN FIELD IN U. KINGDOM.

| ANGLE Θ | SEQUENCE1 | ANGLE Θ | SEQUENCE 2 | ANGLE Θ | SEQUENCE1 |
|---|---|---|---|---|---|
| 1 | 1629 | 30 | 2056 | 59 | 2594 |
| 2 | 1642 | 31 | 2072 | 60 | 2615 |
| 3 | 1655 | 32 | 2089 | | |
| 4 | 1669 | 33 | 2106 | | |
| 5 | 1682 | 34 | 2123 | | |
| 6 | 1696 | 35 | 2140 | | |
| 7 | 1709 | 36 | 2157 | | |
| 8 | 1723 | 37 | 2174 | | |
| 9 | 1737 | 38 | 2192 | | |
| 10 | 1751 | 39 | 2210 | | |
| 11 | 1765 | 40 | 2227 | | |
| 12 | 1779 | 41 | 2245 | | |
| 13 | 1794 | 42 | 2263 | | |
| 14 | 1808 | 43 | 2282 | | |
| 15 | 1823 | 44 | 2300 | | |
| 16 | 1837 | 45 | 2319 | | |
| 17 | 1852 | 46 | 2337 | | |
| 18 | 1867 | 47 | 2356 | | |
| 19 | 1882 | 48 | 2375 | | |
| 20 | 1897 | 49 | 2394 | | |
| 21 | 1913 | 50 | 2413 | | |
| 22 | 1928 | 51 | 2433 | | |
| 23 | 1943 | 52 | 2453 | | |
| 24 | 1959 | 53 | 2472 | | |
| 25 | 1975 | 54 | 2492 | | |
| 26 | 1991 | 55 | 2512 | | |
| 27 | 2007 | 56 | 2532 | | |
| 28 | 2023 | 57 | 2553 | | |
| 29 | 2039 | 58 | 2573 | | |

THE RELATIONSHIP BETWEN BOTH VARIABLES IS LINEAL UNDER THE Ln FUNCTION, THEN r=1.000001, THE SLOPE IS 1.139984 RADIAN, GETTING THIS AS A CONSTANT TO EVERY TWO WELLS OF ANY OIL FIELD.

ALBACORA FIELD BELONGS TO THE SOUTH HEMISPHERE IN BRAZIL WITH 25 PRODUCING WELLS.

SELECTING A35, A32 WELLS, THIS POINTS DISTRIBUTION MATCH THE GEOGRAPHICAL PLACE OF THE A305 WELL.

FIG. 46

THE ANGLE IS THE INDEPENDENT VARIABLE AND AS DEPENDENT VARIABLE THE DISTANCES FROM THE ORIGIN WELL TO THE PLACES OF WELLS THAT ARE BETWEEN TWO WELLS, ADJUST ONE LINEAL FUNCTION.
THE A35 AND A32 WELLS BELONG TO THE ALBACORA FIELD IN BRAZIL.

| ANGLE Θ | SEQUENCE1 | ANGLE Θ | SEQUENCE 2 | ANGLE Θ | SEQUENCE1 |
|---|---|---|---|---|---|
| 1 | 2719 | 30 | 3431 | 59 | 4330 |
| 2 | 2741 | 31 | 3459 | 60 | 4365 |
| 3 | 2763 | 32 | 3487 | | |
| 4 | 2785 | 33 | 3515 | | |
| 5 | 2808 | 34 | 3543 | | |
| 6 | 2830 | 35 | 3572 | | |
| 7 | 2853 | 36 | 3601 | | |
| 8 | 2876 | 37 | 3630 | | |
| 9 | 2899 | 38 | 3659 | | |
| 10 | 2923 | 39 | 3688 | | |
| 11 | 2946 | 40 | 3718 | | |
| 12 | 2970 | 41 | 3748 | | |
| 13 | 2994 | 42 | 3778 | | |
| 14 | 3018 | 43 | 3808 | | |
| 15 | 3042 | 44 | 3839 | | |
| 16 | 3067 | 45 | 3870 | | |
| 17 | 3092 | 46 | 3901 | | |
| 18 | 3116 | 47 | 3933 | | |
| 19 | 3142 | 48 | 3964 | | |
| 20 | 3167 | 49 | 3996 | | |
| 21 | 3192 | 50 | 4028 | | |
| 22 | 3218 | 51 | 4061 | | |
| 23 | 3244 | 52 | 4094 | | |
| 24 | 3270 | 53 | 4127 | | |
| 25 | 3296 | 54 | 4160 | | |
| 26 | 3323 | 55 | 4193 | | |
| 27 | 3350 | 56 | 4227 | | |
| 28 | 3377 | 57 | 4261 | | |
| 29 | 3404 | 58 | 4295 | | |

THE SLOPE IS 1.139961 RADIANS, THE CORRELATION IS r=0.9999905, THIS MEANS A CONSTANT VALUE TO EVERY TWO WELLS IN THE ALBACORA OIL FIELD.

ANOTHER TRAPSLICE DIRECTION WITH THE PAIR A23, A34, WELLS, MATCH ANOTHER A22 WELL.

FIG. 49

THE ANGLE IS THE INDEPENDENT VARIABLE AND AS DEPENDENT VARIABLE THE DISTANCES FROM THE ORIGIN WELL TO THE PLACES OF WELLS THAT ARE BETWEEN TWO WELLS, ADJUST ONE LINEAL FUNCTION.
THE A23 AND A34 WELLS BELONG TO THE ALBACORA FIELD IN BRAZIL.

| ANGLE ⊖ | SEQUENCE1 | ANGLE ⊖ | SEQUENCE 2 | ANGLE ⊖ | SEQUENCE1 |
|---|---|---|---|---|---|
| 1 | 1987 | 30 | 2507 | 59 | 3164 |
| 2 | 2003 | 31 | 2527 | 60 | 3189 |
| 3 | 2019 | 32 | 2548 | | |
| 4 | 2035 | 33 | 2568 | | |
| 5 | 2051 | 34 | 2589 | | |
| 6 | 2068 | 35 | 2610 | | |
| 7 | 2085 | 36 | 2631 | | |
| 8 | 2101 | 37 | 2652 | | |
| 9 | 2118 | 38 | 2673 | | |
| 10 | 2135 | 39 | 2695 | | |
| 11 | 2153 | 40 | 2716 | | |
| 12 | 2170 | 41 | 2738 | | |
| 13 | 2187 | 42 | 2760 | | |
| 14 | 2205 | 43 | 2783 | | |
| 15 | 2223 | 44 | 2805 | | |
| 16 | 2241 | 45 | 2828 | | |
| 17 | 2259 | 46 | 2850 | | |
| 18 | 2277 | 47 | 2873 | | |
| 19 | 2295 | 48 | 2896 | | |
| 20 | 2314 | 49 | 2920 | | |
| 21 | 2332 | 50 | 2943 | | |
| 22 | 2351 | 51 | 2967 | | |
| 23 | 2370 | 52 | 2991 | | |
| 24 | 2389 | 53 | 3015 | | |
| 25 | 2408 | 54 | 3039 | | |
| 26 | 2428 | 55 | 3064 | | |
| 27 | 2447 | 56 | 3088 | | |
| 28 | 2467 | 57 | 3113 | | |
| 29 | 2487 | 58 | 3138 | | |

THE SLOPE IS 1.139998 RADIANS, THE CORRELATION IS r=1.00001, THIS MEANS A CONSTANT VALUE TO EVERY TWO WELLS IN THE ALBACORA OIL FIELD.

MECOACAN OIL FIELD OF THE COMALCALCO BASIN IN MEXICO WITH 38 PRODUCING WELLS.

SELECTING ANOTHER PAIR OF WELLS, 10 WELL AS THE ORIGIN AND 1 WELL AS THE SECOND. THERE IS AT LEAST ONE POINTS DISTRIBUTION MATCHING THE GEOGRAPHICAL PLACE OF THE 6 WELL.

FIG. 53

USING THE ANGLE AS INDEPENDENT VARIABLE AND AS DEPENDENT VARIABLE THE DISTANCES FROM THE ORIGIN WELL TO THE PLACES OF WELLS THAT ARE BETWEEN TWO WELLS, ADJUST ONE LINEAL FUNCTION.

THE10 AND 1WELLS BELONG TO THE MECOACAN FIELD IN MEXICO.

| ANGLE ⊖ | SEQUENCE1 | ANGLE ⊖ | SEQUENCE 2 | ANGLE ⊖ | SEQUENCE1 |
|---|---|---|---|---|---|
| 1 | 903 | 30 | 1140 | 59 | 1439 |
| 2 | 911 | 31 | 1149 | 60 | 1450 |
| 3 | 918 | 32 | 1158 | | |
| 4 | 925 | 33 | 1168 | | |
| 5 | 933 | 34 | 1177 | | |
| 6 | 940 | 35 | 1187 | | |
| 7 | 948 | 36 | 1196 | | |
| 8 | 955 | 37 | 1206 | | |
| 9 | 963 | 38 | 1215 | | |
| 10 | 971 | 39 | 1225 | | |
| 11 | 979 | 40 | 1235 | | |
| 12 | 987 | 41 | 1245 | | |
| 13 | 995 | 42 | 1255 | | |
| 14 | 1003 | 43 | 1265 | | |
| 15 | 1011 | 44 | 1275 | | |
| 16 | 1019 | 45 | 1286 | | |
| 17 | 1027 | 46 | 1296 | | |
| 18 | 1035 | 47 | 1307 | | |
| 19 | 1044 | 48 | 1317 | | |
| 20 | 1052 | 49 | 1328 | | |
| 21 | 1060 | 50 | 1338 | | |
| 22 | 1069 | 51 | 1349 | | |
| 23 | 1078 | 52 | 1360 | | |
| 24 | 1086 | 53 | 1371 | | |
| 25 | 1095 | 54 | 1382 | | |
| 26 | 1104 | 55 | 1393 | | |
| 27 | 1113 | 56 | 1404 | | |
| 28 | 1122 | 57 | 1416 | | |
| 29 | 1131 | 58 | 1427 | | |

THE MECOACAN FIELD HAS THE SAME SLOPE VALUE OF 1.39959 RADIANS AND THE CORRELATION R=1.000008 TO THE PAIR OF WELLS 10 AND 1.

SELECTING ANOTHER PAIR OF WELLS, 2 WELL AS THE ORIGIN AND 32 WELL. THERE IS AT LEAST ONE POINTS ONE POINTS DISTRIBUTION MATCHING THE GEOGRAPHICAL PLACES OF THE 14 AND 15 WELLS.

FIG. 56

USING THE ANGLE AS INDEPENDENT VARIABLE AND AS DEPENDENT VARIABLE THE DISTANCES FROM THE ORIGIN WELL TO THE PLACES OF WELLS THAT ARE BETWEEN TWO WELLS, ADJUST ONE LINEAL FUNCTION.

THE2 AND 32WELLS BELONG TO THE MECOACAN FIELD IN MEXICO.

| ANGLE ⊖ | SEQUENCE1 | ANGLE ⊖ | SEQUENCE 2 | ANGLE ⊖ | SEQUENCE1 |
|---|---|---|---|---|---|
| 1 | 2678 | 30 | 3379 | 59 | 4265 |
| 2 | 2700 | 31 | 3407 | 60 | 4299 |
| 3 | 2721 | 32 | 3434 | | |
| 4 | 2743 | 33 | 3462 | | |
| 5 | 2765 | 34 | 3490 | | |
| 6 | 2788 | 35 | 3518 | | |
| 7 | 2810 | 36 | 3546 | | |
| 8 | 2833 | 37 | 3575 | | |
| 9 | 2856 | 38 | 3603 | | |
| 10 | 2879 | 39 | 3632 | | |
| 11 | 2902 | 40 | 3662 | | |
| 12 | 2925 | 41 | 3691 | | |
| 13 | 2949 | 42 | 3721 | | |
| 14 | 2972 | 43 | 3751 | | |
| 15 | 2996 | 44 | 3781 | | |
| 16 | 3021 | 45 | 3812 | | |
| 17 | 3045 | 46 | 3842 | | |
| 18 | 3069 | 47 | 3873 | | |
| 19 | 3094 | 48 | 3904 | | |
| 20 | 3119 | 49 | 3936 | | |
| 21 | 3144 | 50 | 3968 | | |
| 22 | 3169 | 51 | 4000 | | |
| 23 | 3195 | 52 | 4032 | | |
| 24 | 3221 | 53 | 4064 | | |
| 25 | 3247 | 54 | 4097 | | |
| 26 | 3273 | 55 | 4130 | | |
| 27 | 3299 | 56 | 4163 | | |
| 28 | 3326 | 57 | 4197 | | |
| 29 | 3352 | 58 | 4230 | | |

THE MECOACAN FIELD HAS THE SAME SLOPE VALUE OF 1.39959 RADIANS AND THE CORRELATION R=1.000008 TO THE PAIR OF WELLS 2 AND 32.

THE MECOACAN FIELD HAS THE SAME SLOPE VALUE TO ALL THE POINTS DISTRIBUTION BETWEEN ANY PAIR OF WELLS.

IZOZOG FIELD IN ARGENTINA, WITH 12 WELLS.

SELECTING THE IZ3 AND IZ2 WELLS, THERE IS AT LEAST ONE POINTS DISTRIBUTION MATCHING THE GEOGRAPHICAL PLACE OF THE IZ11 WELL.

FIG. 61

THE ANGLE IS THE INDEPENDENT VARIABLE AND THE DEPENDENT VARIABLE THE DISTANCES FROM THE ORIGIN WELL TO THE PLACES OF WELLS THAT ARE BETWEEN TWO WELLS, ADJUST ONE LINEAL FUNCTION.
THE IZ3 AND IZ2 WELLS BELONG TO THE IZOZOG FIELD IN ARGENTINA.

| ANGLE Θ | SEQUENCE1 | ANGLE Θ | SEQUENCE 2 | ANGLE Θ | SEQUENCE1 |
|---|---|---|---|---|---|
| 1 | 8021 | 30 | 10121 | 59 | 12772 |
| 2 | 8085 | 31 | 10203 | 60 | 12875 |
| 3 | 8151 | 32 | 10285 | | |
| 4 | 8216 | 33 | 10368 | | |
| 5 | 8282 | 34 | 10451 | | |
| 6 | 8349 | 35 | 10535 | | |
| 7 | 8416 | 36 | 10620 | | |
| 8 | 8484 | 37 | 10706 | | |
| 9 | 8552 | 38 | 10792 | | |
| 10 | 8621 | 39 | 10879 | | |
| 11 | 8691 | 40 | 10967 | | |
| 12 | 8761 | 41 | 11055 | | |
| 13 | 8831 | 42 | 11144 | | |
| 14 | 8902 | 43 | 11234 | | |
| 15 | 8974 | 44 | 11324 | | |
| 16 | 9046 | 45 | 11415 | | |
| 17 | 9119 | 46 | 11507 | | |
| 18 | 9193 | 47 | 11600 | | |
| 19 | 9267 | 48 | 11693 | | |
| 20 | 9341 | 49 | 11787 | | |
| 21 | 9416 | 50 | 11882 | | |
| 22 | 9492 | 51 | 11978 | | |
| 23 | 9569 | 52 | 12074 | | |
| 24 | 9646 | 53 | 12172 | | |
| 25 | 9723 | 54 | 12270 | | |
| 26 | 9802 | 55 | 12369 | | |
| 27 | 9881 | 56 | 12468 | | |
| 28 | 9960 | 57 | 12569 | | |
| 29 | 10040 | 58 | 12670 | | |

THE IZOZOG FIELD HAS THE SLOPE VALUE OF 1.140025 RADIANS AND THE CORRELATION R=0.999984 TO THE PAIR OF WELLS IZ3 AND IZ2.

SELECTING THE IZ12 AND IZ9 WELLS, THERE IS AT LEAST ONE POINTS DISTRIBUTION MATCHING THE GEOGRAPHICAL PLACE OF THE IZ2 WELL.

FIG. 64

THE ANGLE IS THE INDEPENDENT VARIABLE AND THE DEPENDENT VARIABLE THE DISTANCES FROM THE ORIGIN WELL TO THE PLACES OF WELLS THAT ARE BETWEEN TWO WELLS, ADJUST ONE LINEAL FUNCTION.

THE IZ12 AND IZ9 WELLS BELONG TO THE IZOZOG FIELD IN ARGENTINA.

| ANGLE Θ | SEQUENCE1 | ANGLE Θ | SEQUENCE 2 | ANGLE Θ | SEQUENCE1 |
|---|---|---|---|---|---|
| 1 | 32870 | 30 | 41477 | 59 | 52339 |
| 2 | 33135 | 31 | 41811 | 60 | 52760 |
| 3 | 33402 | 32 | 42148 | | |
| 4 | 33671 | 33 | 42488 | | |
| 5 | 33942 | 34 | 42830 | | |
| 6 | 34215 | 35 | 43175 | | |
| 7 | 34490 | 36 | 43522 | | |
| 8 | 34768 | 37 | 43873 | | |
| 9 | 35048 | 38 | 44226 | | |
| 10 | 35330 | 39 | 44582 | | |
| 11 | 35615 | 40 | 44941 | | |
| 12 | 35902 | 41 | 45303 | | |
| 13 | 36191 | 42 | 45668 | | |
| 14 | 36482 | 43 | 46036 | | |
| 15 | 36776 | 44 | 46406 | | |
| 16 | 37072 | 45 | 46780 | | |
| 17 | 37371 | 46 | 47157 | | |
| 18 | 37672 | 47 | 47536 | | |
| 19 | 37975 | 48 | 47919 | | |
| 20 | 38281 | 49 | 48305 | | |
| 21 | 38589 | 50 | 48694 | | |
| 22 | 38900 | 51 | 49086 | | |
| 23 | 39213 | 52 | 49481 | | |
| 24 | 39529 | 53 | 49880 | | |
| 25 | 29847 | 54 | 50282 | | |
| 26 | 40168 | 55 | 50686 | | |
| 27 | 40491 | 56 | 51095 | | |
| 28 | 40817 | 57 | 51506 | | |
| 29 | 41146 | 58 | 51921 | | |

THE IZOZOG FIELD HAS THE SLOPE VALUE OF 1.140048 RADIANS AND THE CORRELATION R=1.000003 TO THE PAIR OF WELLS IZ12 AND IZ9.

THE IZOZOG FIELD HAS THE SAME SLOPE VALUE TO ALL THE POINTS DISTRIBUTION BETWEEN ANY PAIR OF WELLS.

FIG. 67
WELLS AND X,Y (U.T.M.)

| WELLS | OIL FIELD | X (U.T.M.) | Y (U.T.M.) |
|---|---|---|---|
| A35 | ALBACORA | 405975 | 7552375 |
| A32 | ALBACORA | 404700 | 7556550 |
| A23 | ALBACORA | 405900 | 7554300 |
| A34 | ALBACORA | 406348 | 7557458 |
| C03 | CAPTAIN | 575614 | 6461917 |
| C06 | CAPTAIN | 575175 | 6465277 |
| C07 | CAPTAIN | 573557 | 6463638 |
| C14 | CAPTAIN | 571173 | 6464714 |
| IZ3 | IZOZOG | 555954 | 2150240 |
| IZ2 | IZOZOG | 562873 | 2139382 |
| IZ12 | IZOZOG | 553081 | 2184780 |
| IZ9 | IZOZOG | 590406 | 2147490 |
| 10 | MECOACAN | 488805 | 2027500 |
| 1 | MECOACAN | 487415 | 2027915 |
| 2 | MECOACAN | 487775 | 2027915 |
| 32 | MECOACAN | 491905 | 2028495 |
| | | | |

FIG. 68

THE AVERAGE CONSTANT OR SLOPE OBTAINED FOR ALL DATA FROM
THE FIELDS ANALYZED WAS=1.139990 RADIANS.

| COUNTRY | PAIR OF WELLS | OIL FIELD | DISTANCE BETWEEN PAIRS IN METERS | CONSTANT OR SLOPE IN RADIANS |
|---|---|---|---|---|
| BRAZIL | A35–A32 | ALBACORA | 4365 | 1.139961 |
| BRAZIL | A23–A34 | ALBACORA | 3189 | 1.139998 |
| UNITED KINGDOM | C03–C06 | CAPTAIN | 3389 | 1.13996 |
| UNITED KINGDOM | C07–C14 | CAPTAIN | 2615 | 1.139984 |
| ARGENTINA | IZ3–IZ2 | IZOZOG | 12875 | 1.139988 |
| ARGENTINA | IZ12–IZ9 | IZOZOG | 52760 | 1.139988 |
| MEXICO | 10–1 | MECOACAN | 1450 | 1.140025 |
| MEXICO | 2–32 | MECOACAN | 4299 | 1.140048 |
| AVERAGE = 1.139990 | | | | |

TOTAL POINTS DISTRIBUTIONS IN FIRST DIRECTION ON GULLFAKS FIELD OF VIKINGS BASIN IN NORWAY.

TOTAL POINTS DISTRIBUTIONS IN FIFTH DIRECTION ON GULLFAKS FIELD OF VIKINGS BASIN IN NORWAY.

TOTAL POINTS DISTRIBUTIONS IN SIXTH DIRECTION ON GULLFAKS FIELD OF VIKINGS BASIN IN NORWAY.

TOTAL POINTS DISTRIBUTIONS IN SEVENTH DIRECTION ON GULLFAKS FIELD OF VIKINGS BASIN IN NORWAY.

TOTAL POINTS DISTRIBUTIONS IN EIGHTH DIRECTION ON GULLFAKS FIELD OF VIKINGS BASIN IN NORWAY.

OBSERVING THE DISTRIBUTION OF POINTS BETWEEN THE PRODUCING WELLS GA09A AND GS33 THAT FINDS ANOTHER WELL. THE GA02H GULLFAKS WELL.

OBSERVING THE DISTRIBUTION OF POINTS BETWEEN THE PRODUCING WELLS G03 AND GS33 THAT FINDS ANOTHER WELL. THE G19 GULLFAKS WELL.

OBSERVING THE DISTRIBUTION OF POINTS BETWEEN THE PRODUCING WELLS GW34 AND GS28 THAT FINDS ANOTHER WELL. THE G26 GULLFAKS WELL.

OBSERVING THE DISTRIBUTION OF POINTS BETWEEN THE PRODUCING WELLS GW34 AND GS33 THAT FINDS TWO WELLS PRODUCING G04 AND G09 IN GROWING SEQUENCE.

DISTANCE IN GROWING SEQUENCE FROM THE WELL GS33 TO THE WELLS G04 AND G09.

USING THE TRANSPORTER OF ANGLES GET THE ANGLES BETWEEN THE DISTANCE GW34 - GS33 AND GS33 - G04 AND GS33 - G09.

OBSERVING THE DISTRIBUTION OF POINTS BETWEEN THE PRODUCING WELLS GA05H AND G11 THAT FINDS TWO WELLS PRODUCING G04 AND G03 IN GROWING SEQUENCE.

DISTANCE IN GROWING SEQUENCE FROM THE WELL G11 TO THE WELLS G04 AND G03.

USING THE TRANSPORTER OF ANGLES, GET THE ANGLES BETWEEN THE DISTANCE GA05H - G11 AND G11 - G04 AND G11 - G03.

FIG. 83

THE ANGLE IS THE INDEPENDENT VARIABLE AND THE DEPENDENT VARIABLE, THE DISTANCES FROM THE ORIGIN WELL TO THE PLACES OF WELLS THAT ARE BETWEEN TWO WELLS. ADJUST ONE LINEAL FUNCTION. THE GAO9H AND GS33 WELLS BELONG TO THE GULLFAKS FIELD, FIG.78

| ANGLE ⊖ | SEQUENCE 1 METERS | ANGLE ⊖ | SEQUENCE 1 METERS | ANGLE ⊖ | SEQUENCE 1 METERS |
|---|---|---|---|---|---|
| 1 | 4573 | 30 | 5771 | 59 | 7283 |
| 2 | 4610 | 31 | 5818 | 60 | 7341 |
| 3 | 4647 | 32 | 5865 | | |
| 4 | 4685 | 33 | 5912 | | |
| 5 | 4723 | 34 | 5959 | | |
| 6 | 4761 | 35 | 6007 | | |
| 7 | 4799 | 36 | 6056 | | |
| 8 | 4838 | 37 | 6105 | | |
| 9 | 4877 | 38 | 6154 | | |
| 10 | 4916 | 39 | 6203 | | |
| 11 | 4955 | 40 | 6253 | | |
| 12 | 4995 | 41 | 6304 | | |
| 13 | 5036 | 42 | 6354 | | |
| 14 | 5076 | 43 | 6406 | | |
| 15 | 5117 | 44 | 6457 | | |
| 16 | 5158 | 45 | 6509 | | |
| 17 | 5200 | 46 | 6562 | | |
| 18 | 5242 | 47 | 6614 | | |
| 19 | 5284 | 48 | 6668 | | |
| 20 | 5326 | 49 | 6721 | | |
| 21 | 5369 | 50 | 6775 | | |
| 22 | 5413 | 51 | 6830 | | |
| 23 | 5456 | 52 | 6885 | | |
| 24 | 5500 | 53 | 6940 | | |
| 25 | 5544 | 54 | 6996 | | |
| 26 | 5589 | 55 | 7053 | | |
| 27 | 5634 | 56 | 7109 | | |
| 28 | 5679 | 57 | 7167 | | |
| 29 | 5725 | 58 | 7224 | | |

THE DISTRIBUTION OF POINTS OF THE FIG. 78
HAS THE ANGLE 1.140025 RADIANS.
THE CORRELATION r = .9999994.

THE DISTRIBUTION OF POINTS OF FIG. 79 HAS
THE ANGLE 1.140034 RADIANS.
THE CORRELATION r = .9999995

FIG. 85

THE ANGLE IS THE INDEPENDENT VARIABLE AND THE DEPENDENT VARIABLE, THE DISTANCES FROM THE ORIGIN WELL TO THE PLACES OF WELLS THAT ARE BETWEEN TWO WELLS. ADJUST ONE LINEAL FUNCTION. THE G03 AND GS33 WELLS BELONG TO THE GULLFAKS FIELD, FIG.79

| ANGLE ⊖ | SEQUENCE 1 METERS | ANGLE ⊖ | SEQUENCE 1 METERS | ANGLE ⊖ | SEQUENCE 1 METERS |
|---|---|---|---|---|---|
| 1 | 6101 | 30 | 7699 | 59 | 9715 |
| 2 | 6150 | 31 | 7761 | 60 | 9793 |
| 3 | 6200 | 32 | 7823 | | |
| 4 | 6250 | 33 | 7886 | | |
| 5 | 6300 | 34 | 7950 | | |
| 6 | 6351 | 35 | 8014 | | |
| 7 | 6402 | 36 | 8078 | | |
| 8 | 6453 | 37 | 8143 | | |
| 9 | 6505 | 38 | 8209 | | |
| 10 | 6558 | 39 | 8275 | | |
| 11 | 6610 | 40 | 8342 | | |
| 12 | 6664 | 41 | 8409 | | |
| 13 | 6717 | 42 | 8476 | | |
| 14 | 6771 | 43 | 8545 | | |
| 15 | 6826 | 44 | 8614 | | |
| 16 | 6881 | 45 | 8683 | | |
| 17 | 6936 | 46 | 8753 | | |
| 18 | 6992 | 47 | 8823 | | |
| 19 | 7049 | 48 | 8894 | | |
| 20 | 7105 | 49 | 8966 | | |
| 21 | 7162 | 50 | 9038 | | |
| 22 | 7220 | 51 | 9111 | | |
| 23 | 7278 | 52 | 9184 | | |
| 24 | 7337 | 53 | 9258 | | |
| 25 | 7396 | 54 | 9333 | | |
| 26 | 7456 | 55 | 9408 | | |
| 27 | 7516 | 56 | 9484 | | |
| 28 | 7576 | 57 | 9560 | | |
| 29 | 7637 | 58 | 9637 | | |

FIG. 87

THE ANGLE IS THE INDEPENDENT VARIABLE AND THE DEPENDENT VARIABLE, THE DISTANCES FROM THE ORIGIN WELL TO THE PLACES OF WELLS THAT ARE BETWEEN TWO WELLS. ADJUST ONE LINEAL FUNCTION. THE GW34 AND GS28 WELLS BELONG TO THE GULLFAKS FIELD, FIG.80

| ANGLE ⊖ | SEQUENCE 1 METERS | ANGLE ⊖ | SEQUENCE 1 METERS | ANGLE ⊖ | SEQUENCE 1 METERS |
|---|---|---|---|---|---|
| 1 | 8594 | 30 | 10845 | 59 | 13685 |
| 2 | 8664 | 31 | 10932 | 60 | 13795 |
| 3 | 8733 | 32 | 11020 | | |
| 4 | 8804 | 33 | 11109 | | |
| 5 | 8875 | 34 | 11199 | | |
| 6 | 8946 | 35 | 11289 | | |
| 7 | 9018 | 36 | 11380 | | |
| 8 | 9091 | 37 | 11471 | | |
| 9 | 9164 | 38 | 11564 | | |
| 10 | 9238 | 39 | 11657 | | |
| 11 | 9312 | 40 | 11751 | | |
| 12 | 9387 | 41 | 11845 | | |
| 13 | 9463 | 42 | 11941 | | |
| 14 | 9539 | 43 | 12037 | | |
| 15 | 9616 | 44 | 12134 | | |
| 16 | 9693 | 45 | 12231 | | |
| 17 | 9771 | 46 | 12330 | | |
| 18 | 9850 | 47 | 12429 | | |
| 19 | 9929 | 48 | 12529 | | |
| 20 | 10009 | 49 | 12630 | | |
| 21 | 10090 | 50 | 12732 | | |
| 22 | 10171 | 51 | 12834 | | |
| 23 | 10253 | 52 | 12938 | | |
| 24 | 10335 | 53 | 13042 | | |
| 25 | 10419 | 54 | 13147 | | |
| 26 | 10503 | 55 | 13253 | | |
| 27 | 10587 | 56 | 13360 | | |
| 28 | 10672 | 57 | 13467 | | |
| 29 | 10758 | 58 | 13576 | | |

THE DISTRIBUTION OF POINTS OF THE FIG. 80
HAS THE ANGLE 1.140039 RADIANS.
THE CORRELATION r = 1.000014

THE DISTRIBUTION OF POINTS OF FIG. 81
HAS THE ANGLE 1.14002 RADIANS.
THE CORRELATION r = 1.000005

FIG. 89

THE ANGLE IS THE INDEPENDENT VARIABLE AND THE DEPENDENT VARIABLE, THE DISTANCES FROM THE ORIGIN WELL TO THE PLACES OF WELLS THAT ARE BETWEEN TWO WELLS. ADJUST ONE LINEAL FUNCTION. THE GW34 AND GS33 WELLS BELONG TO THE GULLFAKS FIELD, FIG.81

| ANGLE ⊖ | SEQUENCE 1 METERS | ANGLE ⊖ | SEQUENCE 1 METERS | ANGLE ⊖ | SEQUENCE 1 METERS |
|---|---|---|---|---|---|
| 1 | 6915 | 30 | 8726 | 59 | 11011 |
| 2 | 6971 | 31 | 8797 | 60 | 11100 |
| 3 | 7027 | 32 | 8867 | | |
| 4 | 7084 | 33 | 8939 | | |
| 5 | 7141 | 34 | 9011 | | |
| 6 | 7198 | 35 | 9083 | | |
| 7 | 7256 | 36 | 9157 | | |
| 8 | 7315 | 37 | 9230 | | |
| 9 | 7374 | 38 | 9305 | | |
| 10 | 7433 | 39 | 9380 | | |
| 11 | 7493 | 40 | 9455 | | |
| 12 | 7553 | 41 | 9531 | | |
| 13 | 7614 | 42 | 9608 | | |
| 14 | 7675 | 43 | 9685 | | |
| 15 | 7737 | 44 | 9763 | | |
| 16 | 7799 | 45 | 9842 | | |
| 17 | 7862 | 46 | 9921 | | |
| 18 | 7926 | 47 | 10001 | | |
| 19 | 7989 | 48 | 10082 | | |
| 20 | 8054 | 49 | 10163 | | |
| 21 | 8119 | 50 | 10245 | | |
| 22 | 8184 | 51 | 10327 | | |
| 23 | 8250 | 52 | 10410 | | |
| 24 | 8316 | 53 | 10494 | | |
| 25 | 8383 | 54 | 10579 | | |
| 26 | 8451 | 55 | 10664 | | |
| 27 | 8519 | 56 | 10750 | | |
| 28 | 8587 | 57 | 10836 | | |
| 29 | 8657 | 58 | 10924 | | |

FIG. 91

THE ANGLE IS THE INDEPENDENT VARIABLE AND THE DEPENDENT VARIABLE, THE DISTANCES FROM THE ORIGIN WELL TO THE PLACES OF WELLS THAT ARE BETWEEN TWO WELLS. ADJUST ONE LINEAL FUNCTION. THE GAO5H AND G11 WELLS BELONG TO THE GULLFAKS FIELD, FIG.82

| ANGLE ⊖ | SEQUENCE 1 METERS | ANGLE ⊖ | SEQUENCE 1 METERS | ANGLE ⊖ | SEQUENCE 1 METERS |
|---|---|---|---|---|---|
| 1 | 3763 | 30 | 4748 | 59 | 5992 |
| 2 | 3793 | 31 | 4787 | 60 | 6040 |
| 3 | 3824 | 32 | 4825 | | |
| 4 | 3855 | 33 | 4864 | | |
| 5 | 3886 | 34 | 4903 | | |
| 6 | 3917 | 35 | 4943 | | |
| 7 | 3949 | 36 | 4983 | | |
| 8 | 3980 | 37 | 5023 | | |
| 9 | 4012 | 38 | 5063 | | |
| 10 | 4045 | 39 | 5104 | | |
| 11 | 4077 | 40 | 5145 | | |
| 12 | 4110 | 41 | 5186 | | |
| 13 | 4143 | 42 | 5228 | | |
| 14 | 4177 | 43 | 5270 | | |
| 15 | 4210 | 44 | 5313 | | |
| 16 | 4244 | 45 | 5356 | | |
| 17 | 4278 | 46 | 5399 | | |
| 18 | 4313 | 47 | 5442 | | |
| 19 | 4347 | 48 | 5486 | | |
| 20 | 4382 | 49 | 5530 | | |
| 21 | 4418 | 50 | 5575 | | |
| 22 | 4453 | 51 | 5620 | | |
| 23 | 4489 | 52 | 5665 | | |
| 24 | 4525 | 53 | 5710 | | |
| 25 | 4562 | 54 | 5756 | | |
| 26 | 4599 | 55 | 5803 | | |
| 27 | 4636 | 56 | 5850 | | |
| 28 | 4673 | 57 | 5897 | | |
| 29 | 4711 | 58 | 5944 | | |

THE DISTRIBUTION OF POINTS OF THE FIG. 82
HAS THE ANGLE 1.140016 RADIANS.
THE CORRELATION r = 1.000003

METHOD FOR LOCATING OIL WELLS

RELATED APPLICATION DATA

This is a continuation-in-part of application Ser. No. 09/487,280, filed Jan. 19, 2000, now U.S. Pat. No. 6,206,099, entitled "System for Relating Multiple Oil or Gas Wells to Each Other" the contents of which are incorporated herein by reference.

BACKGROUND OF THE INVENTION

1. Field of the Invention

The present invention is generally related to a method of finding the location of fossil fuel producing oil wells. More particularly, the present invention relates to system and method of mathematically generating a distribution of points from two know well locations. The distribution is then employed in locating additional producing fossil fuel wells.

2. Description of the Related Art

Presently, there are many oil or natural gas producing fields located around the world. Each of these fields includes a number of producing wells that generate a fossil fuel such as oil or natural gas. The wells are distributed over the area of a given field in what appears to be a haphazard manner.

Each well position is originally located and selected for drilling by searching for oil and natural gas utilizing a number of different methods. One method is to simply look for ground seepage wherein oil or natural gas escapes from the earth through the ground into the atmosphere. Oil seepage can be located by visual inspection. Gas seepage can be traced by sensitive equipment that measures the presence or absence of natural gas in the atmosphere. These methods are known as surface methods. Another method is known as either gravity or magnetic survey wherein small changes in the electromagnetic field or gravitational force of the earth at a given area are measured relative to the surrounding areas. These small changes indicate underground formations that may be conducive to oil or natural gas reservoirs. A third method is commonly known as seismographic exploration that can be utilized to detect smaller and less obvious rock formations and underground traps that can include reservoirs of oil or natural gas that are otherwise not discoverable by the previous less sophisticated methods. Seismic surveying utilizes sound transmitted through the ground to indicate less obvious underground formations that can be conducive to oil or natural gas reservoirs. This procedure is repeated over wide areas to determine the possible locations of pockets or reservoirs of oil and/or natural gas.

Heretofore, there has been no method known to somehow relate the positions of known oil wells to the positions of unknown oil wells. There is further no presently known method of relating existing oil well positions within a given field for determining prime locations to drill additional oil wells in the field without resorting to the sophisticated, costly and time consuming methods of locating new well sites.

SUMMARY OF THE INVENTION

The present invention relates to a method of finding the geographic location of one or more producing wells on the basis of the location of two other known producing wells. In the first step of the method, first and second producing wells and designated, with the location of such wells being defined an x–y coordinate system.

Next, the distance X between the two wells is computed in accordance with the following equation:

$$X=\sqrt{(x_1-x_0)^2+(y_1-y_0)^2}$$

Thereafter, a smaller distance Y is computed in accordance with the following equation:

$$Y^2+XY-X^2=0$$

Designating the distance Y from the first, or origin well, as segment A, a growing sequence of segments $A_n$ can be computed in accordance with the equation:

$$A_n=Ae^{\theta \cot \alpha}$$

(wherein θ is incrementally varied by a number of degrees in radians and wherein cot α is a fixed value).

In the next step of the method, a sequence $B_n$ of segments is computed which corresponds to the sequence $A_n$ in accordance with the equation $$A_n^2+A_nB_n-B_n^2=0$$

Finally, the intersection between the sequence of segments $A_n$ and $B_n$ are located. The points that define these intersections define a trap slice upon which producing wells can be located.

These and other objects, features and advantages of the present invention will become apparent upon a review of the written description and accompanying drawings.

BRIEF DESCRIPTION OF THE DRAWINGS

The following drawing figures illustrates aspects of the present invention wherein:

FIG. 9 illustrates a data table indicating each pairing of distances between producing wells that yields the mathematical constant and wherein each of the producing wells is included;

FIG. 11 illustrates a chart comparing the actual distances between producing wells of the table of FIG. 9 to the average of all the data of the table;

FIG. 15 illustrates a table including data for each well pairing that yields a constant mathematical relationship and wherein each well of the entire field is utilized;

FIG. 17 illustrates a table comparing the actual distances of wells from the table of FIG. 15 and the average of all data in the table of FIG. 15;

FIG. 20 illustrates a table showing the pairs of distances for the field illustrated in FIG. 18 that yield a constant mathematical relationship and that utilizes all of the producing wells of the field;

FIG. 22 illustrates a table providing the data comparing the actual measured distance relationships and the average relationships utilizing all the data of the table of FIG. 20; and FIG. 23 illustrates a table showing the results of analyzing ten different oil fields.

FIGS. 24–43 illustrate how the present invention is carried out relative to the Captain Oil Field in the United Kingdom.

FIGS. 44–50 illustrate how the present invention is carried out relative to the Albacora Field in Brazil.

FIGS. 51–58 illustrates how the present invention is carried out relative to the Mecoacan Oil Field in the Comalcalco Basin in Mexico.

FIGS. 59–66 illustrate how the present invention is carried out relative to the Izozog Field in Argentia.

FIGS. 67–68 are summary tables for the data illustrated in FIGS. 24–66.

FIGS. 69–92 illustrate how the present invention is carried out relative to the Gullfaks Oil Field in Norway.

DETAILED DESCRIPTION OF THE PREFERRED EMBODIMENTS

The First Method of the Present Invention

Figure 1:
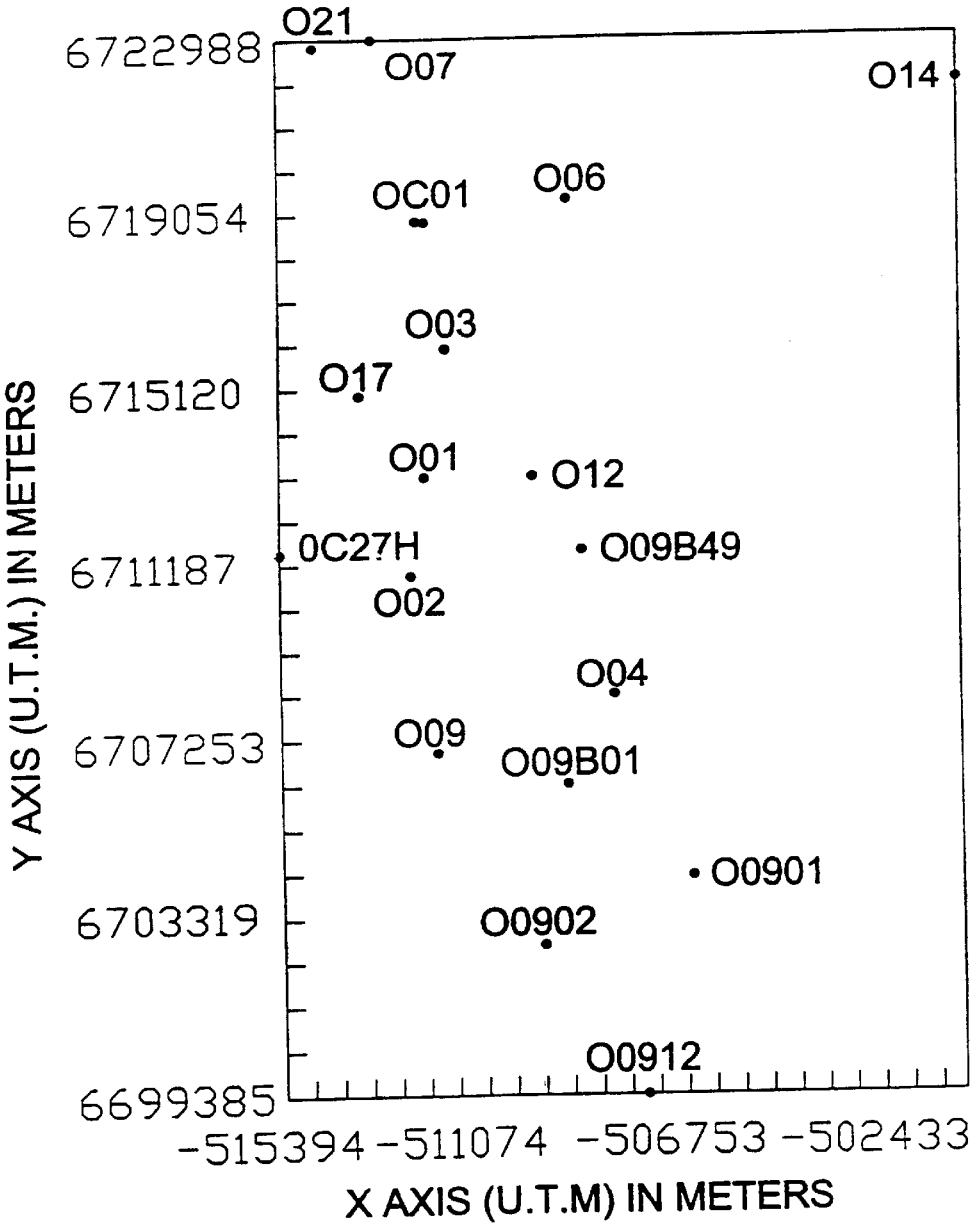
FIG. 1 illustrates a schematic drawing of an oil producing field located in Norway and including nineteen producing wells.

Referring now to the drawings, FIG. 1 illustrates a schematic chart showing the geographic location of each producing well in a productive oil field known as the Oseberg field in Norway. The units of the x-axis and the y-axis of the chart are each in metric meters. The intersection of the x-axis and y-axis for the chart is not zero but instead is the southernmost and westernmost location of producing wells in the entire field. The chart represents a coordinate system known as the Universal Transverse Mercator (UTM) geographical coordinate system and is based on data of 1927. In this system, there is one horizontal and vertical 0 coordinate and then every geographic location is taken from the 0 coordinate and measured in meters both horizontally and vertically relative to the origin. Therefore, the horizontal or x-axis of the chart represents the distance in meters along a horizontal axis from the 0 coordinate of the UTM coordinate system. Similarly, the vertical or y-axis represents the distance in meters relative to the 0 coordinate along a vertical axis of the UTM coordinate system.

Figure 2:
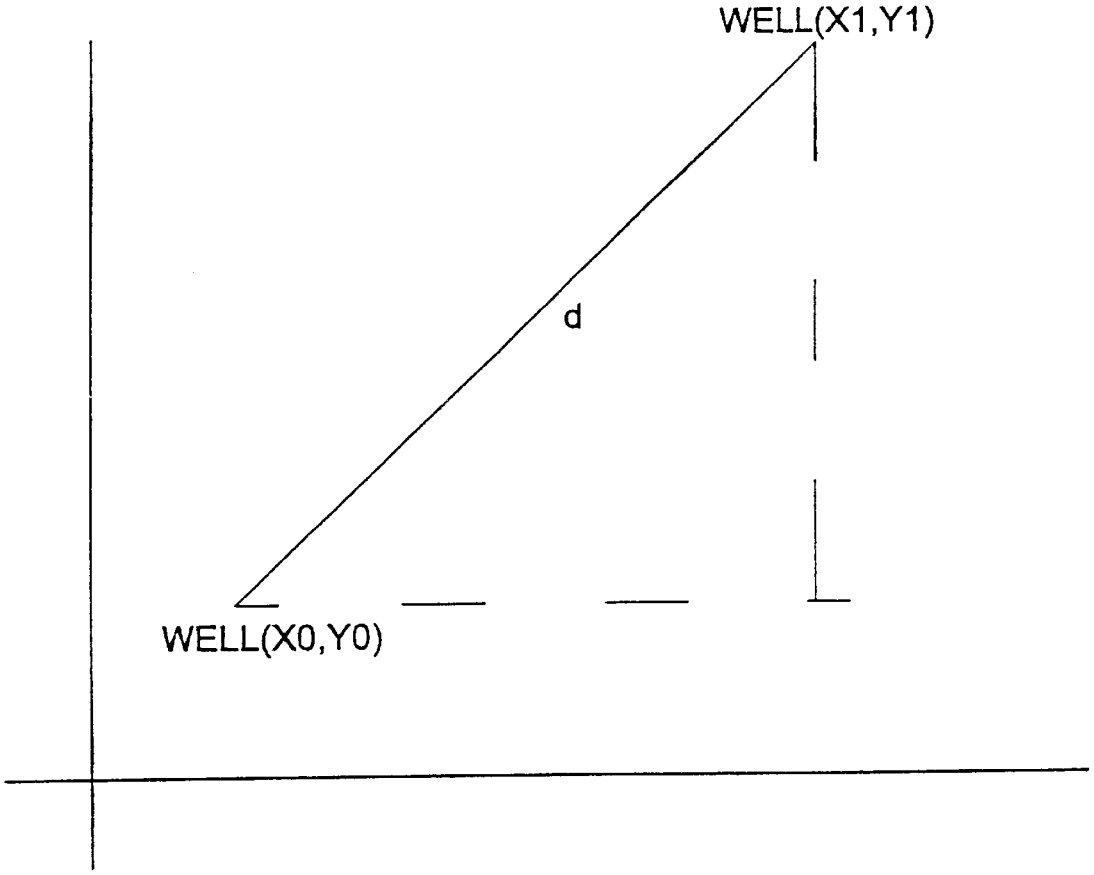
FIG. 2 illustrates a graph illustrating x-axis and y-axis distance coordinates between two producing wells of the field.

FIG. 2 illustrates a simple schematic showing how, utilizing the UTM coordinate system, an actual distance in meters between two producing wells is calculated for the purposes of this invention. The lower left well identified by the coordinates (X0, Y0) is located spaced from a second well identified having the coordinates (X1, Y1). Utilizing-the commonly known equation $$d=\sqrt{(X_1-X_0)^2+(Y_1-Y_0)^2} \quad \text{(EQ. 1)}$$

This equation calculates the hyphothonus of a right triangle indicated by the dotted lines in FIG. 2. The horizontal dotted line represents the distance along the x-axis between the two wells and the vertical dotted line represents the distance along the y-axis between the wells. Utilizing the equation, the distance d between the two wells can be calculated as long as the coordinates in the UTM coordinate system are known for each producing well.

The present invention provides a method for relating all of the producing wells in any given oil field wherein a mathematical relationship can be utilized for a number of different purposes. The relationship between each of the producing wells in a particular oil field is dependent upon the distances between all of the wells. By analyzing each of the distances between given pairs of producing wells in a number of different manners, a reoccurring relationship is discovered that relates all oil producing wells in a given field. An example is presented thoroughly explaining the inventive method and then the mathematical relationship that is realized is discussed. Two more examples are also presented and discussed in less detail herein.

Figure 3:
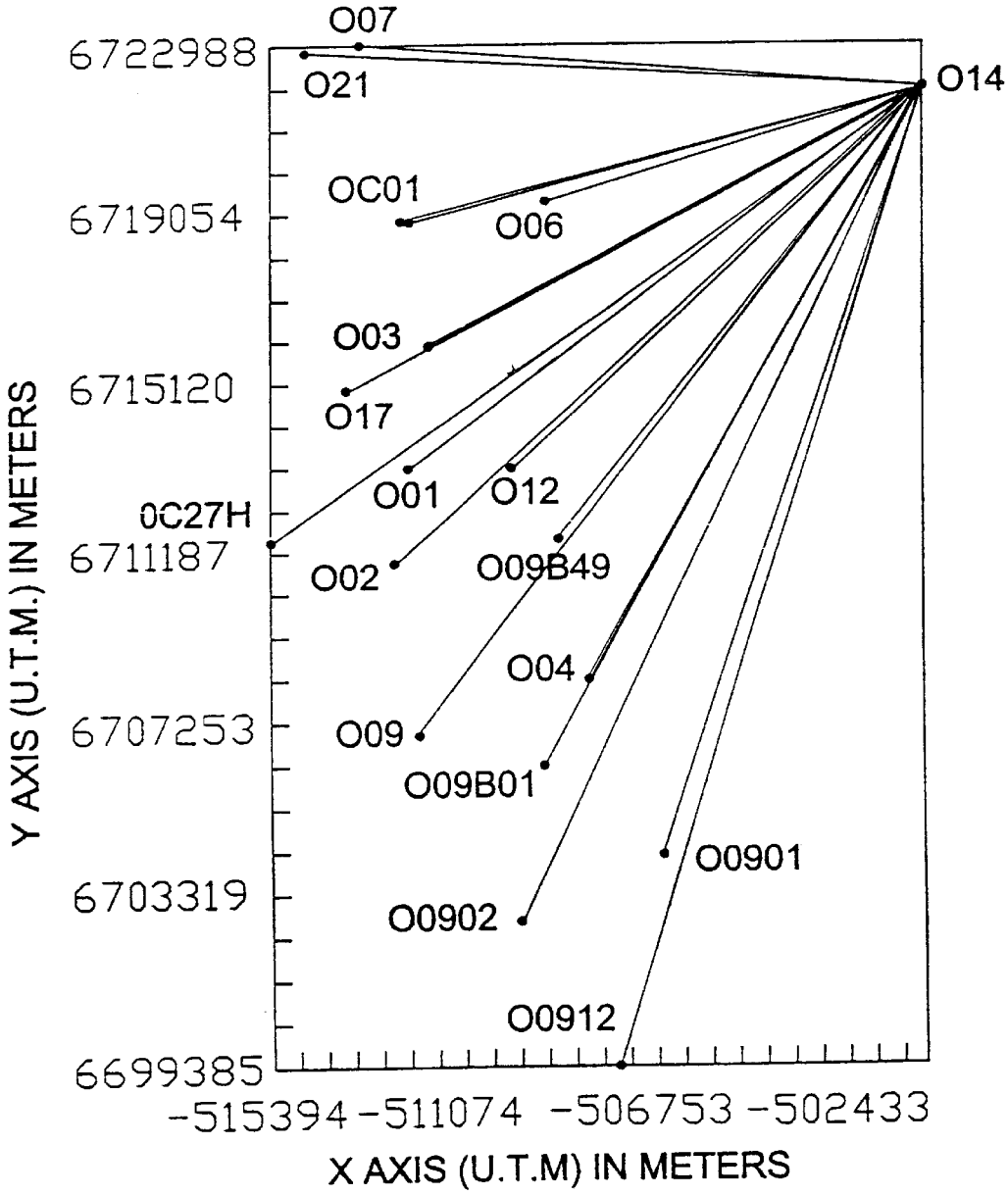
FIG. 3 illustrates the chart of FIG. 1 with lines drawn from one origin well to each of the remaining wells of the field.
Figure 4:
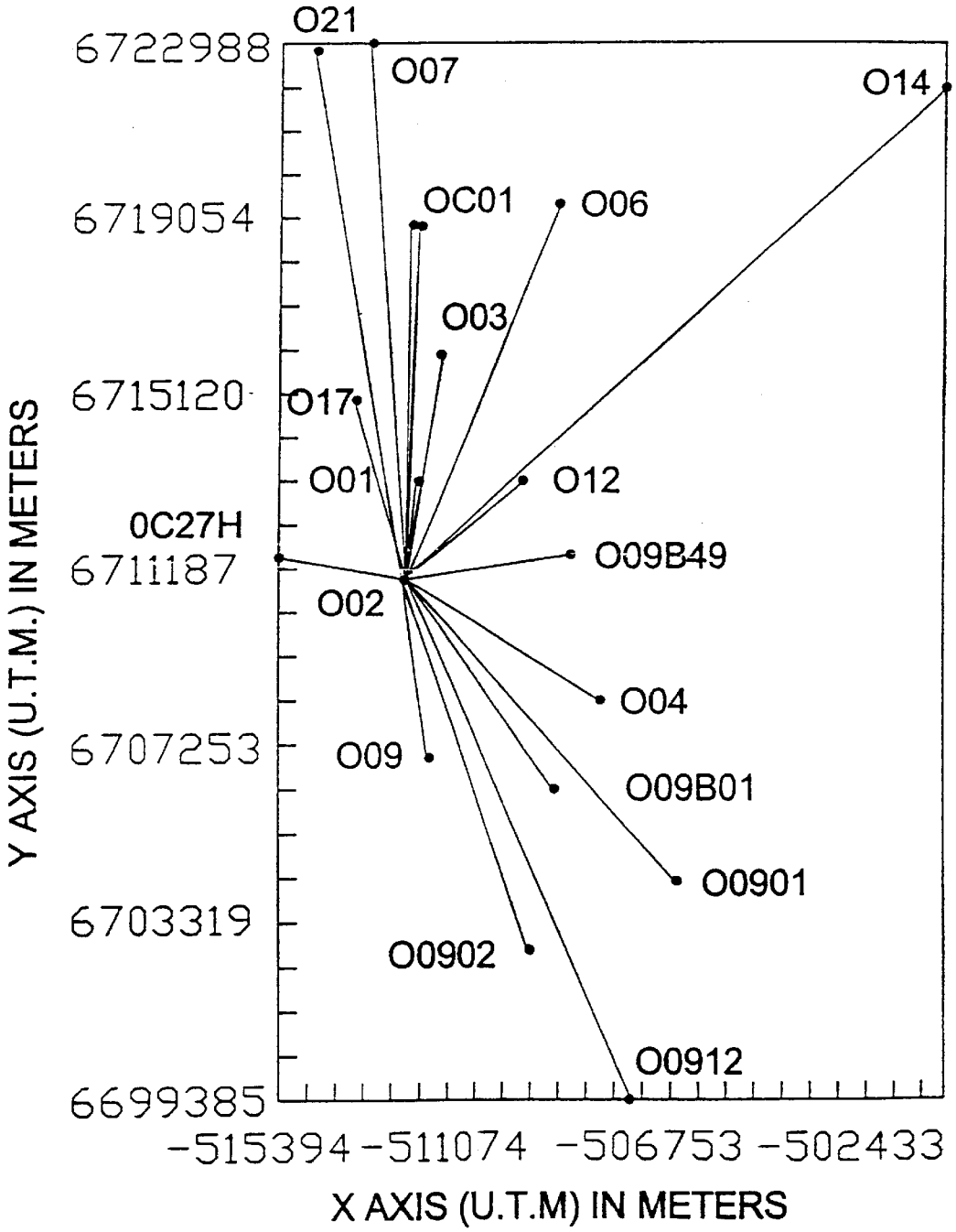
FIG. 4 illustrates a chart showing a different well selected as the origin well and lines drawn from this origin well to each remaining well of the field.

A first statistical analysis was conducted. Referring to FIG. 3, a chart representing each of the producing wells in the Oseberg field is illustrated wherein one of the wells identified as well O14 is selected as the origin well and a distance from the origin well to each other producing well of the field is calculated utilizing the equation 1 noted above. FIG. 4 illustrates the chart showing each of the wells of the Oseberg field except wherein the well O02 is selected as the origin well. The distance from the origin well to each of the remaining producing wells of the field is then calculated and also includes the distance from the origin well O02 to the previously selected origin well O14. This was done for each well selected as the origin well.

Figure 5:
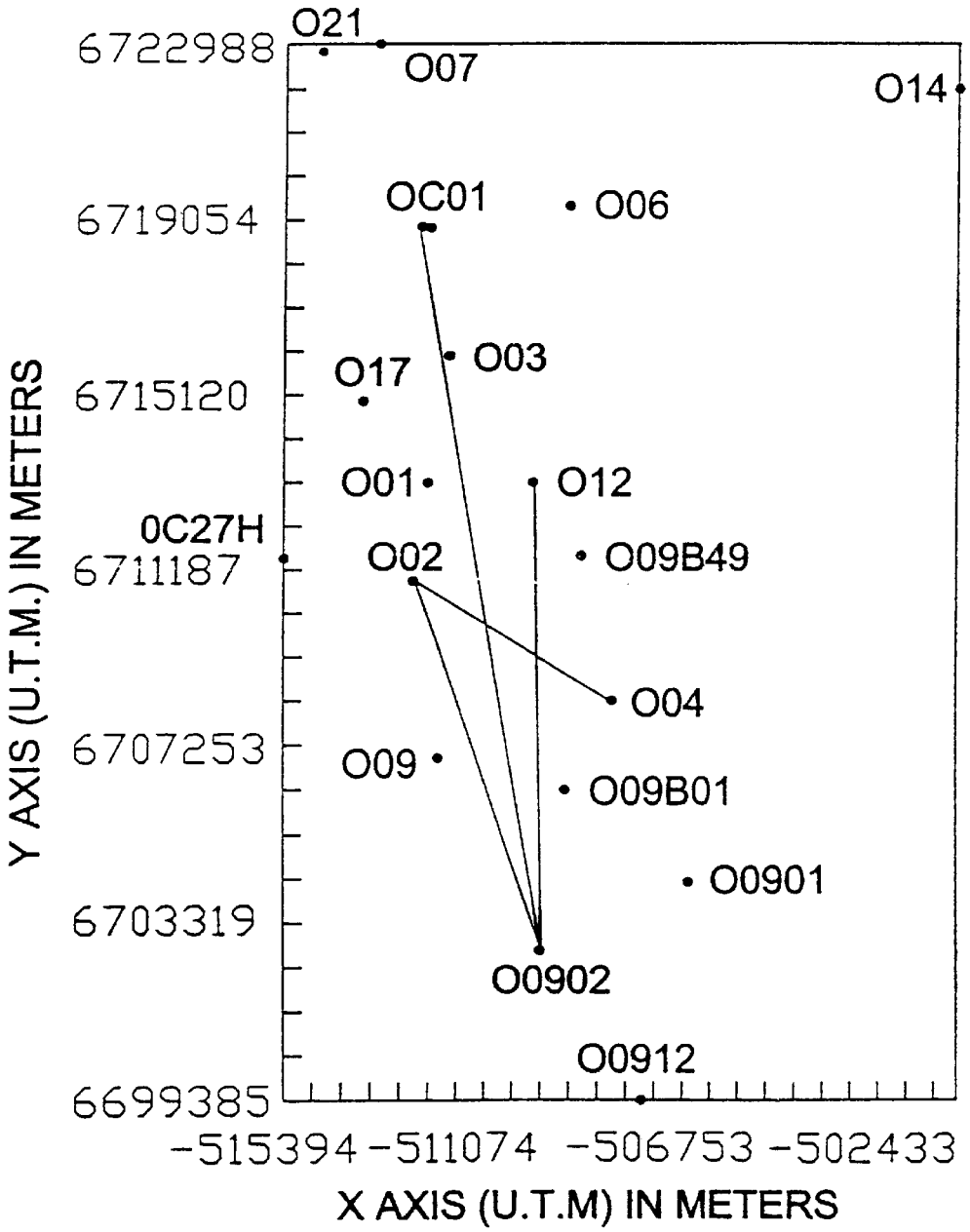
FIG. 5 illustrates a chart showing the distance between one selected pair of wells, one being an origin well, in comparison to the distance between a third selected producing well from the origin well, and showing another distance between two producing wells, one being another origin well, compared to the distance between another third selected producing well and its origin well.

Couples or pairs of distances having a common origin well were then compared for each producing well selected as the origin well. For example, as illustrated in FIG. 5, an origin well is O02 and one couple or pair of distances is illustrated including the distance from O02 to the well O04 and the distance from O02 to the well O0902. FIG. 5 also illustrates the producing well O0902 selected as the origin well and illustrates one couple or pair of distances. One distance is from O0902 to the well 012 and another distance is from O0902 to the well OC01. Therefore, for each well selected as the origin well in the Oseberg field, which includes nineteen total producing wells, there are eighteen distances between each origin well and the remaining producing wells in the field. Though these distances are repeated a number of times, there are a total of 19×18=342 total distances possible for all wells selected as the origin well. For each well selected as the origin well, there are seventeen possible couples or pairs of distances from the origin well to two selected of the remaining producing wells. Therefore, there are 19×17=323 total possible couples or pairs of distances without repeating any pairs or couples of distances and without repeating the origin well. The ratio of the smaller distance over the larger distance for every possible pair or couple of distances in the entire oil field of Oseberg was then analyzed and compared.

Figure 6:
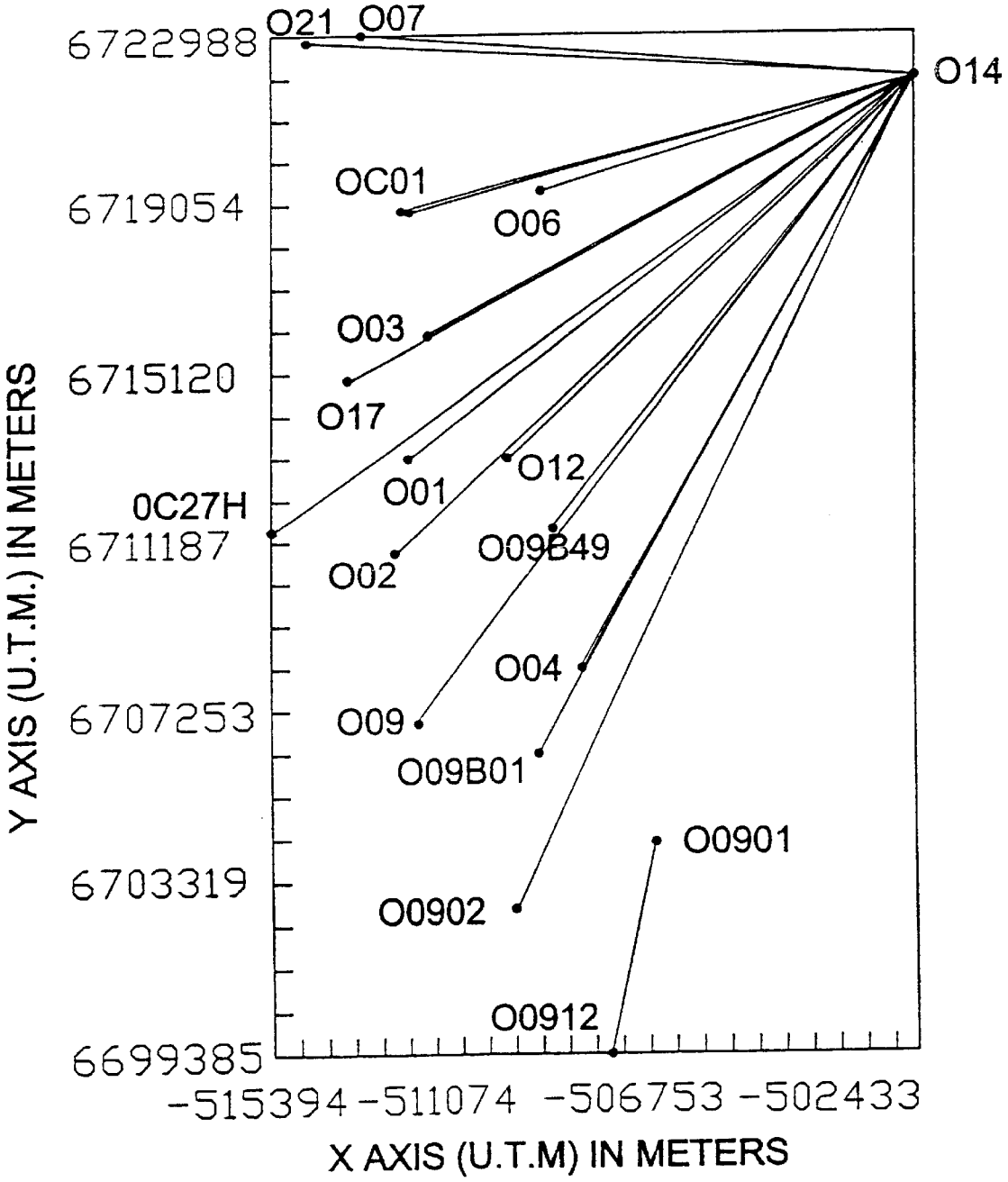
FIG. 6 illustrates a chart showing the distance between a pair of selected producing wells and the distance between a third selected producing well and each remaining producing well.

A second statistical analysis was also conducted on the distance data for the producing wells of the Oseberg field. In the first statistical analysis noted above in FIG. 5, for comparing couples of distances having a common origin well, three producing wells were required. Referring to FIG. 6, the second statistical analysis was conducted selecting four producing wells at any one time. One distance is first selected as the origin distance. For example, the distance between the producing well O0912 and O0901, was selected as the origin distance and is shown in FIG. 6. A third well such as the well O14 is next selected. The distance between the third well and each remaining unselected well is then calculated as is also illustrated in FIG. 6. Each of these distances is then separately compared to the origin distance to form separate pairs or couples of distances utilizing four producing wells. In this manner, each distance is separately selected as the origin distance between two given producing wells and compared to each other distance between any two of the remaining producing wells. An exhaustive analysis of each possible distance coupling or pairing utilizing four wells at a time was then studied without repeating distance pairings or couplings.

Figure 7:
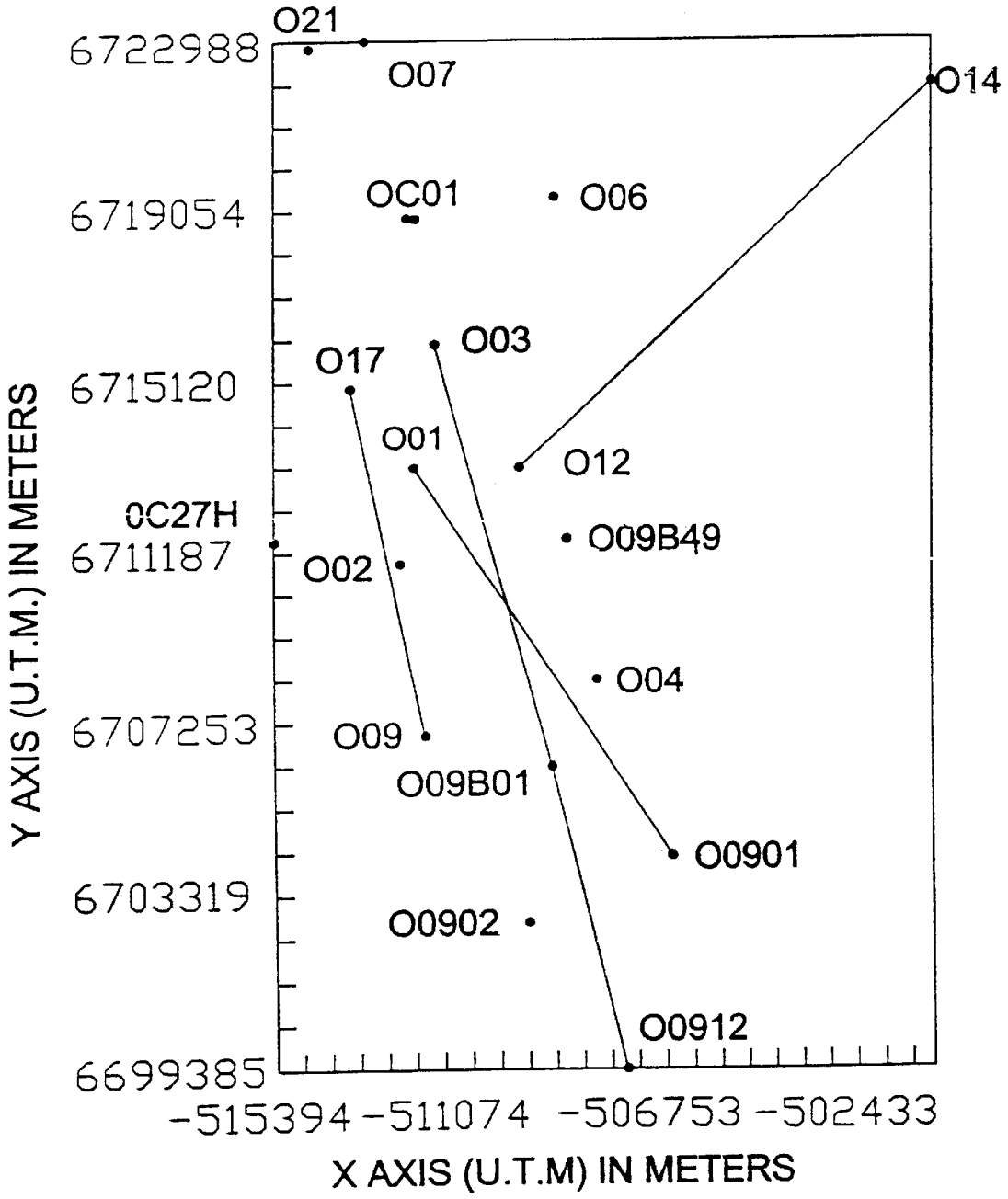
FIG. 7 illustrates a chart showing the distances between four selected pairs of producing wells.

As illustrated in FIG. 7, two examples of distance pairings or couplings are illustrated utilizing four separate wells for each pairing or coupling. For example, one origin distance is selected as the distance between the producing well O14 and the producing well O12. The coupled or paired distance was the distance between the producing well O17 and the producing well O09. A second exemplary pairing or coupling is the origin distance between the well O13 and the well O0912 and the coupled distance between the well O01 and well O0901. The ratio of each possible distance pairing or coupling utilizing four wells was then determined whereby the smaller distance of each pairing is divided by the larger distance.

Figure 8:
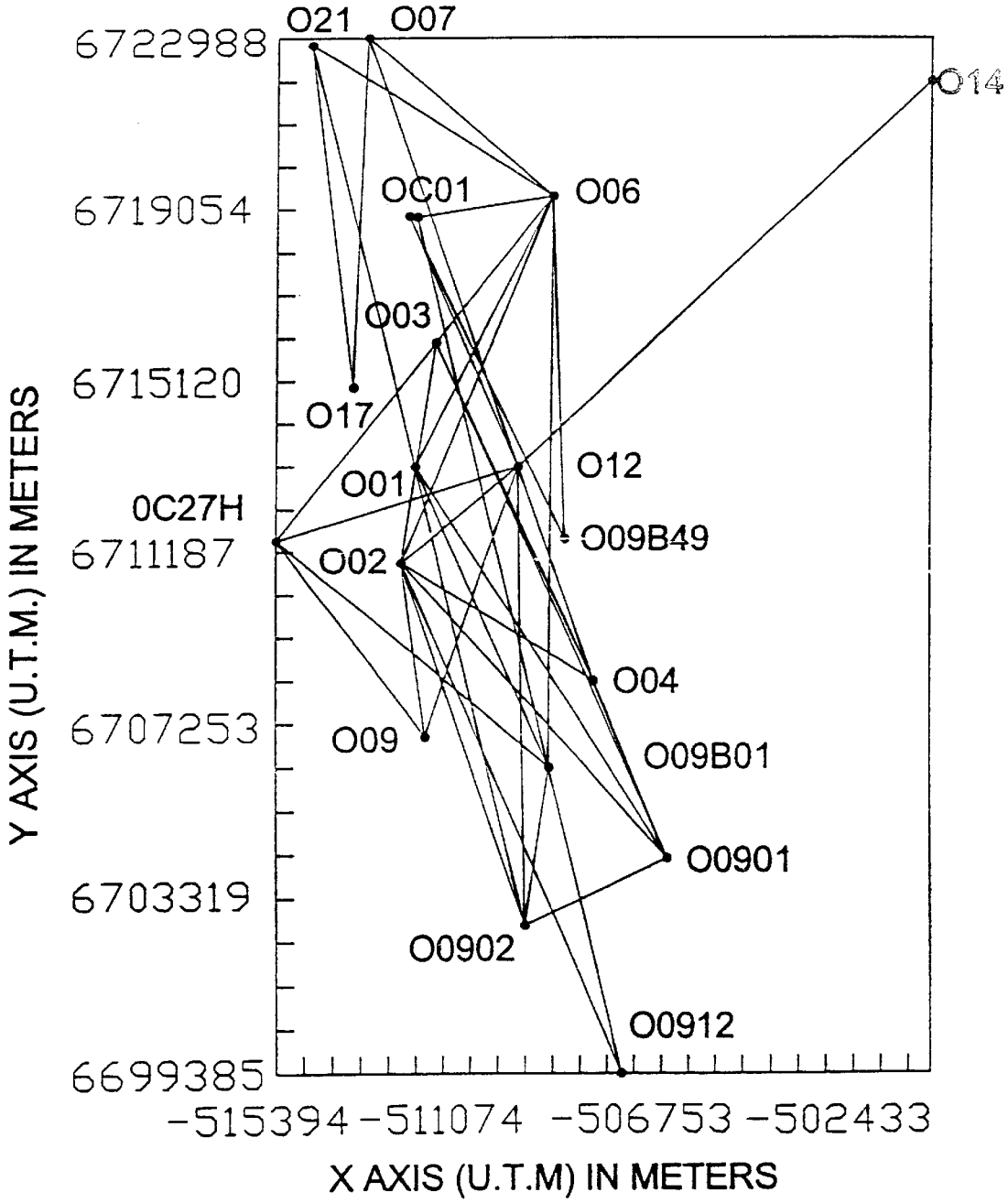
FIG. 8 illustrates a chart showing all the possible three producing well combinations of the field wherein one producing well is the origin well and the compared distance from the origin well to two different wells yields a constant mathematical relationship, and showing all the possible four producing well combinations of the field where the compared distance between one pair of wells to another pair of wells also yields a constant mathematical relationship.

Upon reviewing the ratio data for each distance coupling or pairing for both statistical studies, one utilizing three wells having a common origin well and one utilizing four separate producing wells, reveal that a relatively large number of pairings or couplings produce the same constant ratio. Upon further analysis, each of the producing wells of the field at Oseberg was utilized at least once in the data producing the constant ratio. Every single well of the Oseberg field produced the same constant mathematical relationship at least once when compared to two or three other producing wells of the field. FIG. 8 illustrates each of the twenty-nine couples of distances or distance pairings of the Oseberg field that produced a constant distance ratio of 0.6178 (plus or minus a small statistical variation).

FIG. 9 illustrates a data table including twenty-nine (29) pairs of distances which yield essentially the same constant ratio between the smaller distance Y over the larger distance X of each coupling or pairing. As can be seen in this data table, the couplings 4, 10 and 20 represent the first statistical study and utilize only three producing wells and have a common origin well. The remaining couplings or pairings represent the second statistical study and utilize four separate producing wells in comparing distances for each of the remaining couplings.

Figure 10:
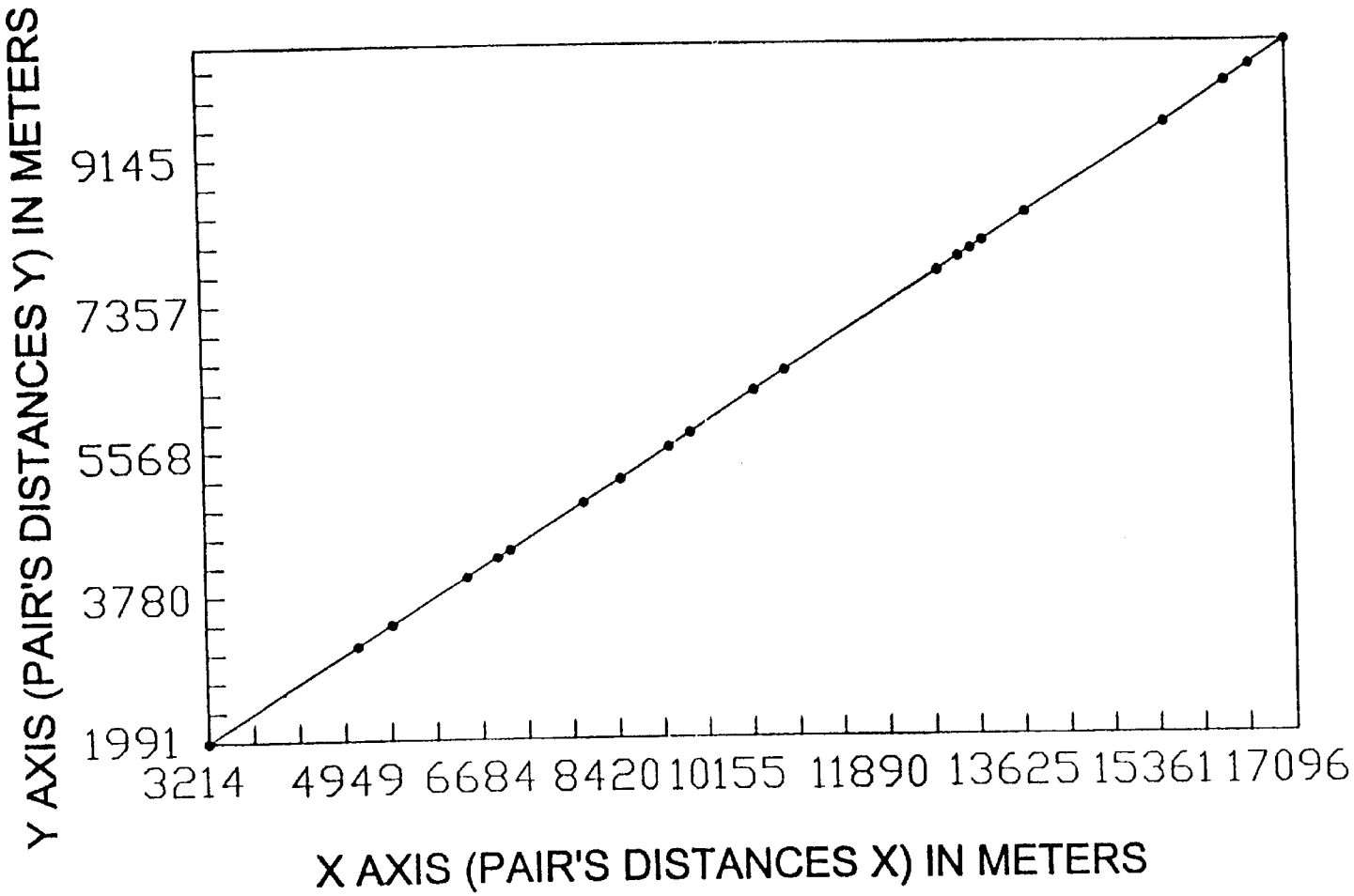
FIG. 10 illustrates a chart representing the mathematical constant produced by the well distance pairings of the data table in FIG. 9.

FIG. 10 illustrates a chart plotting the ratio of the distance couplings for each coupling or pairing 1 through 29 shown in the data table in FIG. 9. The slope of the curve is linear and was calculated as B=0.6178017. The chart of FIG. 10 plots the larger distance X for each distance coupling along the horizontal axis and the smaller distance Y for each particular coupling along the vertical axis of the chart. This chart does not plot coordinates of the UTM system, but instead plots the distance in meters between producing wells for each pair or coupling indicated in the data table of FIG. 9.

The data table of FIG. 11 illustrates comparative data wherein the independent variable X represent the larger distance between producing wells of each coupling or pairing of distances. The second column of the table indicates the actual smaller distance Y for each pairing. Column 3 of the chart indicates a calculated variable Y' utilizing the average mathematical constant of the data of FIG. 8. The fourth column of the table of FIG. 11 denotes the difference in meters between the actual and the calculated dependent variable Y and Y, respectively, for determining a statistical deviation between the actual and calculated variables.

Figure 12:
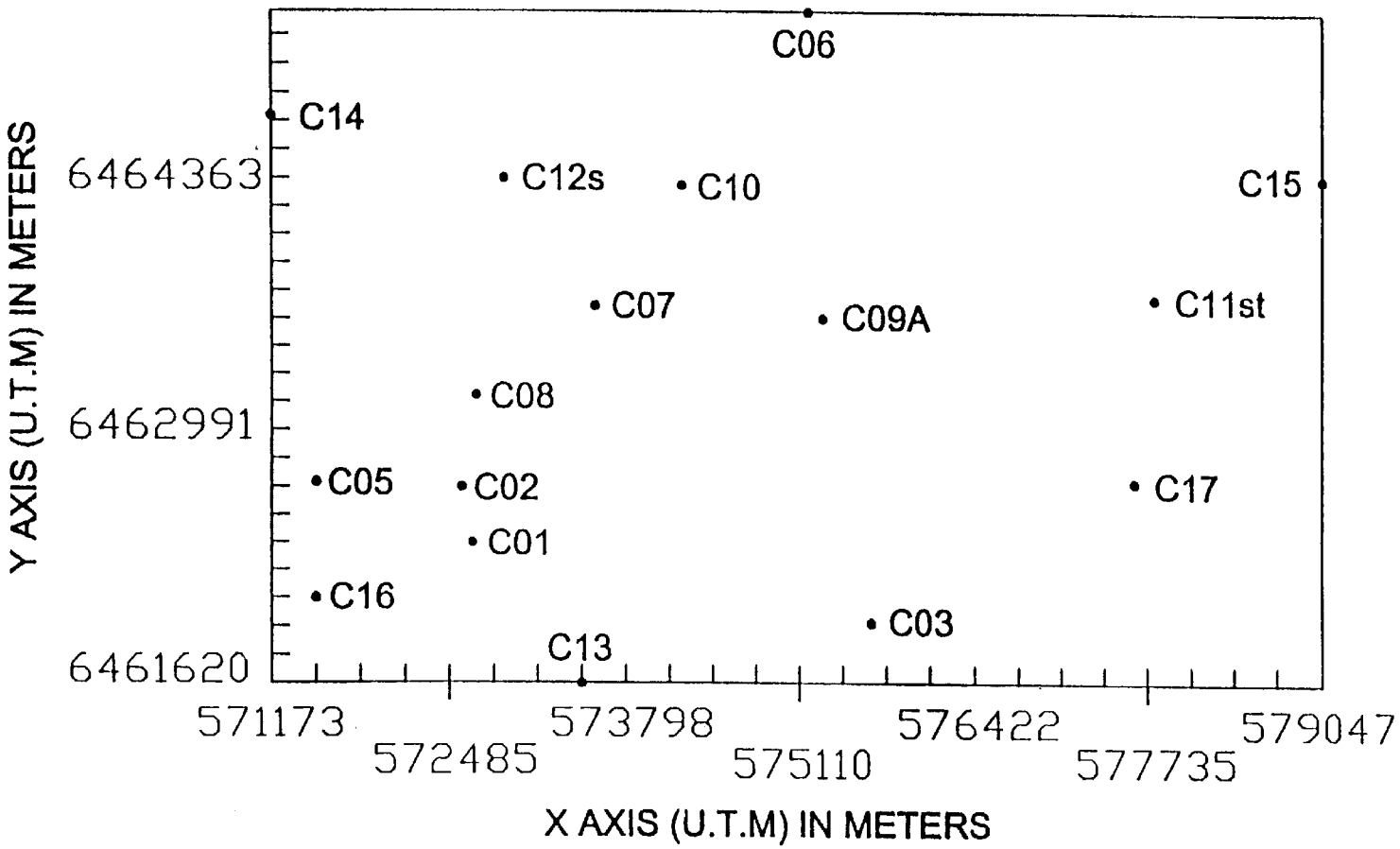
FIG. 12 illustrates a schematic chart representing the producing wells of another oil field located in the United Kingdom.

FIG. 12 illustrates another schematic chart of each of sixteen producing wells in a oil field known as Captain field in the United Kingdom. Again, the geographical coordinates of each producing well are shown in the chart in meters and according to the UTM coordinate system.

Figure 13:
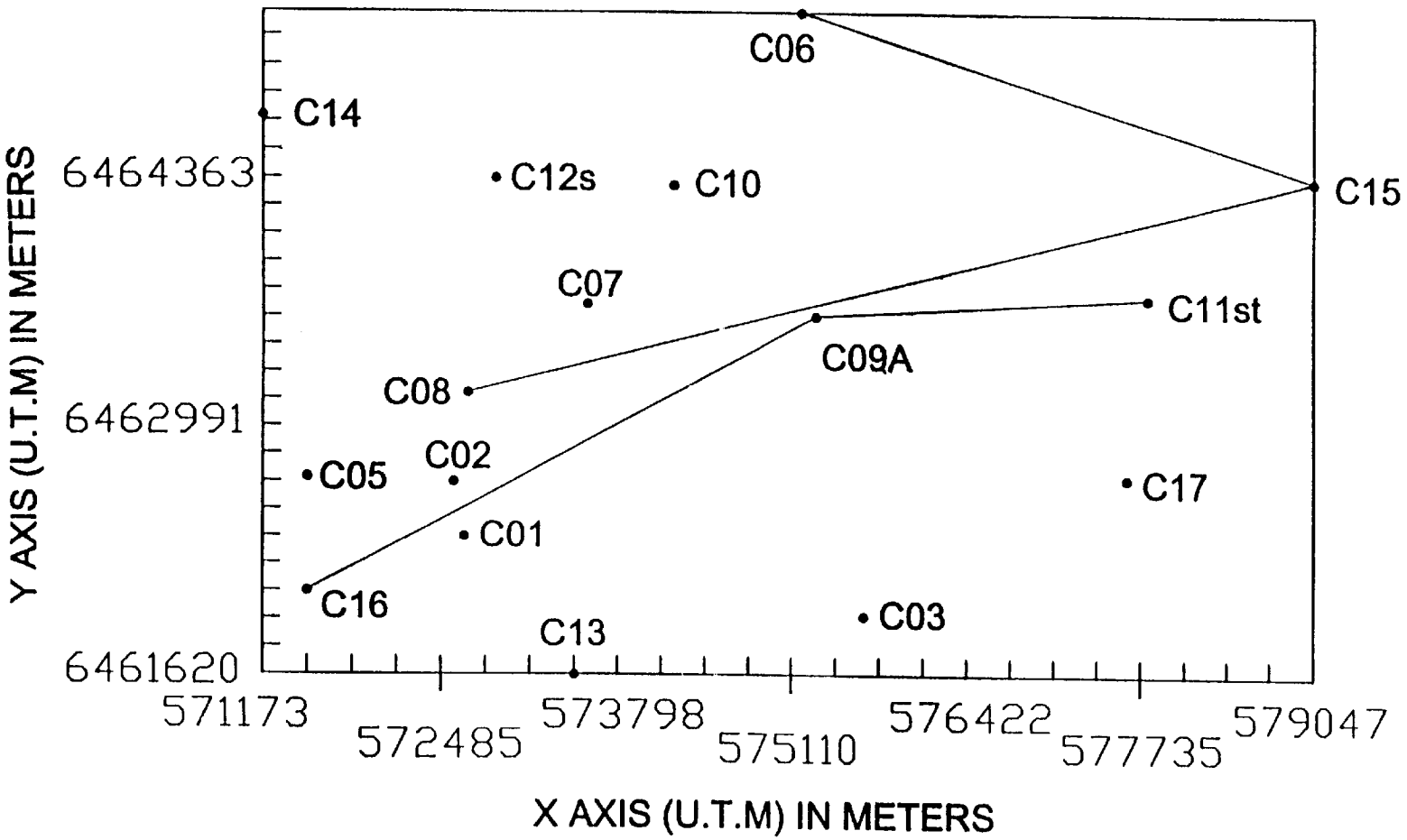
FIG. 13 illustrates the chart of FIG. 12 wherein examples of wells selected as an origin well and the distances from each origin well to two other producing wells are shown.

Similar to that of the Oseberg field discussed above, each possible pair or coupling of distances of producing wells in the Captain field was calculated both utilizing the three well statistically study and utilizing the four well statistical study. FIG. 13 illustrates an example of two different distance pairs or couplings wherein each pair or coupling has a common origin well. For example, the origin well C15 is selected and the distance from C15 to the producing well C06 and the distance from C15 to the producing well C08 makeup the two distances of the pair. As another example, the origin well C09A is selected and the distance between C09A and the producing well C11ST and from C09A to the producing well C16 makeup the two distances of that particular pair.

Figure 14:
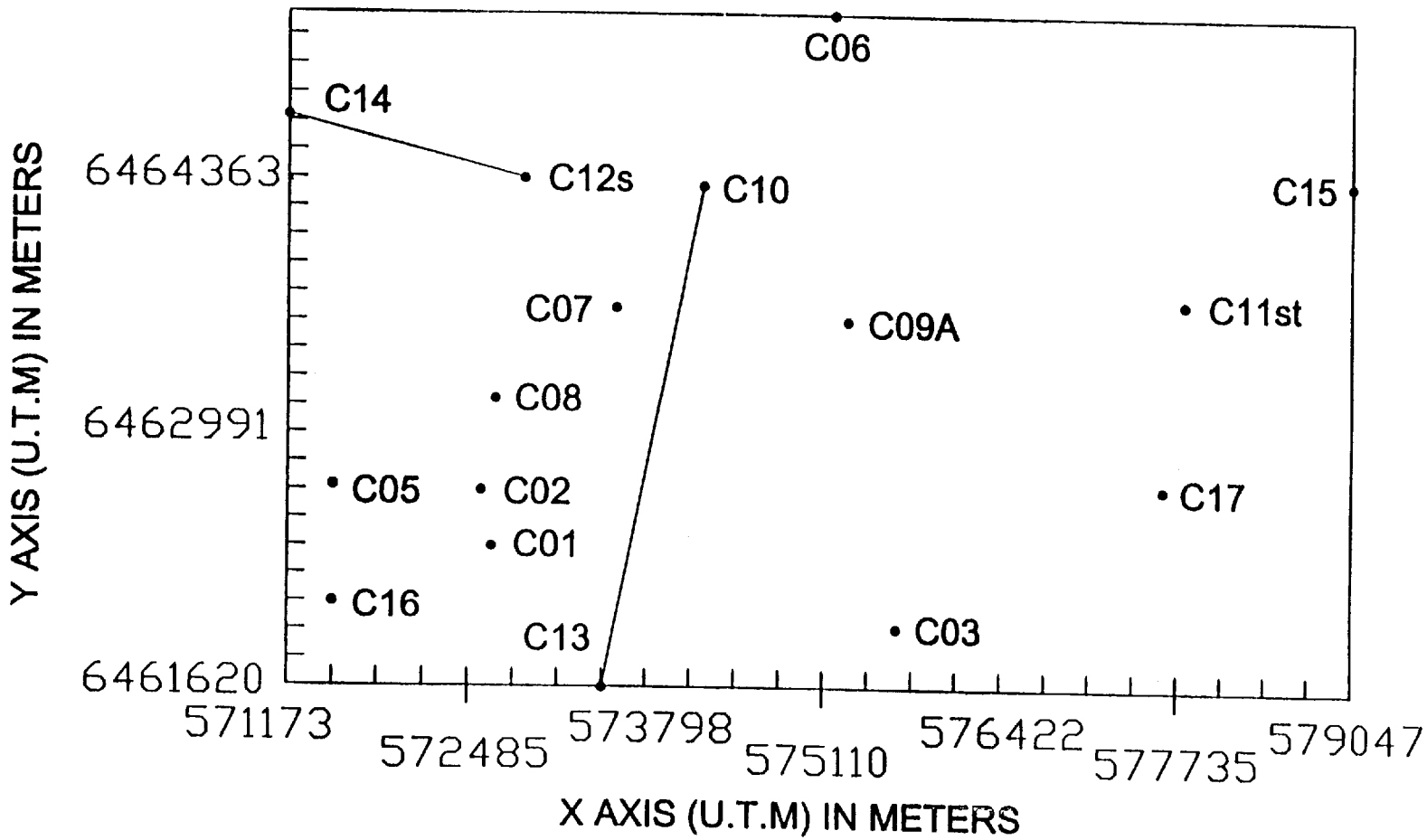
FIG. 14 illustrates the chart of FIG. 12 wherein the distance between first pairs of producing wells are compared to the distances between other second pairs of producing wells.

Similarly, FIG. 14 illustrates one example of a distance coupling or pair wherein the coupling or pair utilizes four separate producing wells. One distance of the pair is from the producing well C14 to C12s and the other distance of the pair is the distance from the well C13 to the well C10.

Of all of the possible distance pairing combinations both utilizing three producing wells having a common origin well and utilizing four separate producing wells, twenty-seven (27) pairings or couplings yielded a common distance ratio of the smaller distance Y of each pairing over the larger distance X of each pairing and which utilized each and every producing well at least once for the entire Captain field. As shown in the table of FIG. 15, of the twenty-seven different couplings that produce the constant ratio, the couplings 1, 11, 12, 16, 18, 21 and 27 utilize three producing wells and a common origin well whereas the remaining couplings utilize four separate producing wells.

Figure 16:
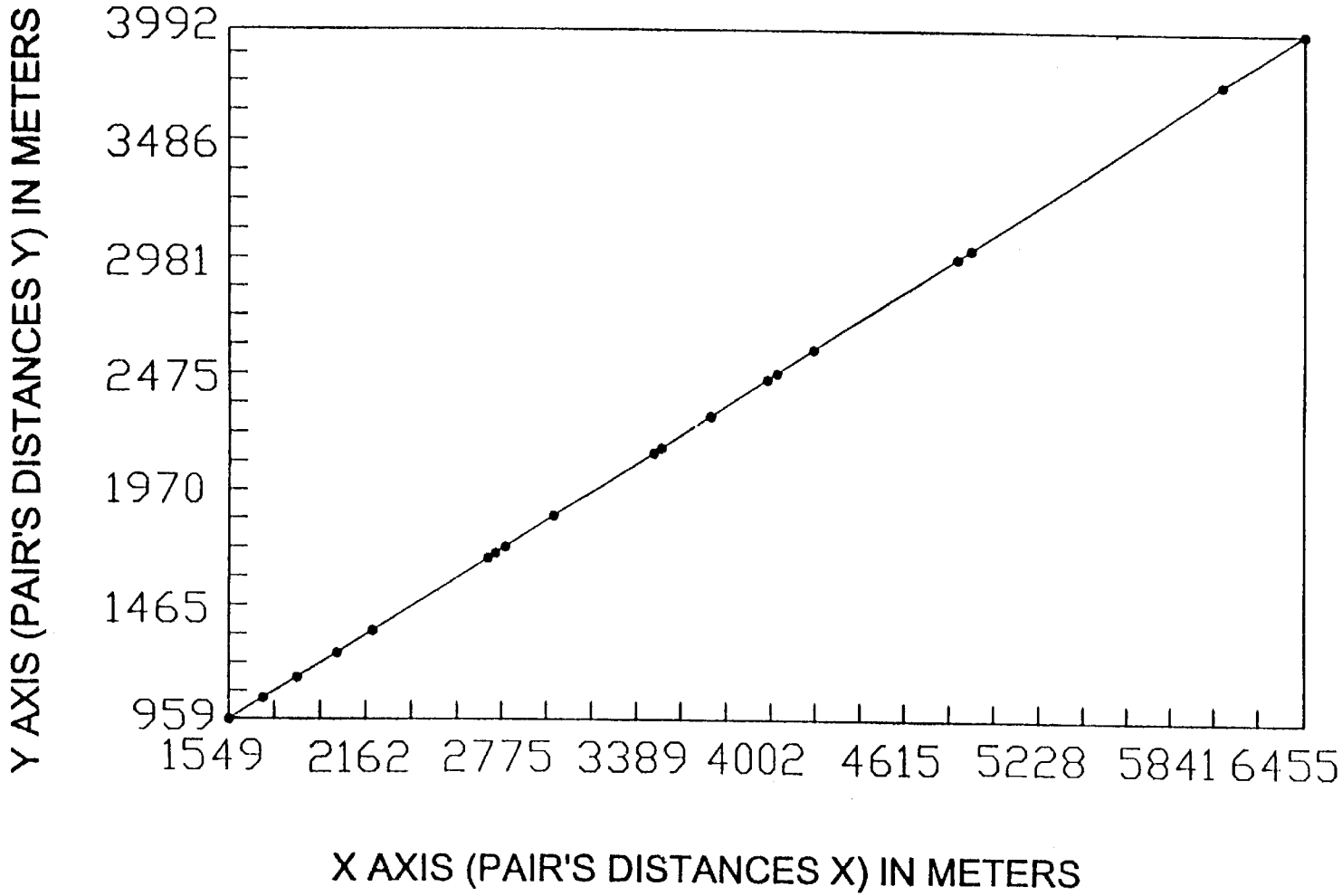
FIG. 16 illustrates a chart denoting the mathematical constant produced by the pairings of wells illustrated in the table of FIG. 15.

FIG. 16 illustrates a chart comparing the larger distance X of each pair along the horizontal axis to the smaller distance Y of each pair along the vertical axis. The slope of the curve is again linear or constant and is B=0.6181176 for the captain field.

FIG. 17 illustrates a data table comparing the actual larger distance X, smaller distance Y, calculated average smaller distance Y', and the difference of Y–Y' for each of the twenty-seven pairs or couplings that produce the constant ratio for the Captain field.

Figure 18:
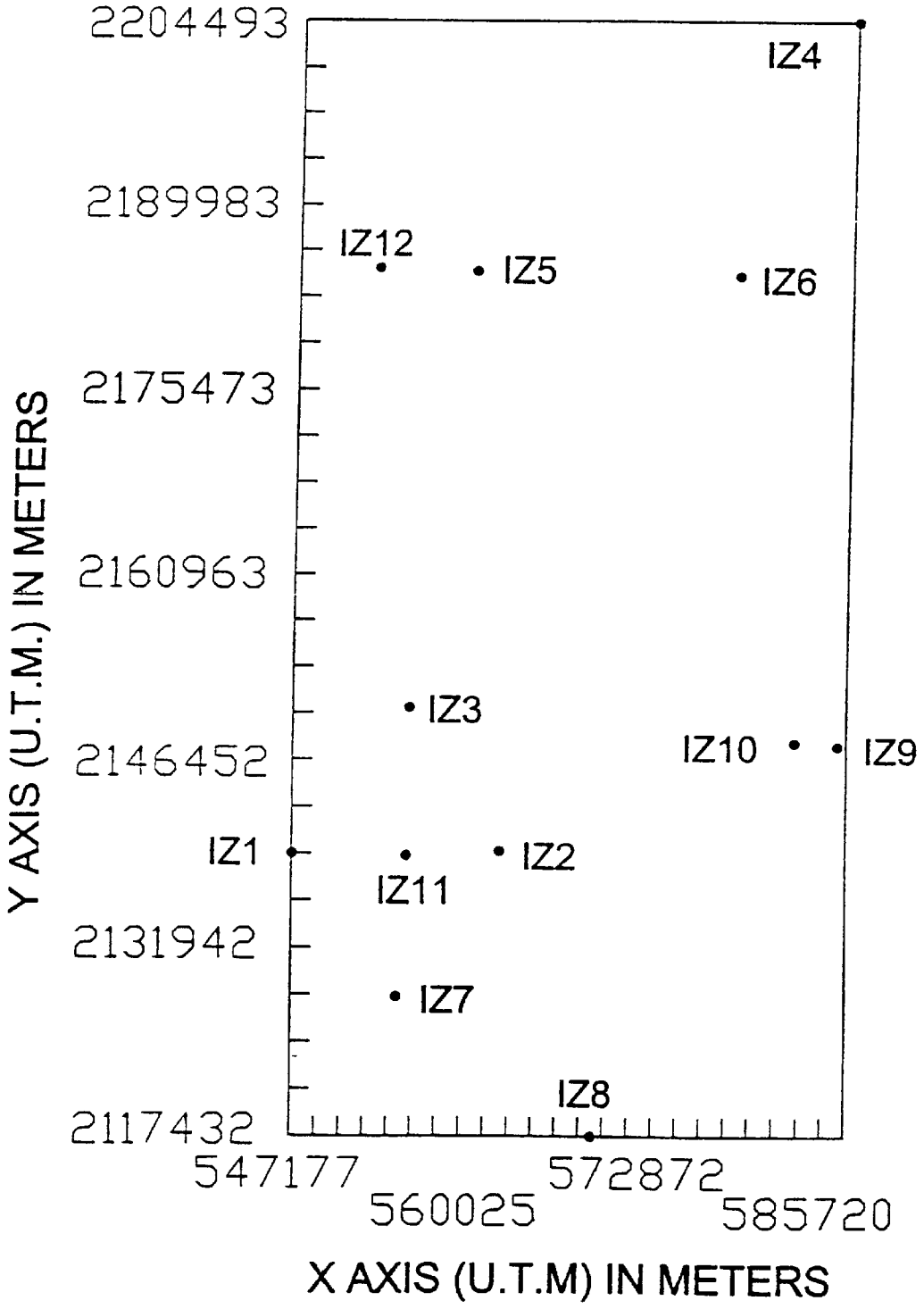
FIG. 18 illustrates a schematic chart showing each of the producing wells of another oil field located in Argentina.

As another example, FIG. 18 illustrates a schematic chart of the twelve oil producing wells of an oil field identified as Izozog Field, located in Argentina. Again, the chart includes units of meters and geographically locates the wells according to the UTM coordinate system.

Figure 19:
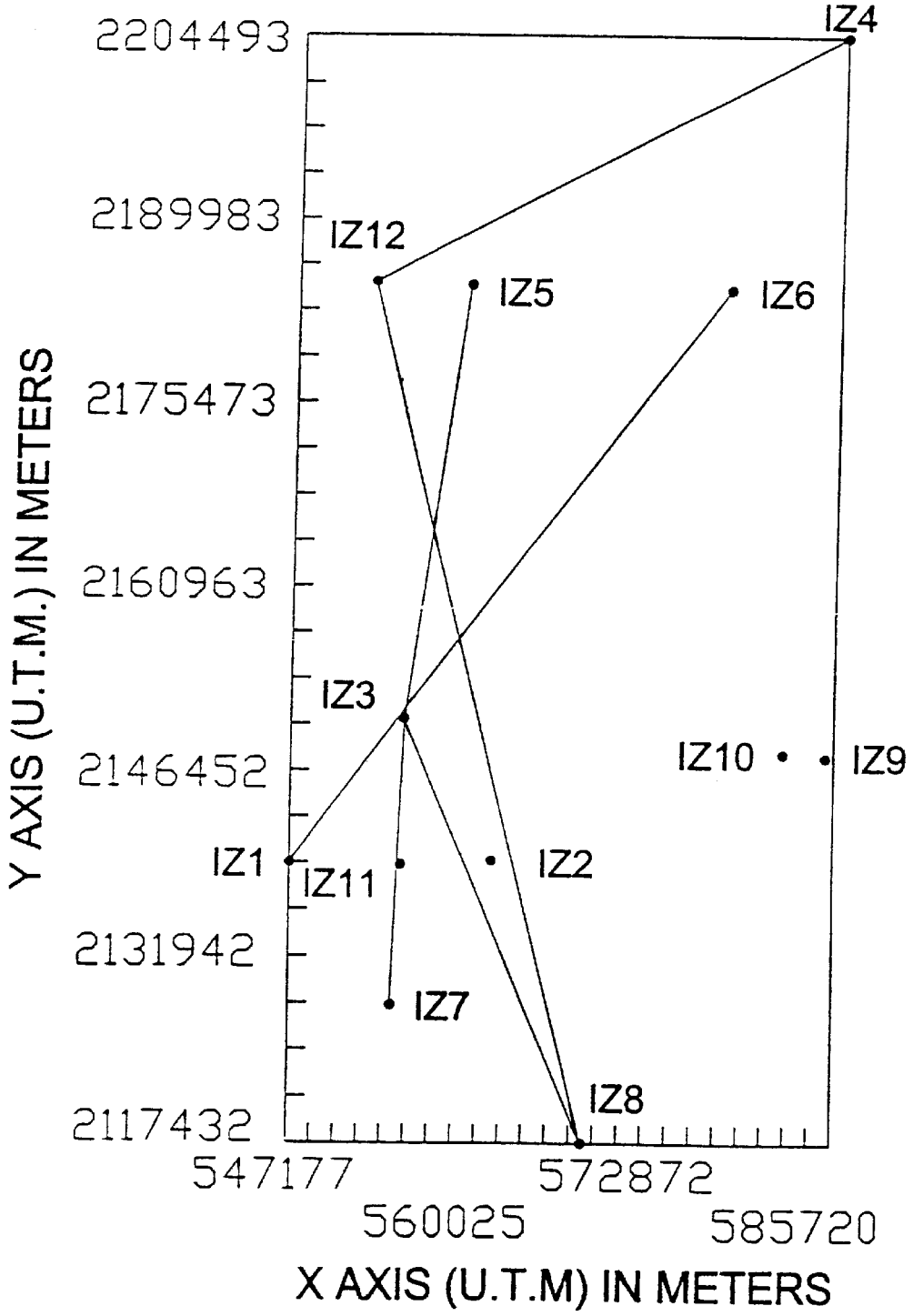
FIG. 19 illustrates a chart showing distances between a number of exemplary producing wells or well pairings.

FIG. 19 illustrates three examples of distance couplings or pairings utilizing only three producing wells with one of the three origin well. For example, where the well IZ12 is the origin well, the distance from the IZ12 to the IZ4 well and the distance from IZ12 to the IZ8 well provide one distance pairing. Where the producing well IZ3 is the origin well, the distance from the IZ3 well to the IZ8 well and the distance from the IZ3 well to the IZ7 well provides another distance pair. Also illustrated in FIG. 19, is one example of a distance pairing utilizing four separate oil producing wells. For example, the large distance X for this pairing is the distance from the well IZ6 to the well IZ1 and the small distance Y is the distance between the IZ5 well and the IZ3 well.

Figure 21:
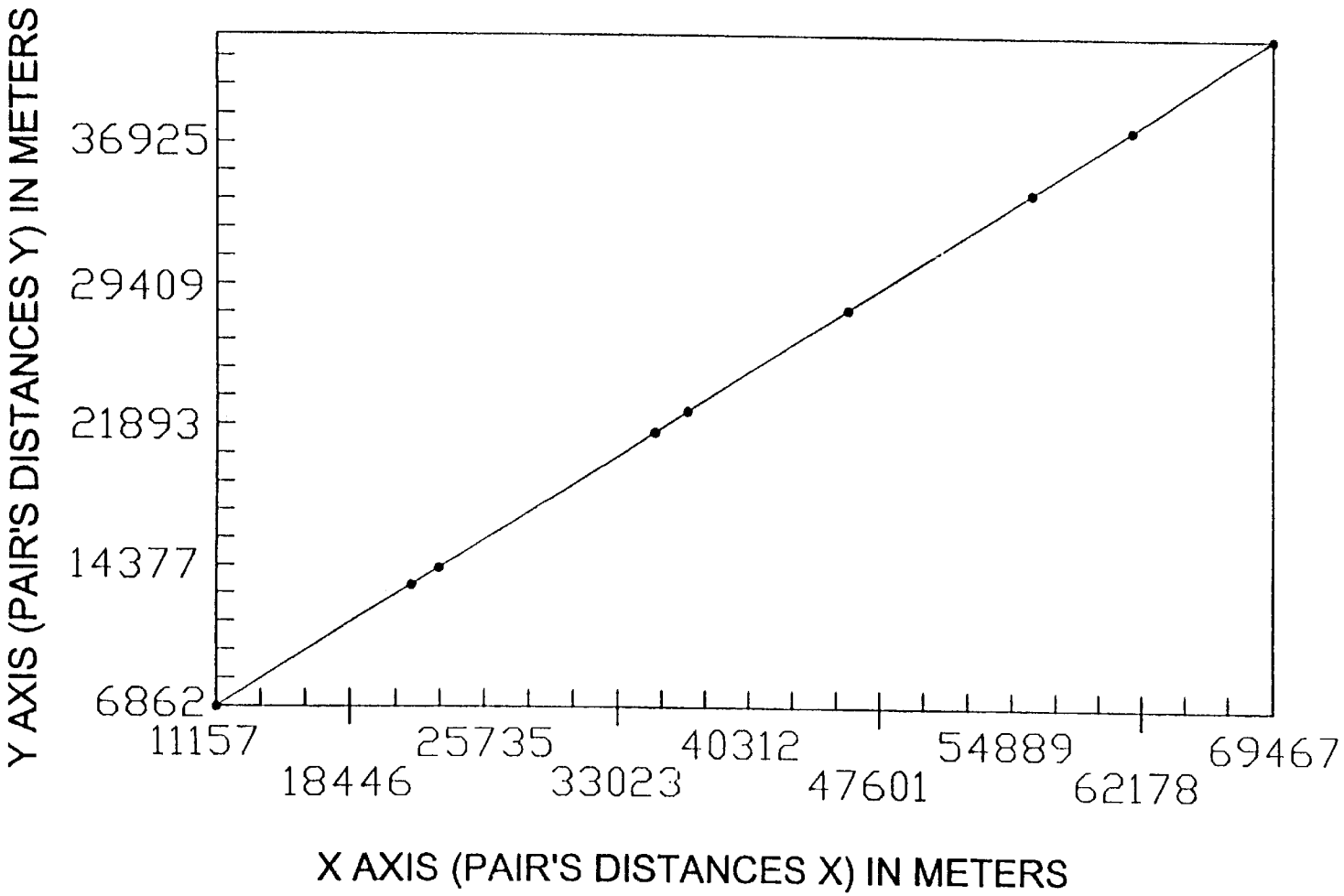
FIG. 21 illustrates a chart denoting the a mathematical constant for each of the producing well distance pairings of the table of FIG. 20.

Out of all the possible distance pairings utilizing either the three well or the four well statistical analysis, nine (9) pairings again produced the same constant and also utilized each and every well at least once for the entire Izozog field. The data for each of these nine pairings is shown in the table of FIG. 20. As shown in FIG. 20, pairing numbers 1, 2, 4, 6, 8 and 9 utilize only three wells and the distance pairings 3, 5 and 7 utilize four wells. Again, the ratio for each of these pairings identified as the small distance Y over the large distance X of each pairing equals a constant value B=0.6185382. FIG. 21 illustrates a chart having the large distance X of each pair plotted along the horizontal axis and the small distance Y of each pair plotted along the vertical axis. Again, the curve is linear and has a slope of B=0.6185382. This plot includes each of the well pairings shown in the table of FIG. 20.

FIG. 22 illustrates a data table including the large distance X and the small distance Y for each pairing noted in table 20. This data table also includes the calculated average small distance Y' as well as the difference between the calculated distance Y' and the actual distance Y.

In all, ten different oil fields in a number of different countries were statistically analyzed in the manner discussed above. FIG. 23 illustrates a chart or table listing the country and the oil field in that particular country that was analyzed. FIG. 23 also lists the number of producing wells in each field and the number of distance pairings or couplings producing the same mathematical relationship. FIG. 23 also lists the constant or slope B that was discovered for each of the particular oil fields analyzed. Surprisingly, in each oil field analyzed, a distance ratio among a number of distance pairings between three oil wells including an origin well or four separate oil wells, and wherein every producer well in each field was utilized at least once, the constant or slope B was found to be virtually identical.

The average constant or slope B for all of the data obtained from the ten fields analyzed was B=0.61804. The significance of this constant B or slope obtained from all of these different and unrelated oil fields was further analyzed. Given that the constant or slope B represents a ratio of the smaller distance Y of a distance pairing over the larger distance X of the same distance pairing, if the ratio is equal to 0.61804, this relates to the equation 0.61804=Y÷X, then the smaller distance Y is equal to the larger distance X multiplied by the constant ratio 0.61804.

In solving an algebraic problem of comparing two lines X and Y of different length, and in making the bigger line X equal to one (X=1), the value of the smaller line Y is the dependent variable. Solving this problem results in the equation $X^2=Y(Y+X)$. Making X equal to 1, and in solving this quadratic equation, $Y=(-1)+1^2-4(1)(-1)^2=0.618033$. Surprisingly, this value is identical to the slope or constant B derived from analyzing each of the oil fields. Based upon the statistical data obtained from each of the oil fields and the result of equation 5, a new equation $$Y^2+X\cdot Y-X^2=0 \qquad \text{(EQ. 2)}$$

is generated bu substituting the variable X for 1 in the equations 3 and 4 above. Utilizing this equation, and knowing the independent variable X being the distance between two producing oil wells in any given oil field, one can calculate the dependent variable Y which can be utilized in a number of different ways.

One use of the present invention can be performed using two existing well locations to find a third. If two existing producing wells are known and the distance is known between the two producing wells, this distance is the independent variable X, or the large distance in a distance coupling or pair. In one example, one of the two wells is selected as the origin well and Equation 2 is used to calculate a second smaller distance or dependent variable Y. A third producing well will be found on a circle having a radius of the distance Y from the origin well. This calculation can be utilized to locate an existing location of a third producing well or alternatively, can be utilized to locate a third well location where a new well can be drilled that will be a producing well within the existing field.

Another use for the present invention can be performed using three existing well locations to find a fourth. Two existing producing wells are known in a given oil field and where the distance X between these two known wells is known. A third known producing well can be selected regardless of its position relative to the first two producing wells. Equation 2 can then be utilized to calculate a smaller distance or dependent variable Y from the third well to a fourth well location.

This particular calculation can be used for two purposes. First, the calculation can be done to locate an existing location of a fourth producing well relative to the third known producing well. Alternatively, this calculation can be performed to locate a fourth well location to drill a new well a distance from the third known producing well anywhere on a circle having a radius the distance Y from the third well.

Utilizing the methods of the invention, any known existing producing well in a given field can be utilized in conjunction with virtually any other known producing well to either locate an existing producing well without knowing its exact location and without resorting to sophisticated locating technology, or alternatively, can be utilized to locate an area where a new producing well can be drilled within the given oil field.

The Second Method of the Present Invention

In the second system of the present invention, a method is provided whereby two known oil well locations are employed in generating possible locations for additional wells. This method will first be outlined in general terms.

Thereafter, specific examples will be provided. Namely, the method will be carried out on well locations in: the Captain Field in the United Kingdom; the Albacora Oil Field in Brazil; the Mecoacan Oil Field in Mexico; the Izozog Oil Field in Argentina; and the Gullfaks Oil Field in Norway.

The invention involves a method of finding the geographic location of one or more producing wells on the basis of the location of two other known producing wells. A producing well is a well which generates a by product, such as in the case of a fossil fuel well, gas or petroleum.

In accordance with this method a pair of producing wells are located. These are two wells which are currently producing a by product, such as oil or gas. These wells are designated as first and second wells respectively. Thereafter, the first and second wells are designated on an x–y coordinate system, such as a system employing Universal Transverse Mercator coordinates. Next, the distance between the two wells is calculated on the basis of the coordinate positions of the first and second wells. This calculation is made in accordance with the following equation:

$$X=\sqrt{(x_1-x_0)^2+(y_1-y_0)^2} \quad \text{(Eq. 1)}$$

Within this equation the upper case X denotes the distance between the two selected wells. The lower case values $x_1-x_0$ represent the x coordinates of the first and second wells. Likewise, the lower case values $y_1-y_0$ represent the y coordinates of the first and second wells. As such, $x_1-x_0$ and $y_1-y_0$ form the legs of a right triangle, with the distance X being the hypotenuse.

In the next step of the method, a smaller distance Y is determined on the basis of the distance X. This smaller distance is computed in accordance with the following equation:

$$Y^2+XY-X^2=0 \quad \text{(Eq. 2)}$$

Namely, the distance X between the two wells is substituted in Equation 2 and Y is solved for:

$$Y=\frac{(-X_i)+\sqrt{X_i^2-4(1)(-(X_i^2))}}{2(1)} \quad \text{(Eq. 2a)}$$

This smaller distance Y, when measured from the first, or origin, well is designated as segment A. Next, a sequence of growing segments $A_n$ can be computed on the basis of segment A in accordance with the following equation:

$$A_n=Ae^{\theta \cot \alpha} \quad \text{(Eq. 3)}$$

Here, the value θ cot α represents the angle between segment A and the next segment in the series $A_n$. The value θ, measured in radians, is incrementally varied from 1 to an upper value n. Thus, the sequence $A_n$ is generated by varying θ from 1 to an upper value n. Additionally, cot α remains a constant value obtained from empirical evidence. Specifically, the value for cot α is determined on the basis of geometric data complied from existing well locations. It has been found that the angle α can be considered a constant of approximately 1.14 radians.

Consequently, the steps outlined above are employed in determining a sequence of growing segments $A_n$ all of which originate at the first, or origin, well. On the basis of the sequence $A_n$, a sequence of corresponding segments denoted $B_n$ can be computed. The values for $B_n$ are computed in accordance with Equation 2. Namely, segments A and B are utilized within Equation 2 as follows:

$$A_n^2+A_nB_n-B_n^2=0 \quad \text{(Eq. 2c)}$$

A value for $A_n$ is substituted in the above equation and $B_n$ is solved for.

Once a corresponding set of values of $B_n$ is computed, the intersection between individual segments $A_n$ and $B_n$ is determined. Specifically, each set of corresponding segments $A_n$ and $B_n$ will intersect at a specific point. Thus, the two sequences of segments $A_n$ and $B_n$ will generate a point distribution. The number of points within the distribution is equal to n, the number of segments computed. This point distribution takes the form of an arc and is designated as a trap slice. It has been found that the trap slice represents a region along which additional wells can be found. Namely, the trap slice contains one or more regions which contain hidden sources of fossil fuel.

The Captain Field United Kingdom

Figure 24:
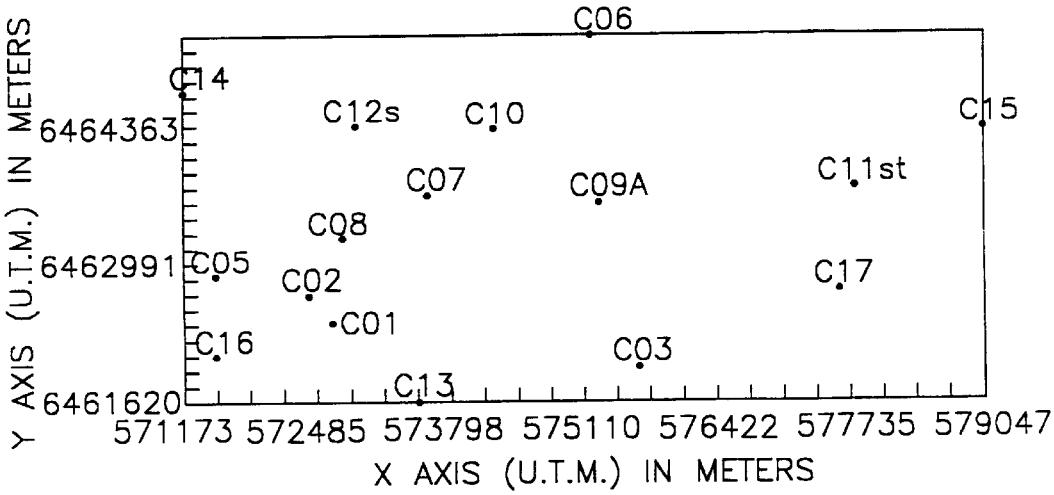

FIGS. 24–44 illustrate how the present invention is carried out in conjunction with the Captain Field in the United Kingdom. Specifically, FIG. 24 illustrates the distribution of the 16 producing wells of the Captain Field. This field is located in the U.K. North Sea, which is in the Northern Hemisphere.

Figure 25:
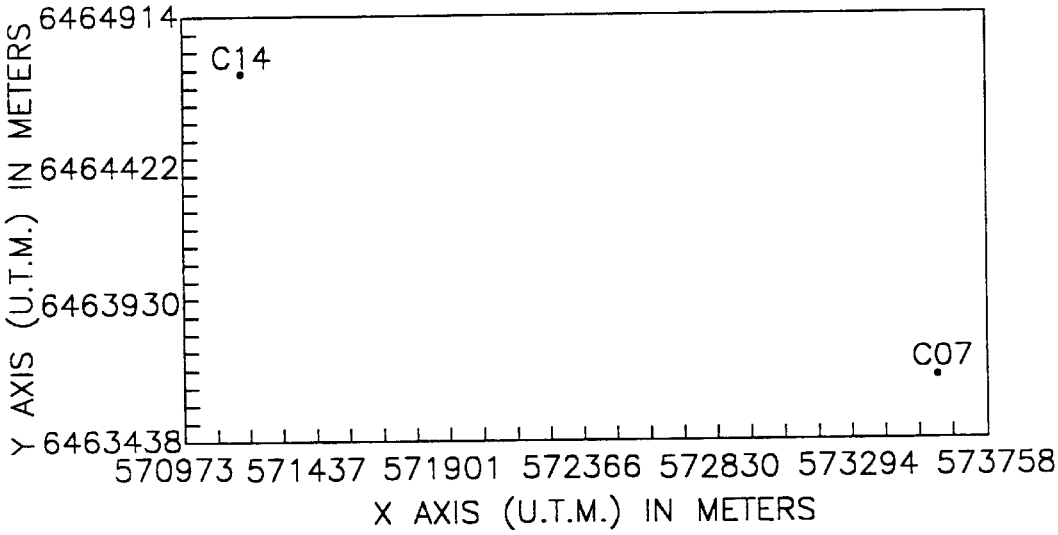
Figure 26:
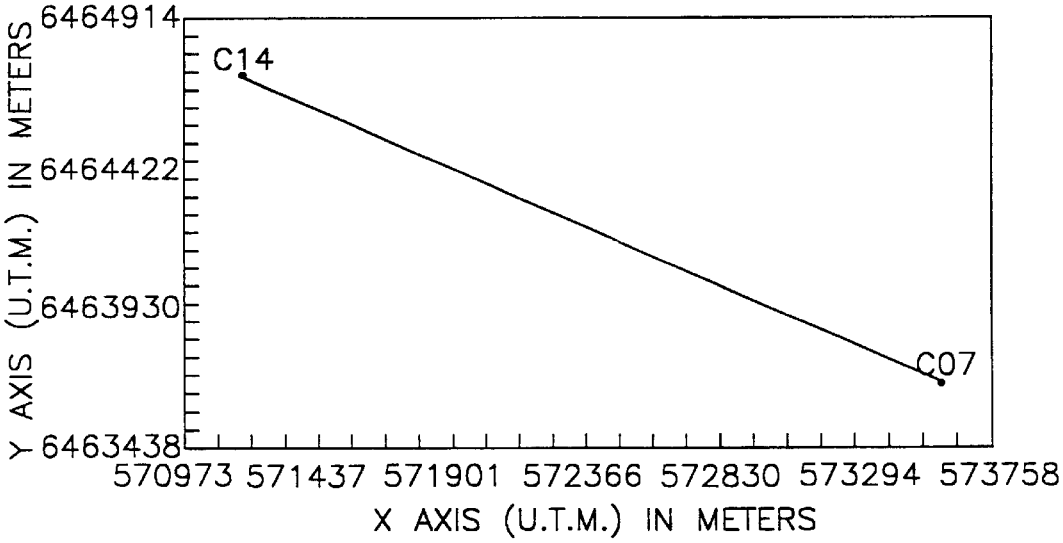
Figure 27:
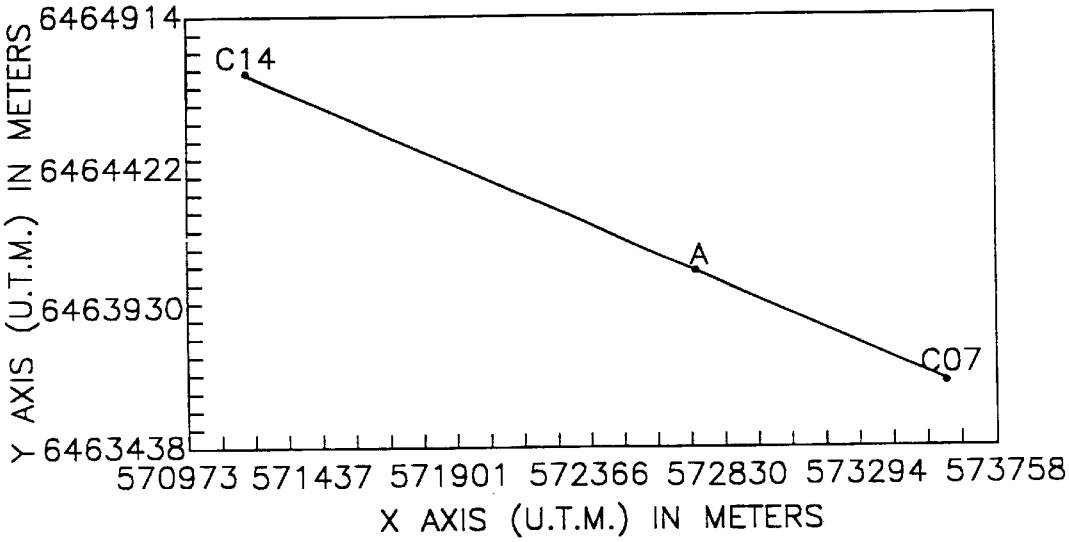

In accordance with the method, two producing well are selected—for example, producing wells C07 and C14 with coordinates UTM (573557,6463638) and (571173,6464714) respectively (indicated in FIG. 25). Next, the distance between these wells is measured using Equation 1. For the points selected, this distance is computed as 2615 meters and is indicated in FIG. 26. Thereafter this distance (X) is broken down into two segments, (A) and (B) by using Equation 2. This is accomplished by designating one of the wells as an origin well (C14) and then using Equation 2 to determine a smaller distance (Y). Namely, the distance between the two wells (X) is substituted into Equation 2 and (Y) is solved for. The distance Y from the origin well represents segment A. As such, B=X–A with A being bigger than B.

Figure 28:
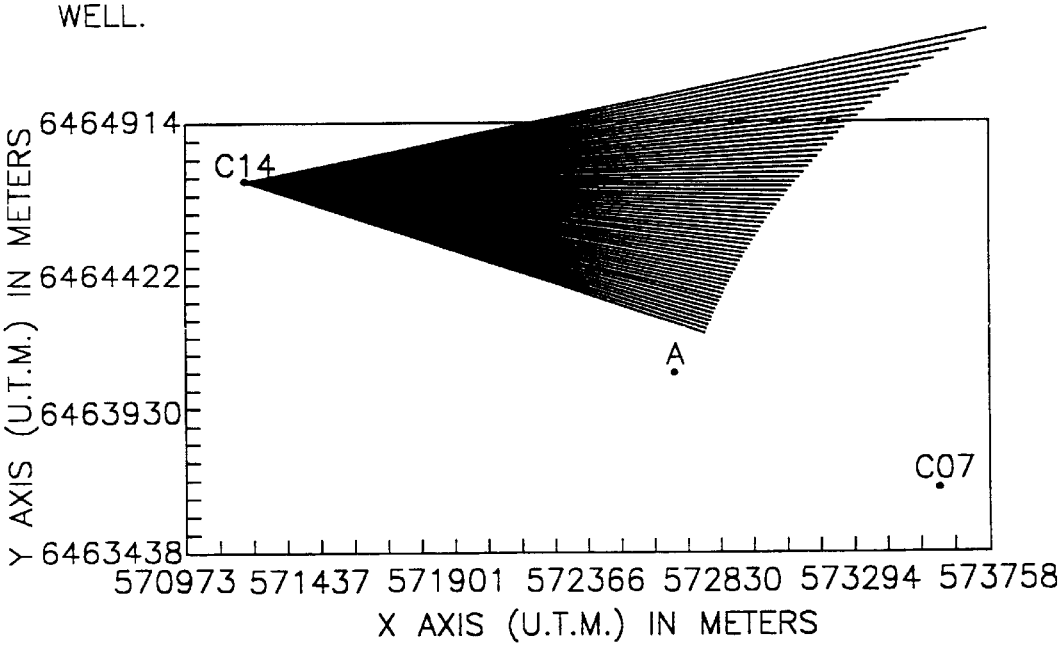
Figure 29:
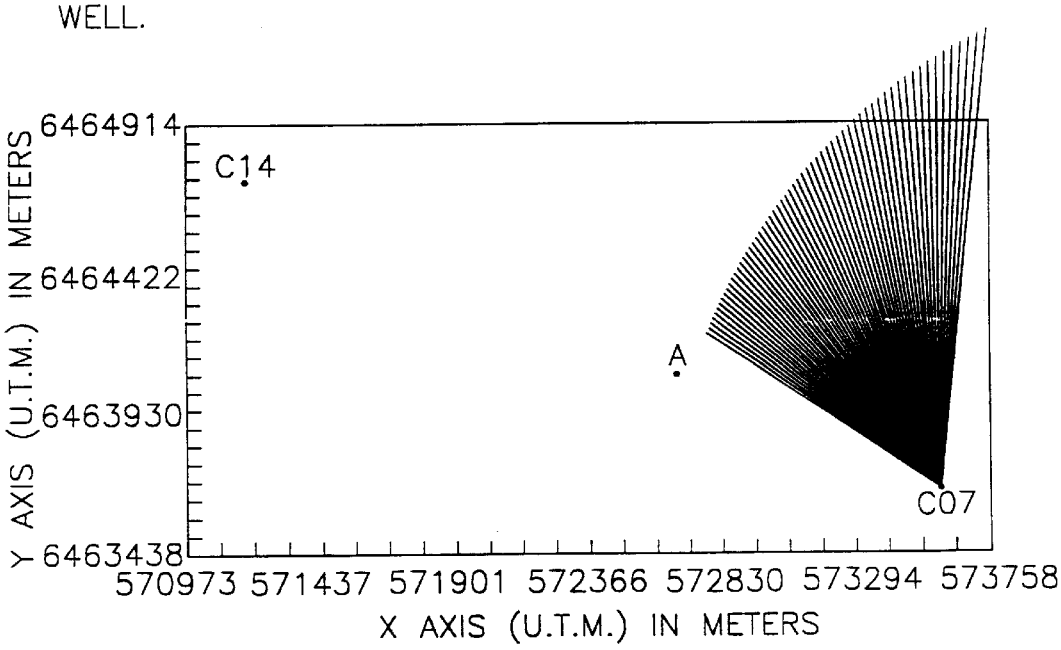

Next, using the distance A, in the Equation:

$$A_n=Ae^{\theta \cot \alpha} \quad \text{EQ. 3}$$

a sequence of growing distances, $A_n$, is computed by sequentially varying the angle θ from 1 up to 60 degrees in radians and using a fixed value for cot α. How this fixed value is arrived at is elaborated upon more fully hereinafter. The sequence of growing distances is illustrated in FIG. 28. The distances $A_n$, a total of 60, are then used one by one in Equation 2 to obtain a second sequence of growing distances $B_n$, from the second well C07. These values are illustrated in the FIG. 29.

Figure 30:
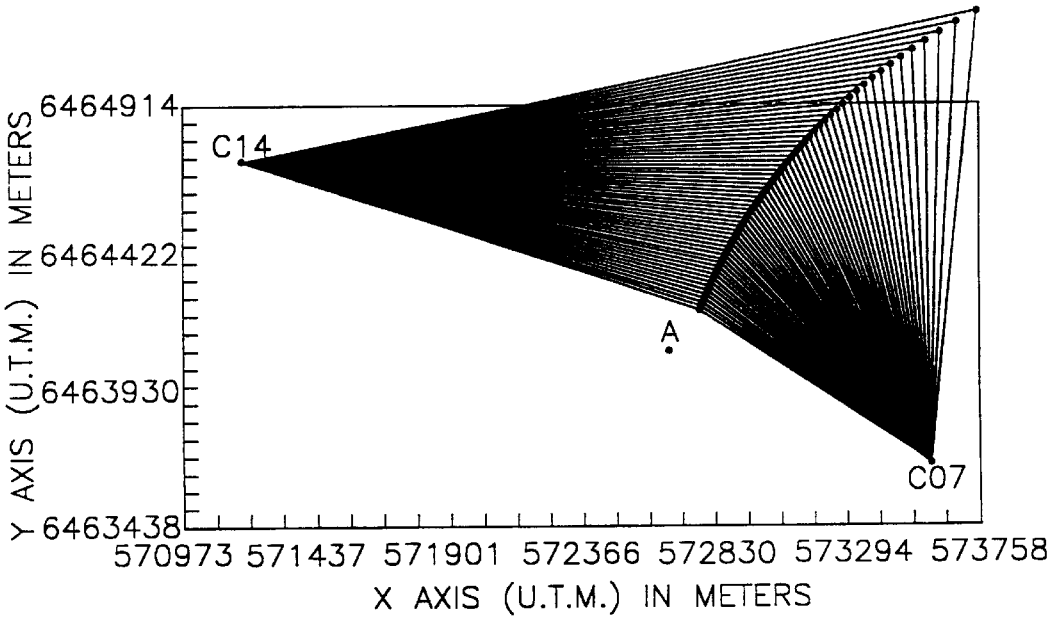

FIG. 30 illustrates that both sequences of growing distances, $A_n$ and $B_n$, coincide in a distribution of 60 points in UTM coordinates. The intersection of $A_n$ and $B_n$ form an arc. This arc is designated as a trap slice.

Figure 31:
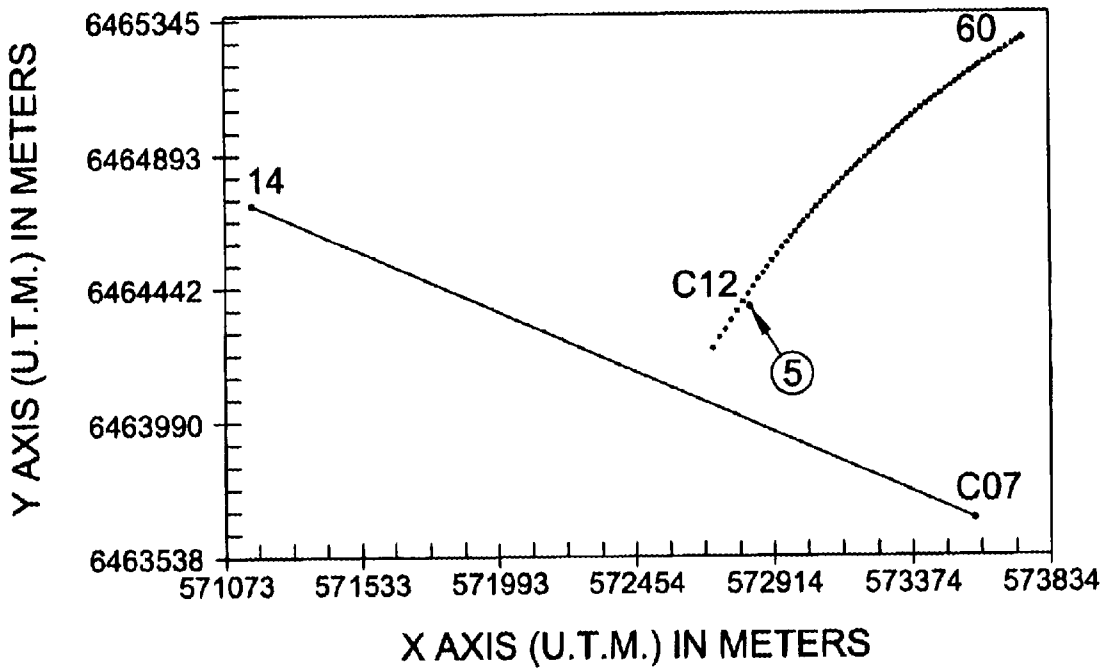

As noted in FIG. 31, there are 60 discrete intersections of the $A_n$ and $B_n$ segments. These points are designated 1 to 60, with 1 being the point closest to the straight line between wells C14 and C7. FIG. 31*a* is a listing of the coordinates of points 1 to 60. FIG. 31 illustrates point 5 within the trap slice distribution. Point 5 has UTM coordinates (572820, 6464372) and finds the geographic position of producing well C12s with coordinates (572860,6464358). The C12s well is 42 meters from point number 5.

Figure 32:
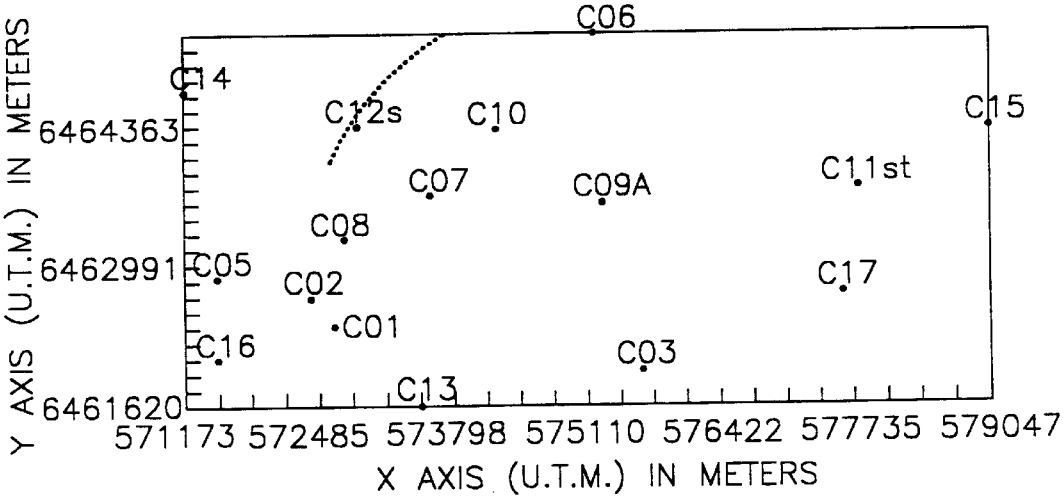
Figure 33:
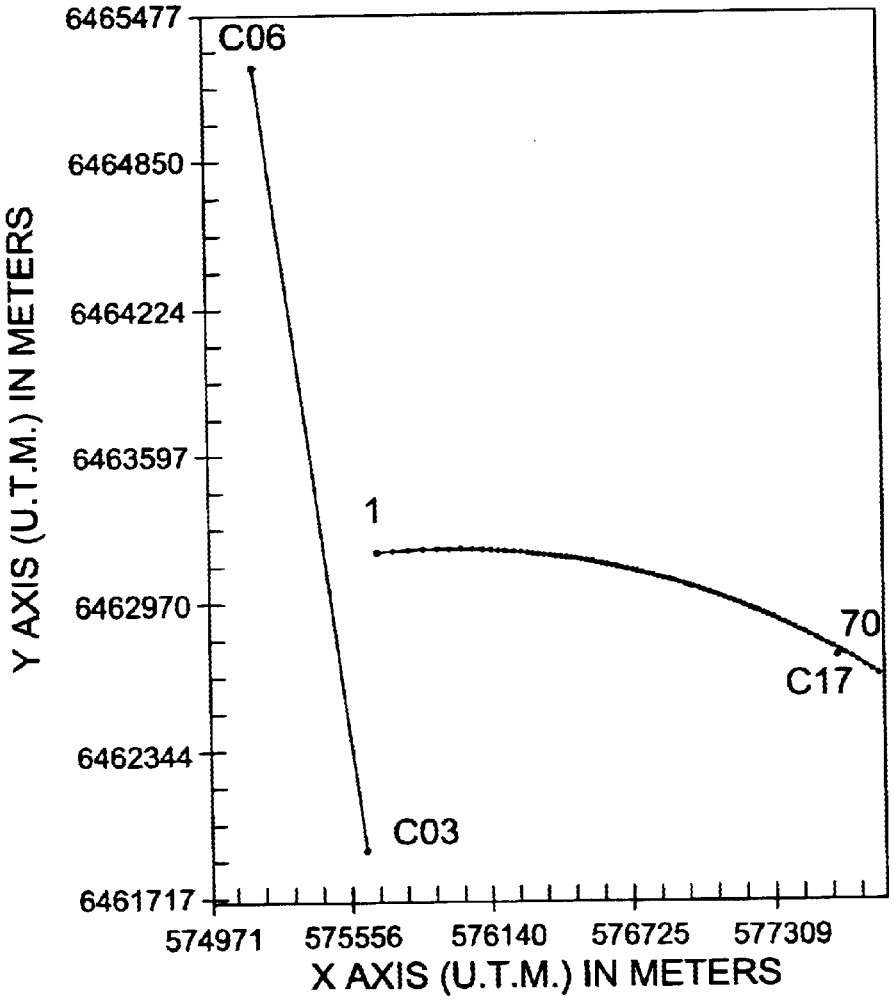
Figure 34:
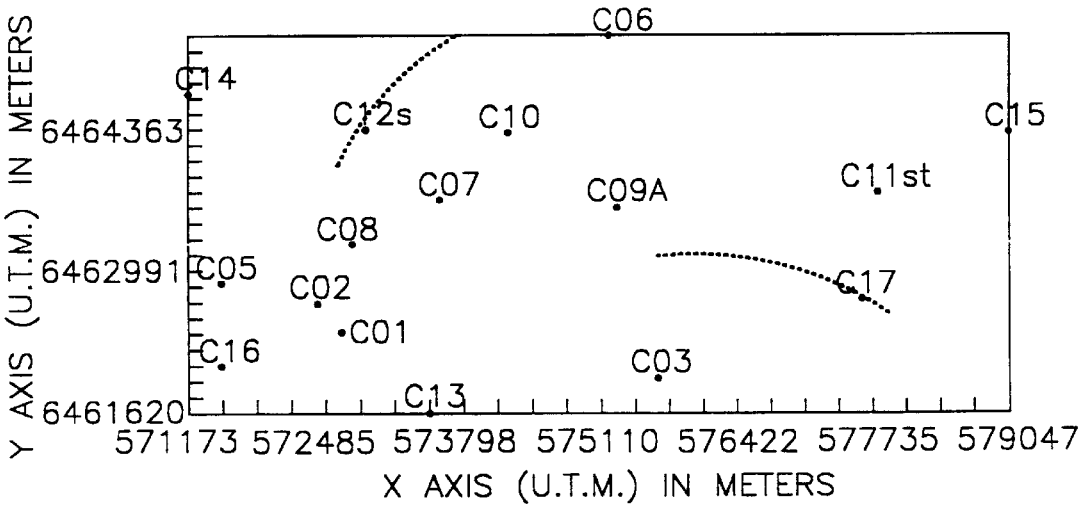

The FIG. 32 illustrates the producing wells in the Captain field as well as the relationship between the C12s well and the trap slice. The method can be carried out again between another couple of oil wells C06 and C03, with UTM coordinates (575171,6465277) and (575614,6461917) respectively. As indicated, Equation 1 is employed in determining the distance between these points. This distance is calculated to be 3389 meters. Thereafter, in the manner described hereinabove, Equations 2,3 and 2 are employed to compute a distribution of points, or a trap slice. The coordinates of the points along this trap slice are provided in FIG. 33*a*. FIG. 33 illustrates that point number 63 along the trap slice (again, with 1 representing the point nearest the line between wells C06 and C03) with coordinates (577580, 6462777) finds the geographic location of producing well C17 with coordinates (577577,6462751). The C17 well is only 26 meters away from point number 63. FIG. 34 illustrates located wells C12s and C17 within the Captain field.

Figure 35:
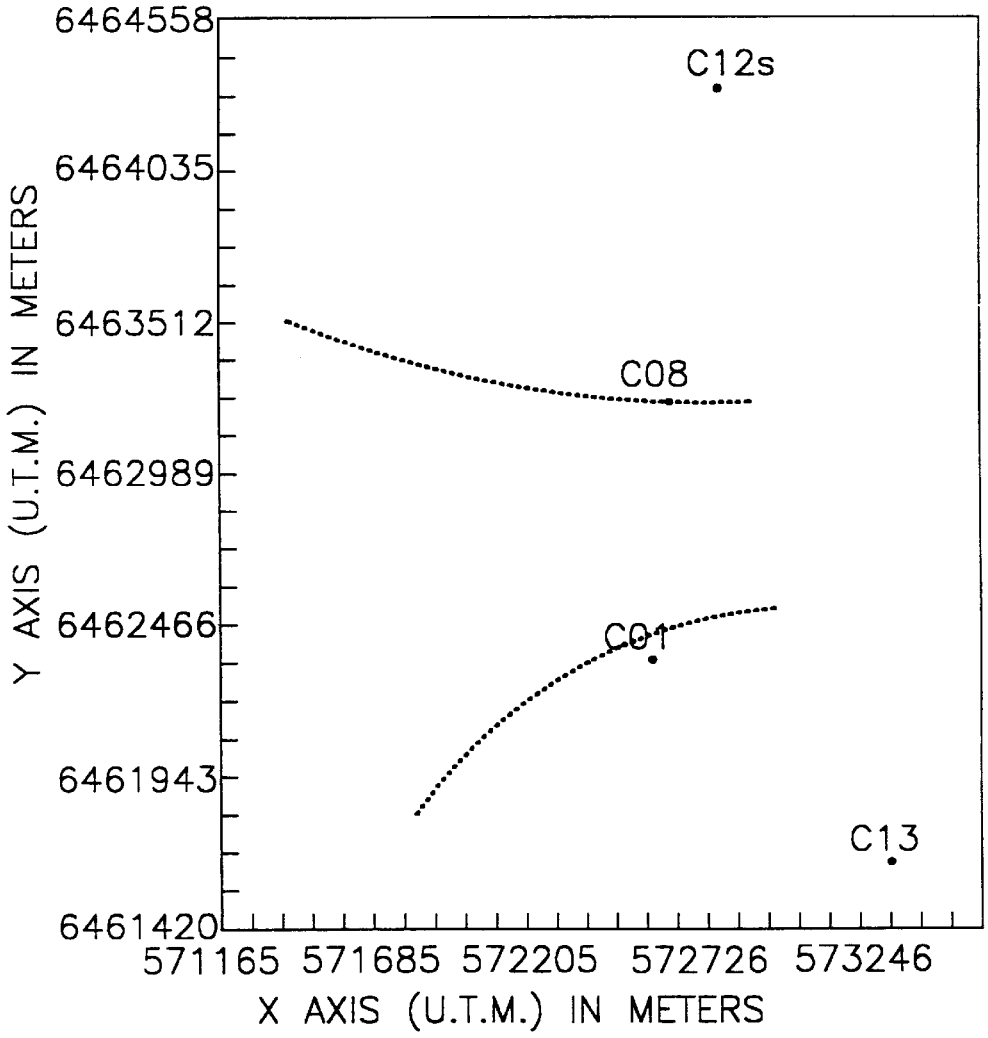
Figure 36:
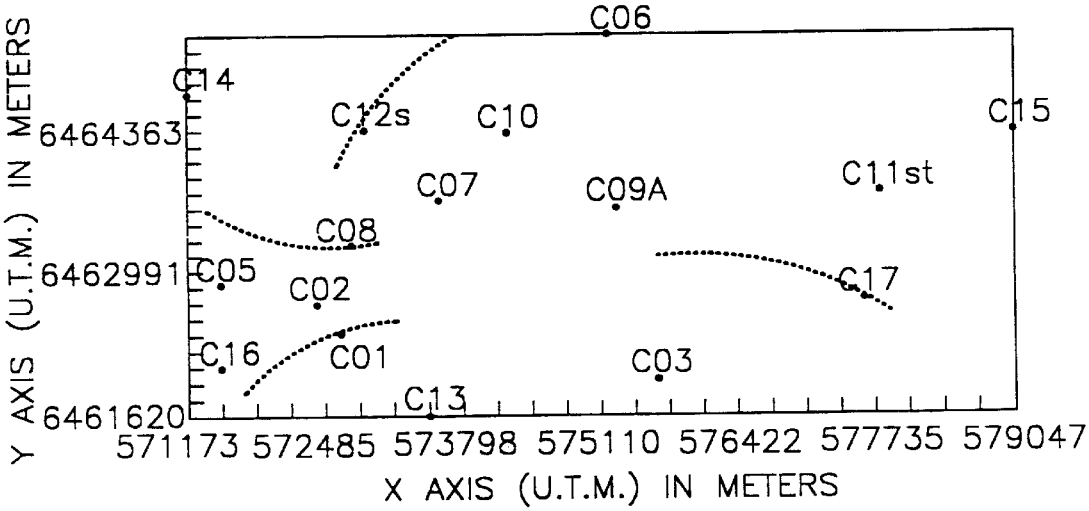

Next, one of the located wells is employed within the method. Specifically, FIG. 35 illustrates wells C12s and C13 with coordinates (572860,6464358) and (573462,6461620) respectively. These wells are separated by a distance of 2803 meters. Utilizing Equations 2,3 and 2, two distributions of points, or trap slices, are computed in two different directions. This is accomplished by first designating the C13 well as the origin well and employing Equations 2,3, and 2 to compute a trap slice. Thereafter, C12s is designated as the origin well and Equations 2, 3, and 2 are employed to compute another trap slice. In one of the trap slices, point number 13 (again, with 1 being the point nearest the line among the wells C12s and C13) has coordinates (572612, 6462451). Point 13 differs 50 meters from the geographic location of producing well C01 with coordinates (572624, 6462402). In the other trap slice, point number 5 with coordinates (572700,6463254) differs 20 meters from the geographic location of producing well C08 with coordinates (572684,6463242). The FIG. 36 illustrates the distributions of points within Captain field.

Figure 37:
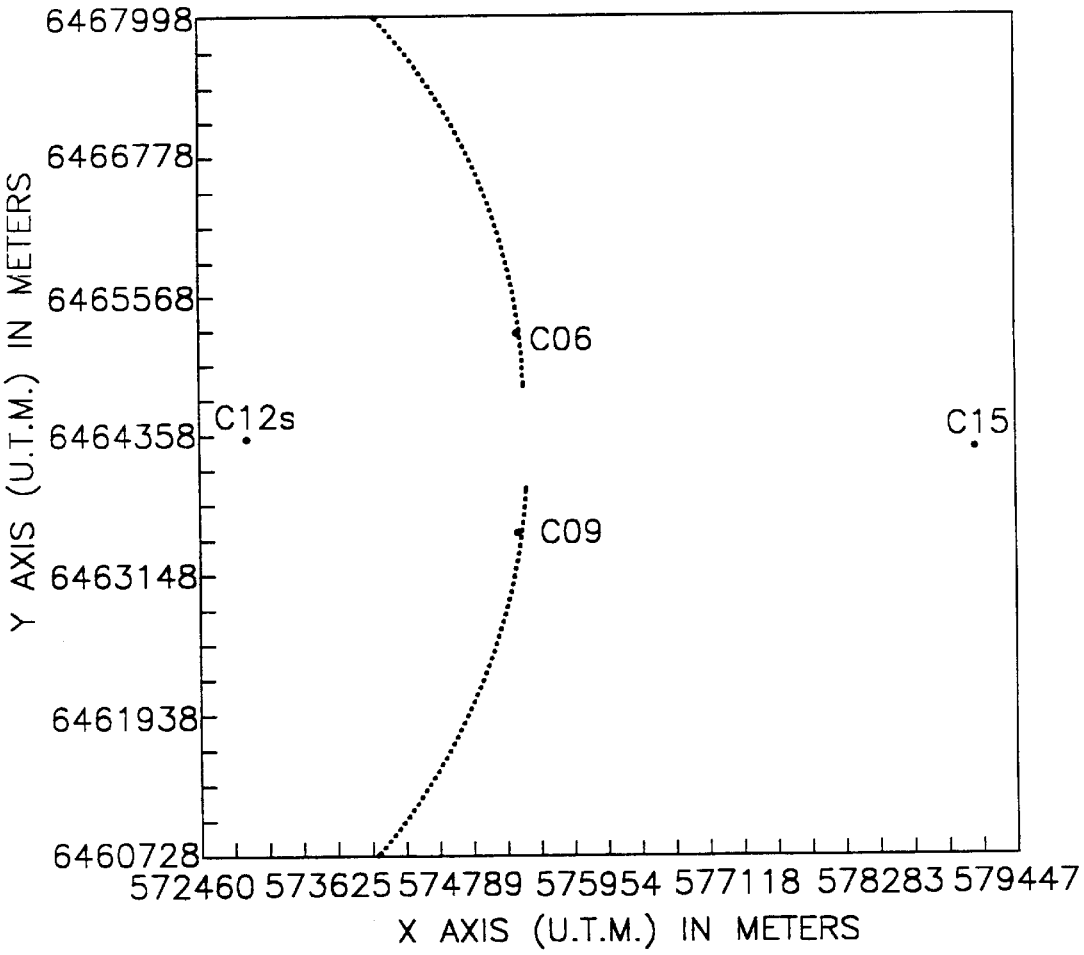

FIG. 37 illustrates the selection of two other wells C12s and C15 with coordinates (572860,6464358) and (579047, 6464324), respectively. The computed distance between these two wells is 6187 meters. Here, Equations 2,3 and 2, are employed to build two symmetrical distributions of points. One trap slice is above the line between the wells C12 and C15, the other below. Point 6, with coordinates (575154,6465298), belongs to the upper distribution and differs 27 meters from the geographic location of producing well C06 with coordinates (575171,6465277). Point 4, with coordinates (575179,6463598), belongs to the lower distribution of points and differs 53 meters from the geographic location of producing well C09 with coordinates (575226, 6463572).

Figure 38:
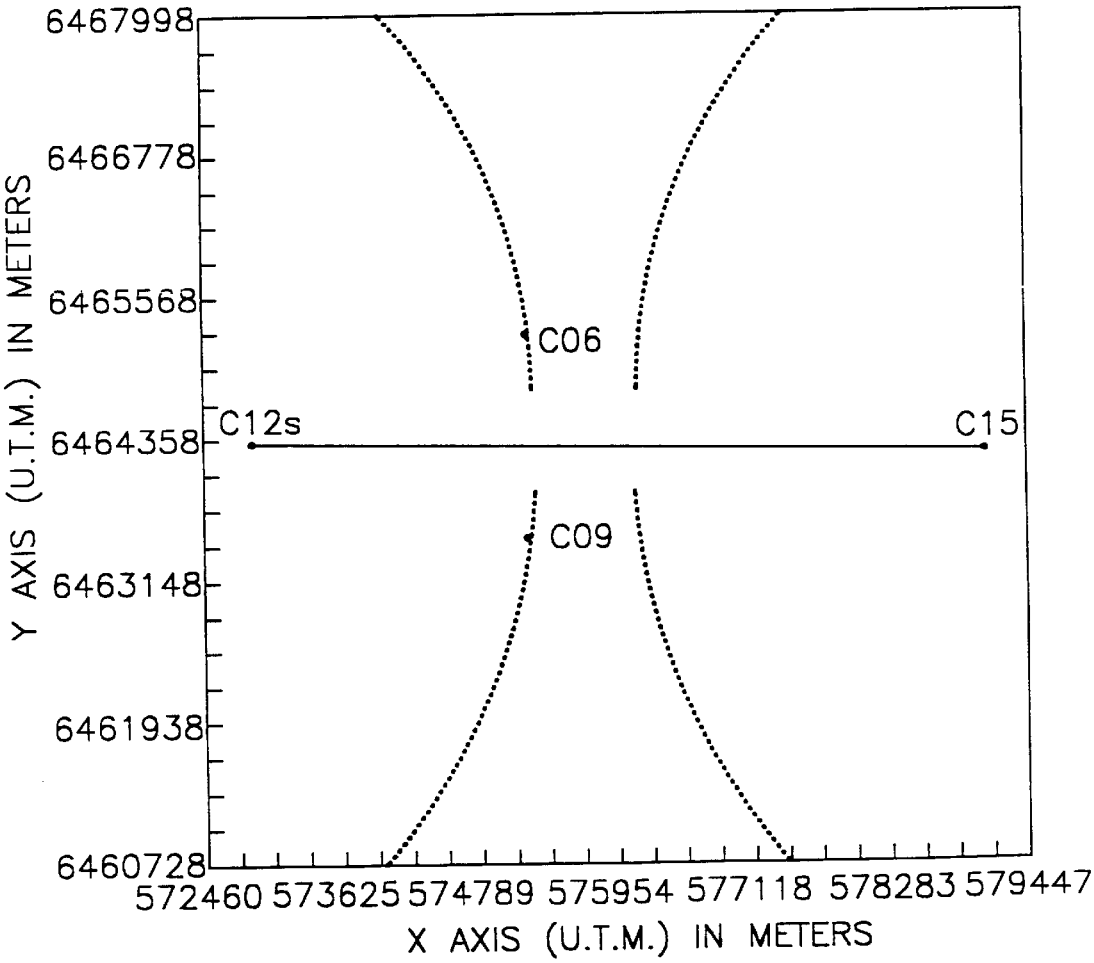

In general, for any couple of wells in the Captain field Equations 2,3 and 2 can be employed to generate four distributions of points or trap slices, symmetrical at the line among the two producing wells. These distributions are illustrated in FIG. 38. These four distributions are achieved as follows. First, the above method is employed to generate opposing trap slices above and below the line connecting points C12S and C15. Thereafter, the calculations are repeated, but with the second well designated as the origin well. The result is four trap slices symmetrical about the line connecting points C12S and C15.

Figure 39:
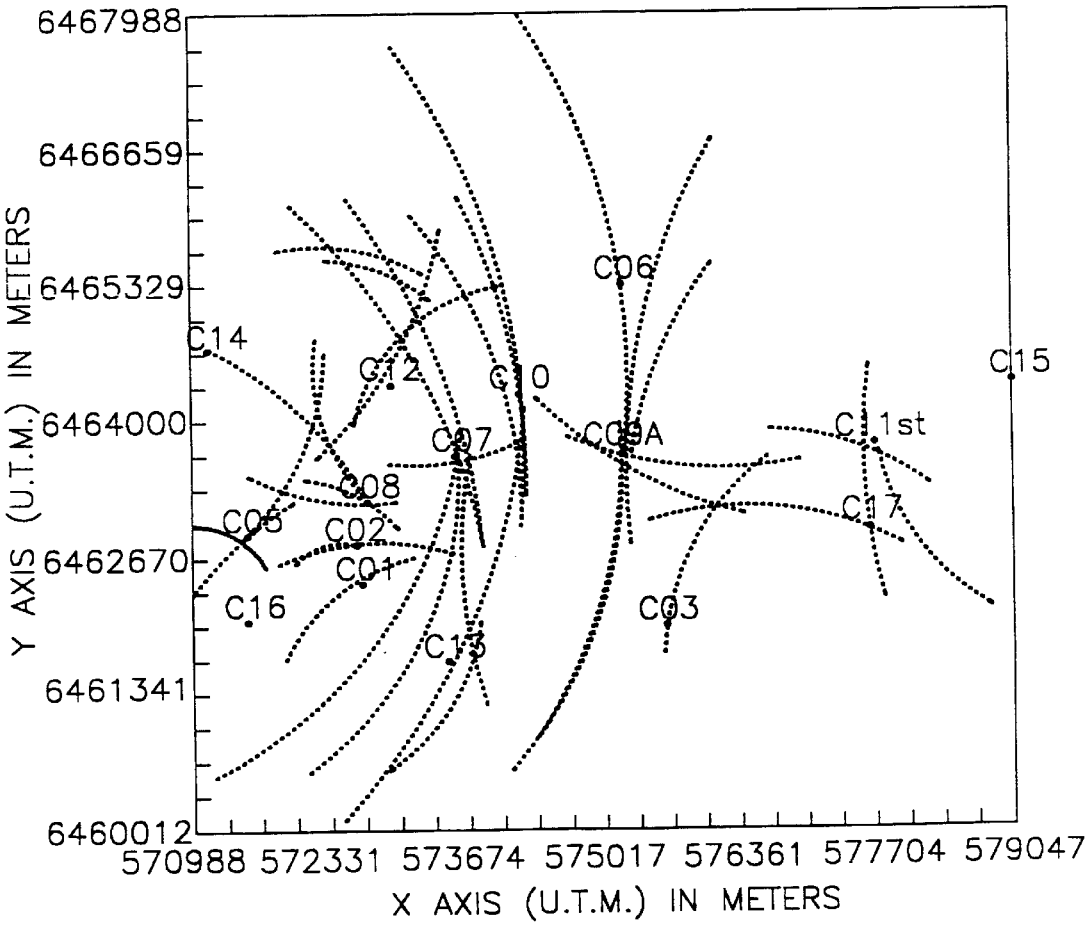

Also FIG. 39 illustrates that trap slice distributions of varying sizes, directions and with varying numbers of points, all find the geographic place of the same producing wells. For example, producing well C10 is located by three distributions of 60 points, namely the distributions created between points C05–C15, C02–C17 and C02–C11. Also, the FIG. 39 illustrates that 90% of the producing wells can be found on a distribution of points built by Equations 1,2,3 and 2. Therefore, 37 distributions of points or trap slices coincide with geographic locations that produce oil or gas. Since each couple of producing wells possesses four symmetrical distributions at their distance, there are 480 distinct distributions that should possess trap conditions with the possibility of being producers of oil or gas. So the geographic places where several distributions coincide will have increased probabilities of producing gas or oil.

Determining Cot α

Figure 55:
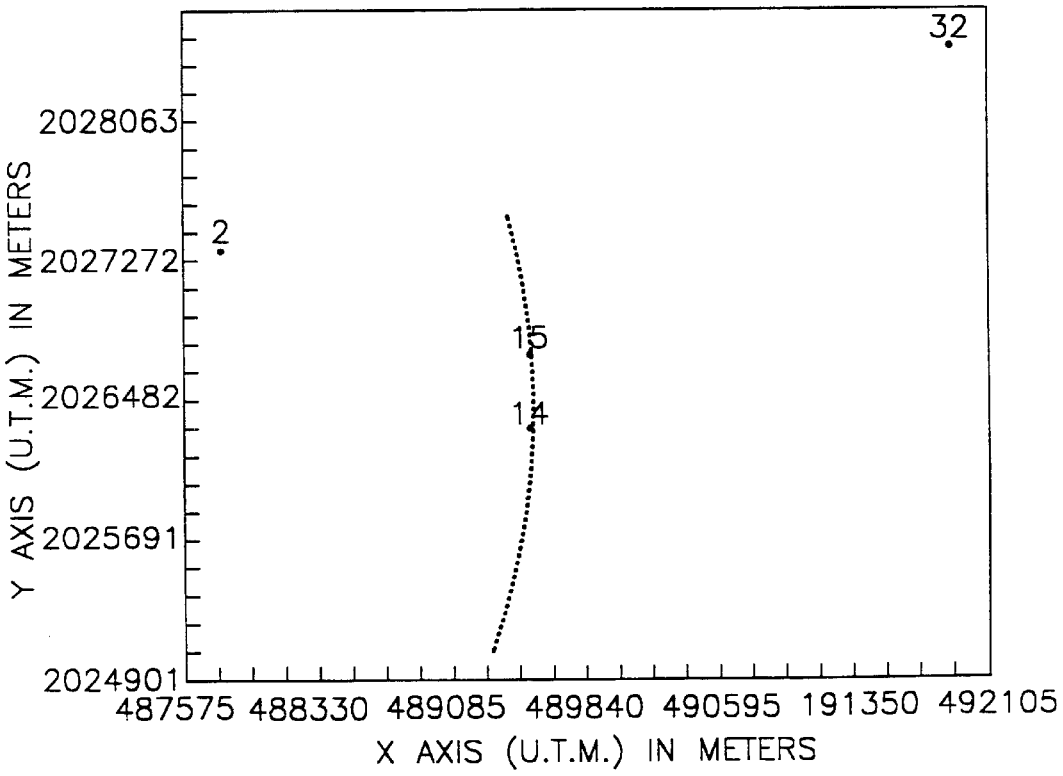

The manner in which the fixed value for the cotangent of α is determined is described next. Specifically, the cotangent of angle α (used in. Equation 3) is determined by direct measurements taken from oil fields. For example, FIG. 55 illustrates producing oil wells 2 and 32 in the Mecoacan Field in the Comalcalco basin in Mexico. These wells have coordinates (487775,2027300) and (491905,2028495), respectively. By using Equation 1, the distance among these wells is determined to be 4299 meters. Thereafter, Equation 2 is employed in the manner described above to divide this distance into two segments. Specifically, using Equation 2 a distance of 2657 meters from well 32 is designated as point A.

Thereafter, the UTM coordinates of point A are determined on the straight line among the wells 2 and 32. As explained hereinabove, point A is a guide to find producing wells near point A along a growing sequence of distances from the producing well 32. For example, producing wells are located at points 15 and 14 (with coordinates (489500, 2026705) and (489500,2026305) respectively) along this growing sequence of distances. The distance measured between the producing wells 15 and 32 is 2998 meters, and the distance measured between the producing wells 14 and 32 is 3252 meters. With this data, one can use Equation 3 (which calculates growing distances $A_n$ as a function of the angle θ) to obtain a value for cot α. This is achieved by measuring the angle between segments A and $A_n$ and estimating the value as θ. Namely, the cot α term is ignored. These measurements indicate that the angle between segments 15–32 and 2–32 is 14 degrees. Likewise, the angle between the segments 14–32 and 2–32 is 25 degrees. Namely, for producing well 15 a value of θ of 14 degrees is obtained and for the producing well 14 a value of θ of 25 degrees is obtained. Therefore, for each producing well 15 and 14 we have a pair of values representing angle and distance. These values are (14,2998) and (25,3252) for points 15 and 14, respectively.

Next, applying the natural logarithm to both sides of the Equation 3 one obtains:

$$Ln(A_n)=Ln(A)+\theta \cot \alpha Ln(e) \Rightarrow Ln(A_n)=Ln(A)+\cot \alpha\theta \qquad \text{EQ. 4}$$

Where Equation 4 is a linear half logarithm equation that depends on the Angle θ in radians to produce the natural logarithm of the distances. Again, however, the value for cotangent α can be ignored. This permits calculations to be performed using the couples angle-distance, (14,2998) and (25,3252) for producing wells 15 and 14 respectively. Furthermore, by performing classical techniques of linear regression to Equation 4 we obtain:

$$slope = \frac{\sum \theta_i \mathrm{Ln}(A_i) - n\bar{\theta}\overline{\mathrm{Ln}}(A)}{\sum \theta_i^2 - n\bar{\theta}^2} \text{ and } \cap = \overline{\mathrm{Ln}}(A) \quad \text{EQ. 5}$$

For producing wells 15 and 14, the angles in degrees are transformed into radians, and the natural logarithm is determined for each of the respective distances, obtaining the values (0.2443,7.997327) and (0.4363,8.085486) respectively.

These values can be employed within Equation 5 to obtain angle $\alpha$=1.400335 radians, knowing that in the Equation 5 one has:

$$\tan\alpha = \frac{1}{slope} \Rightarrow \alpha = \mathrm{Arctan}\alpha \quad \text{EQ. 6}$$

Finally, this value of the angle $\alpha$ is used under the function cot $\alpha$, as a fixed value in the Equation 3 and this will always be used given any distance between any two producing wells in any oil field.

Figure 41:
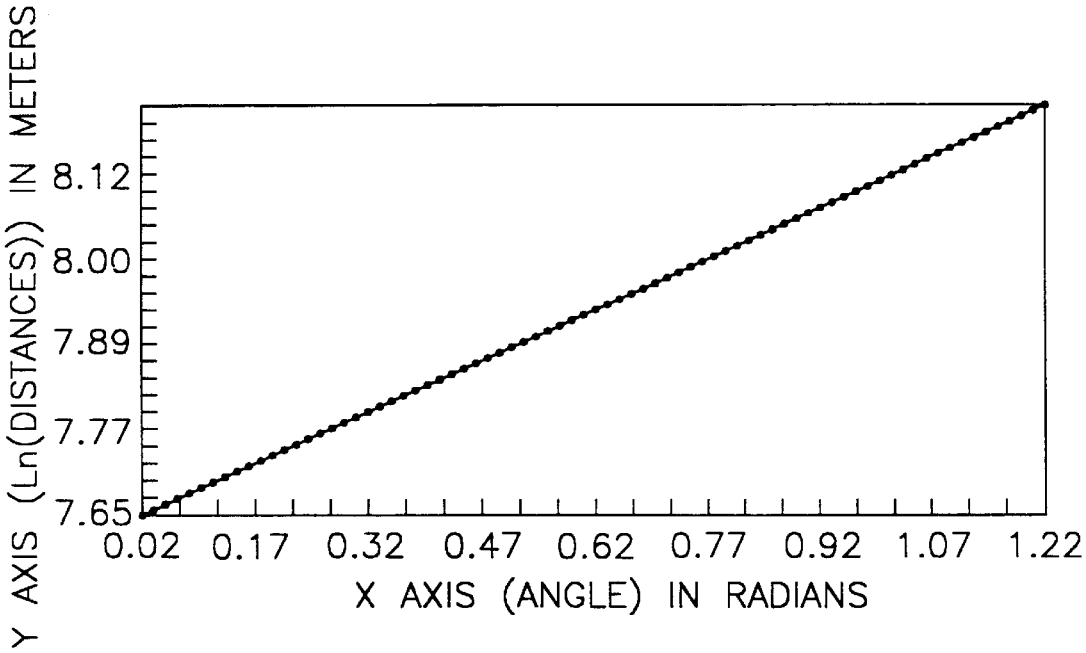
Figure 43:
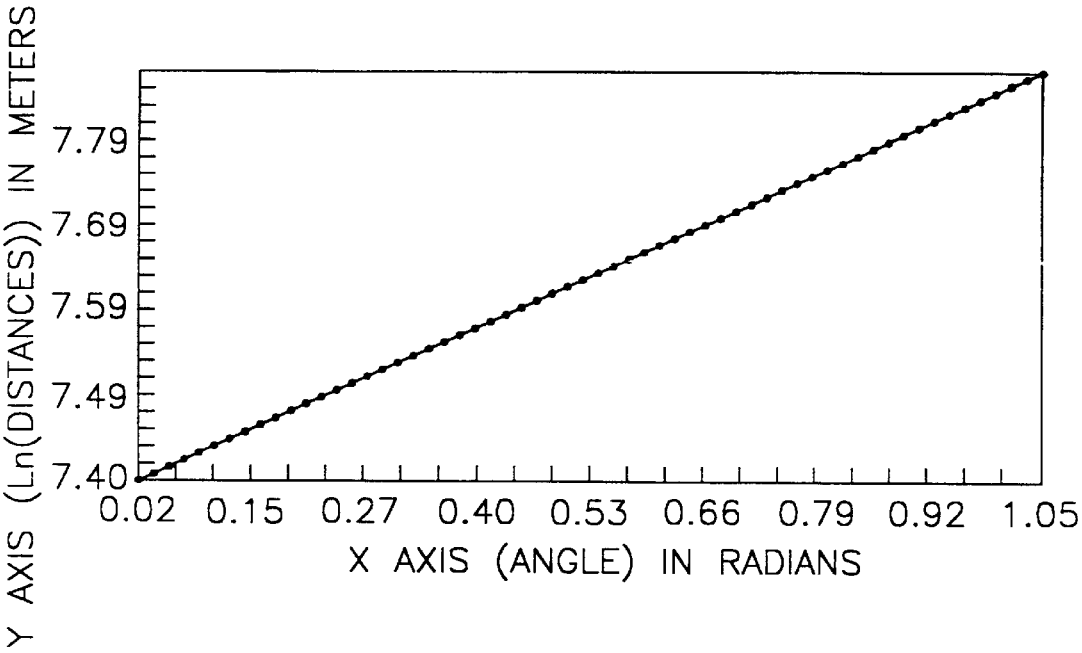
Figure 44:
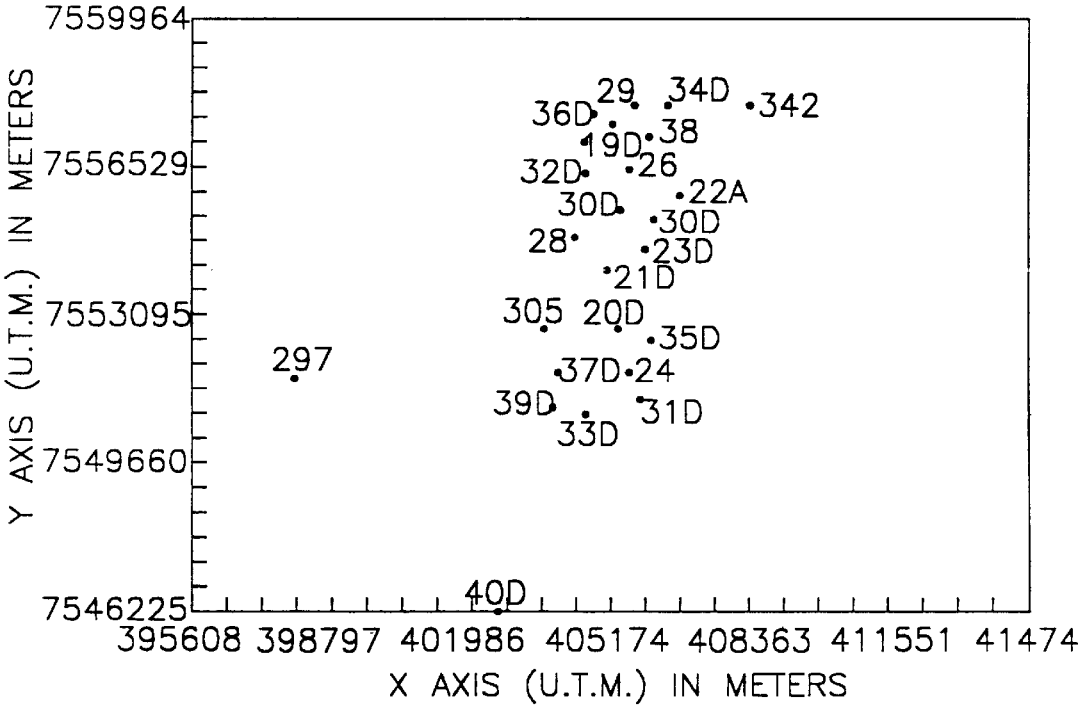
Figure 45:
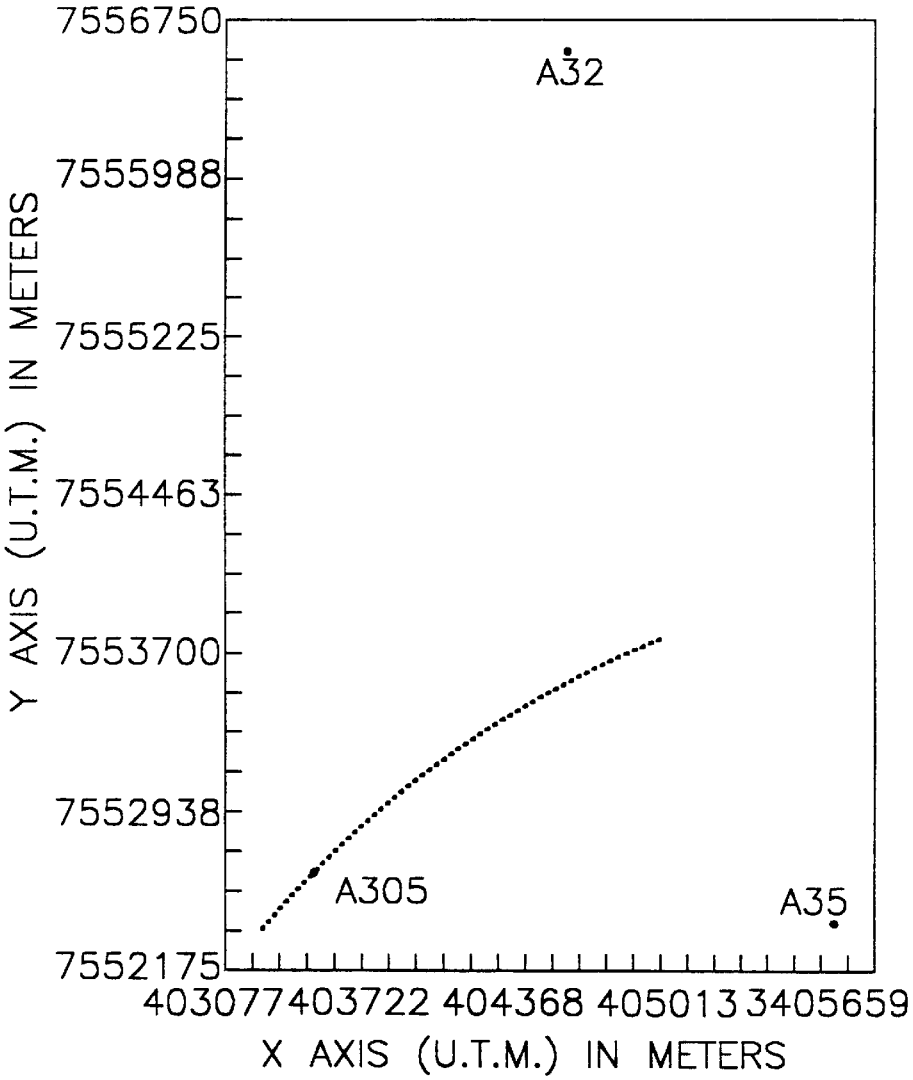

The FIG. 40 and 41 illustrate the distances and the angles among the wells C03 and C06 in the Captain oil field. Using the equations above, we obtain an angle, $\alpha$=1.139996. This distributions listed in FIG. 40 find the geographic place of the producing well C17. The FIG. 42 and 43 determine a distribution of points that equals the geographical place of producing well C12s. The values can be employed to determine an angle $\alpha$=1.139984.

Albacora Oil Field Brazil

FIGS. 44–50 illustrate how the present invention is employed in the Albacora field in the Campos's basin in Brazil in the south Hemisphere. The field includes 25 producing wells and is shown in the FIG. 44.

Figure 47:
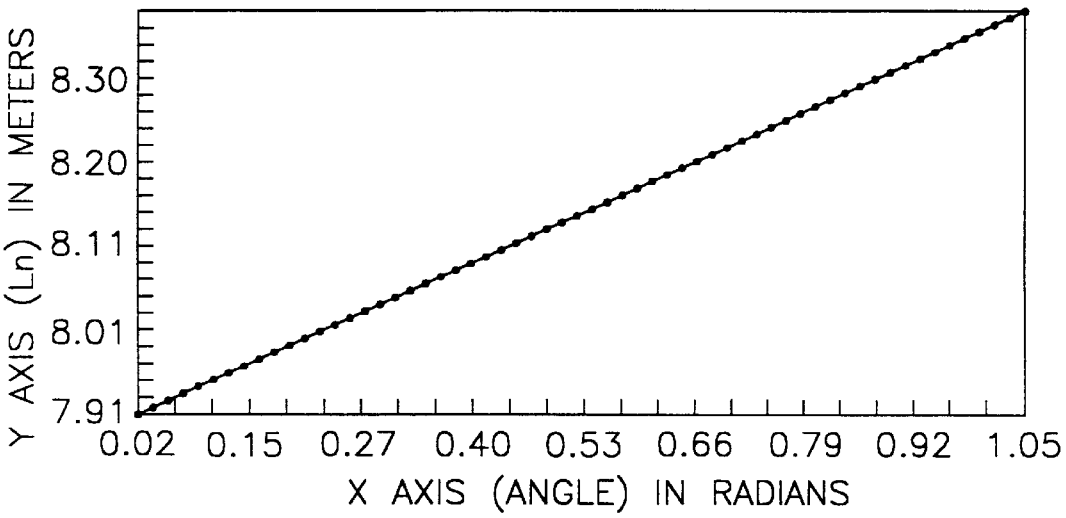
Figure 48:
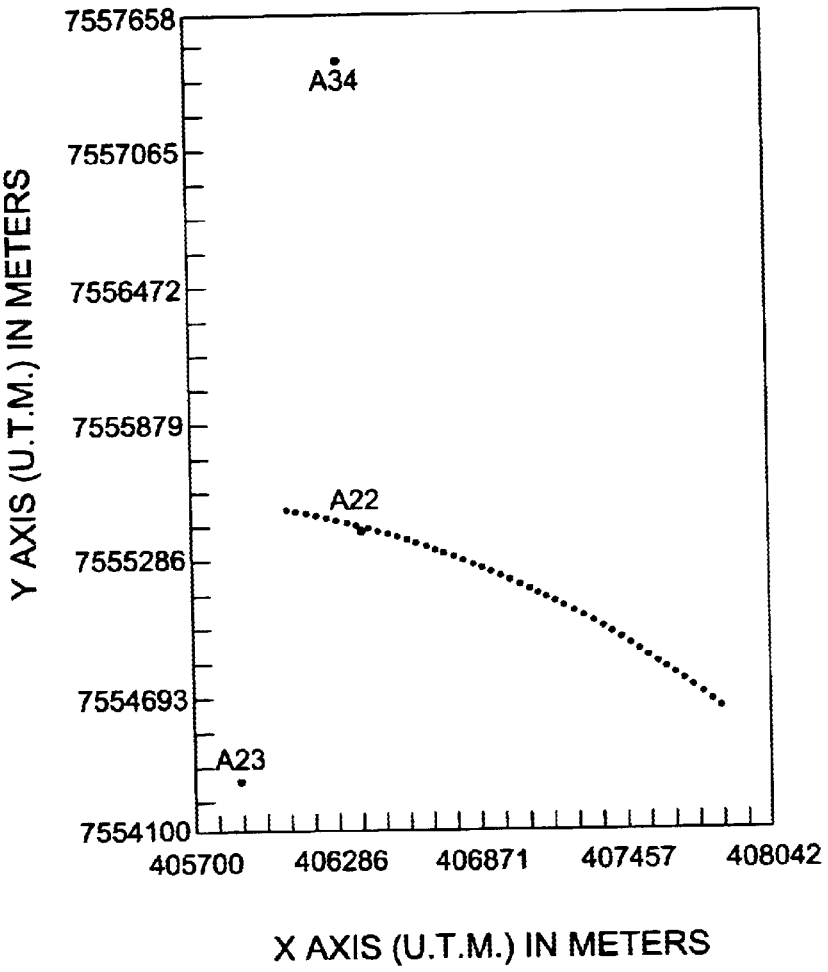
Figure 50:
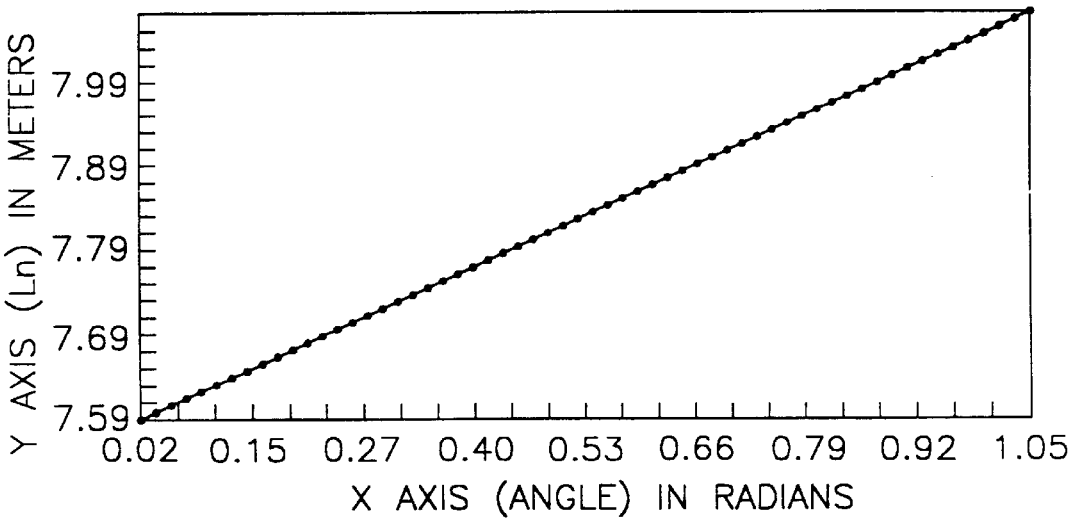

Again, the method is carried out by selecting producing wells A35 and A32 with coordinates (405975,7552375) and (404700,7556550) respectively. Next, using Equation 1, the distance of 4365 meters is computed between the points. Thereafter, a distribution of 60 points is determined by way of Equations 2,3 and 2. Point 51 (again, 1 represents the point nearest the line among the wells A35 and A32) has coordinates (403488,7552675). This point finds the geographic location of producing well A305 with a discrepancy or error of 20 meters. The trap slice distribution is determined with the angles and growing distances of the table in FIG. 46. These values can be adjusted to a direct half logarithm obtaining an angle, $\alpha$=1.139961 radians. This is illustrated in FIG. 47.

Selecting the producing well A34 with coordinates (406348,7557458) and the producing well A23 with coordinates (405900,7554300) a distance is calculated among these of 3189 meters by way of Equation 1. Next, a distribution of 60 points is built with the Equations 2,3 and 2. Here, point number 3 (again, with 1 representing the point nearest the line among the wells A34 and A23) with coordinates UTM (406409,7555440) finds the geographical place of producing well A22 with coordinates (406420, 7555406). The well is located with a geographical discrepancy of 35 meters. This distribution is determined with the angles and growing distances of the chart of the FIG. 49 and these are adjusted to a direct half logarithm obtaining an angle $\alpha$=1.139998 radians like it is shown in the FIG. 50.

Mecoacan Oil Field Mexico

Figure 51:
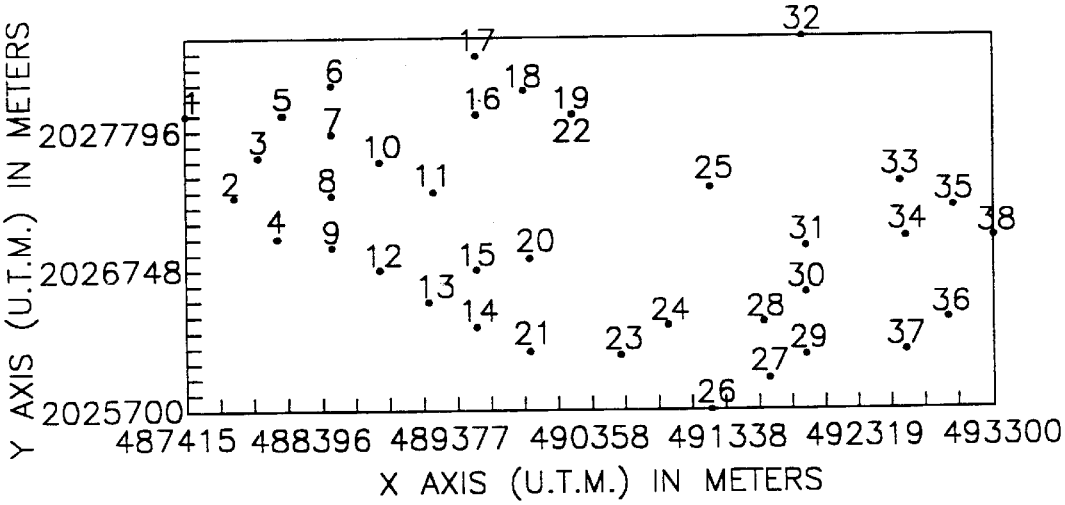
Figure 52:
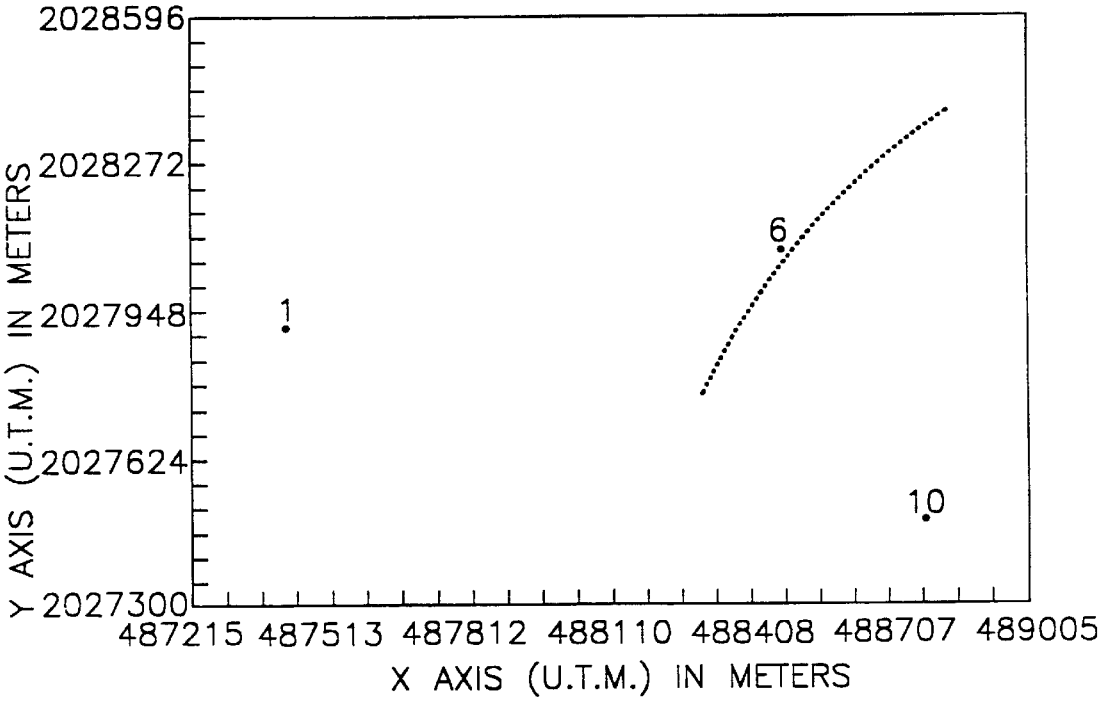
Figure 54:
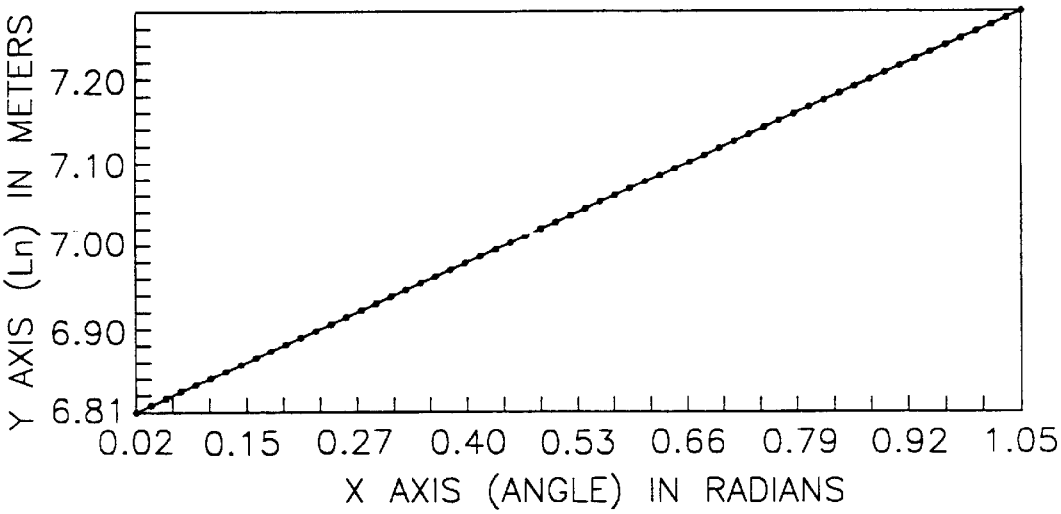

Next, the present invention is demonstrated on the Mecoacan oil filed in the Comalcalco basin of Mexico. This field has 38 producing wells, the distribution of which is shown in FIG. 51. In accordance with the present invention, producing wells 1 and 10 (with coordinates (487415, 2027915) and (488805,2027915) respectively) are selected. The distance between the well is then calculated with Equation 1, this distance being 1450 meters. Thereafter, a trap slice distribution of 60 points is built with the Equations 2,3 and 2. This trap slice this finds the geographic location of a producing well near point 6 with coordinates (488465, 2028100). The trap slice distribution is determined with the angles and growing distances detailed in the chart of FIG. 53. When these values are adjusted to a direct half logarithm one obtains an angle $\alpha$=1.139959 radians. This is demonstrated by FIG. 54.

Figure 57:
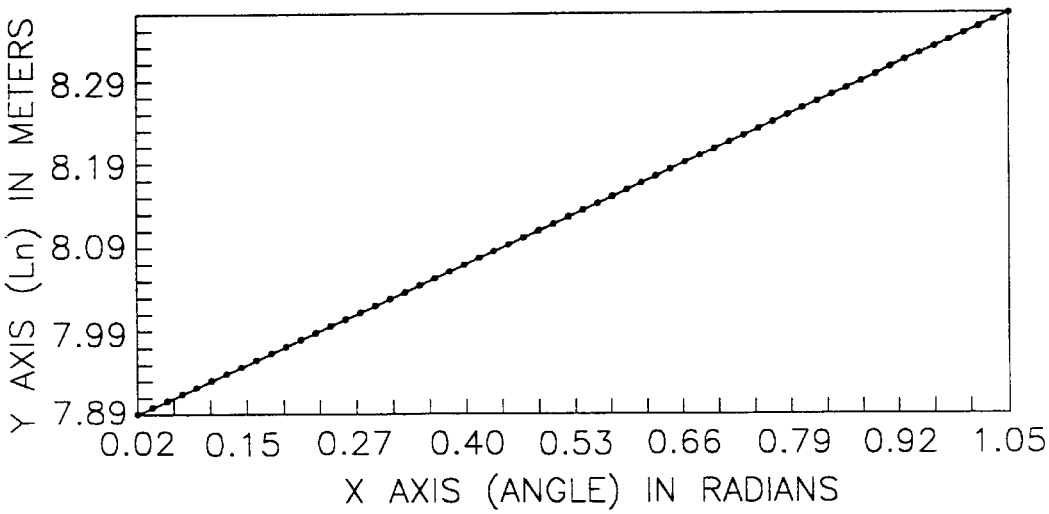
Figure 58:
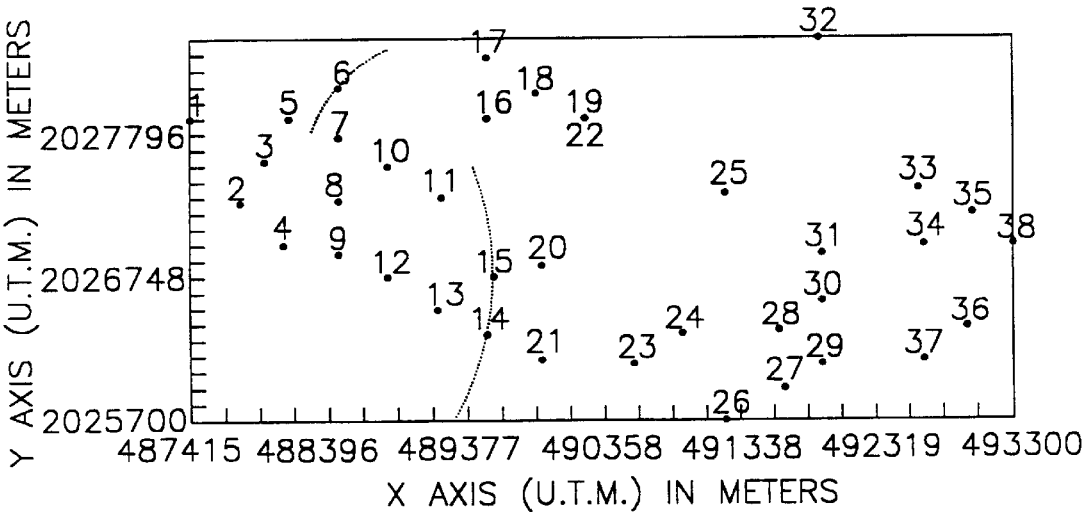

In the next example, the distance among producing wells 2 and 32 in the Mecoacan field (with coordinates (487775, 2027300) and (491905,2028495) respectively) is determined by way of Equation 1. This value is calculated to be 4299 meters. FIG. 55 illustrates the distance between these two wells. Again, a distribution of 60 points is built with Equations 2,3 and 2. This distribution finds points 14 and 25 (again, with point 1 being the point nearest the line among the wells 2 and 32). These points find the location of producing wells. More specifically, points 15 and 14, differ by 24 and 14 meters respectively from the location of producing wells. These are the geographical differences among the coordinates of the point 14 (489518,2026721) and the producing well 15 (489500,2026705) and the point 25 (489513,2026721) and the producing well 14 (489500, 2026305). The FIG. 56 and 57 illustrate the data of the 60 distribution points, or trap slices, adjusted to a linear half logarithm, to obtain an angle of $\alpha$=1.139988 radians. The FIG. 58 illustrates the two point distributions in the Mecoacan field.

Izozog Oil Field Argentina

Figure 59:
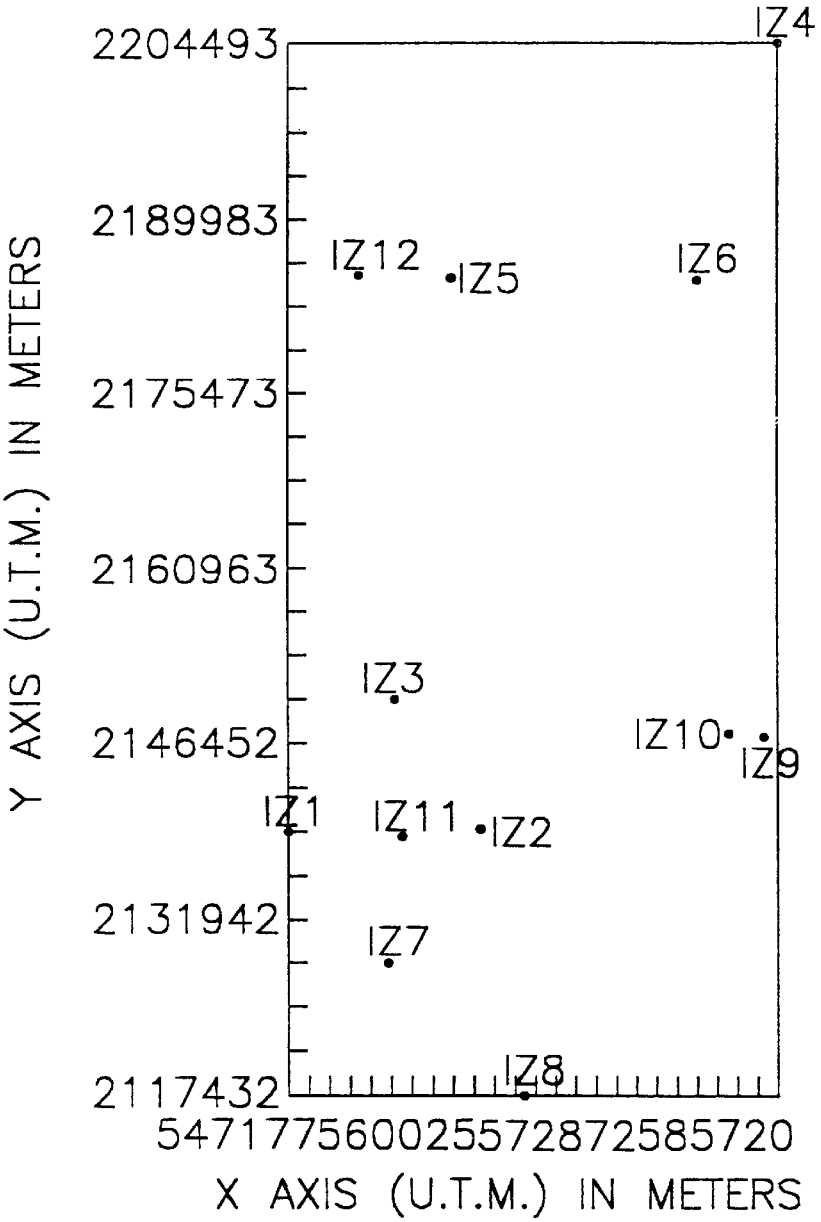
Figure 60:
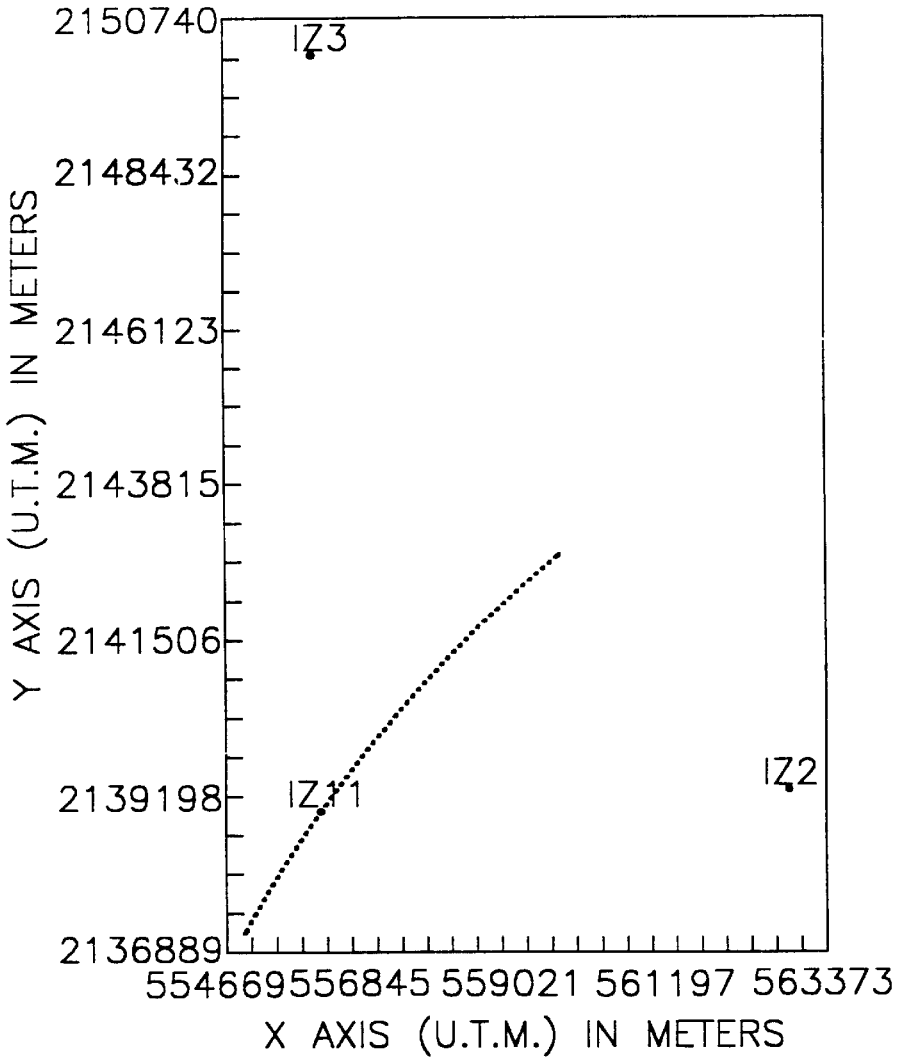
Figure 62:
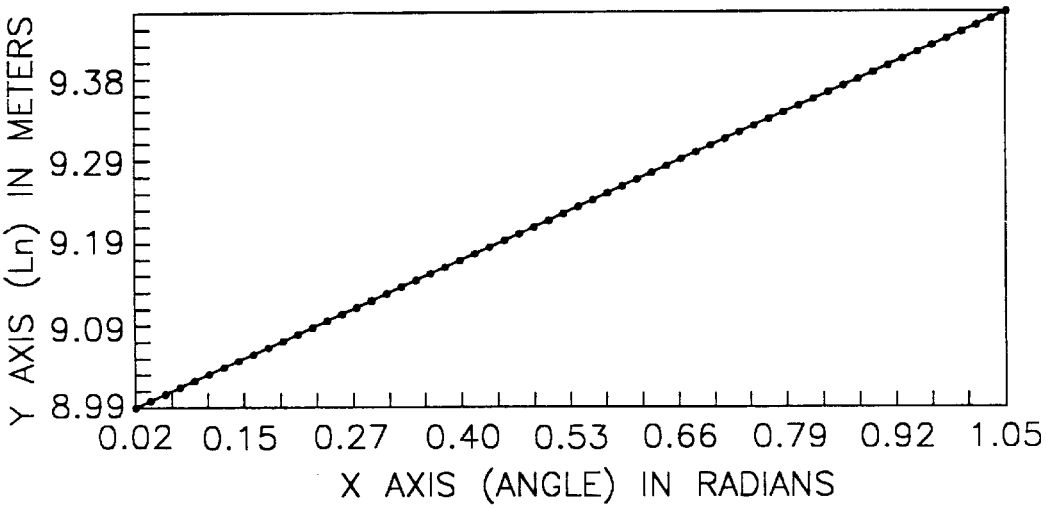

Next, the present method is carried out in the Izozog oil field in Argentina. This field has 12 producing wells and is shown in FIG. 59. Here, producing wells IZ3 with coordinates (555954,2150240) and IZ2 with coordinates (562873, 2139382) are selected. Equation 1 is then employed to obtain a distance of 12875 meters among these. Then, Equations 2,3 and 2, are used to build a distribution of 60 points. Among these points, number 42 (again, with point 1 being the point nearest the line among the wells IZ3 and IZ2) with UTM coordinates (555991,2139095) finds the geographical place of producing well IZ11 with coordinates (556018,2139083). The difference between point 42 and IZ11 is only 29 meters. This is observed in FIG. 60. FIGS. 61 and 62 illustrate the angles and growing distances that determine the distribution depicted in FIG. 60. Again, these values can be used to obtain by adjustment half logarithm an angle $\alpha$=1.140025 radians.

Figure 63:
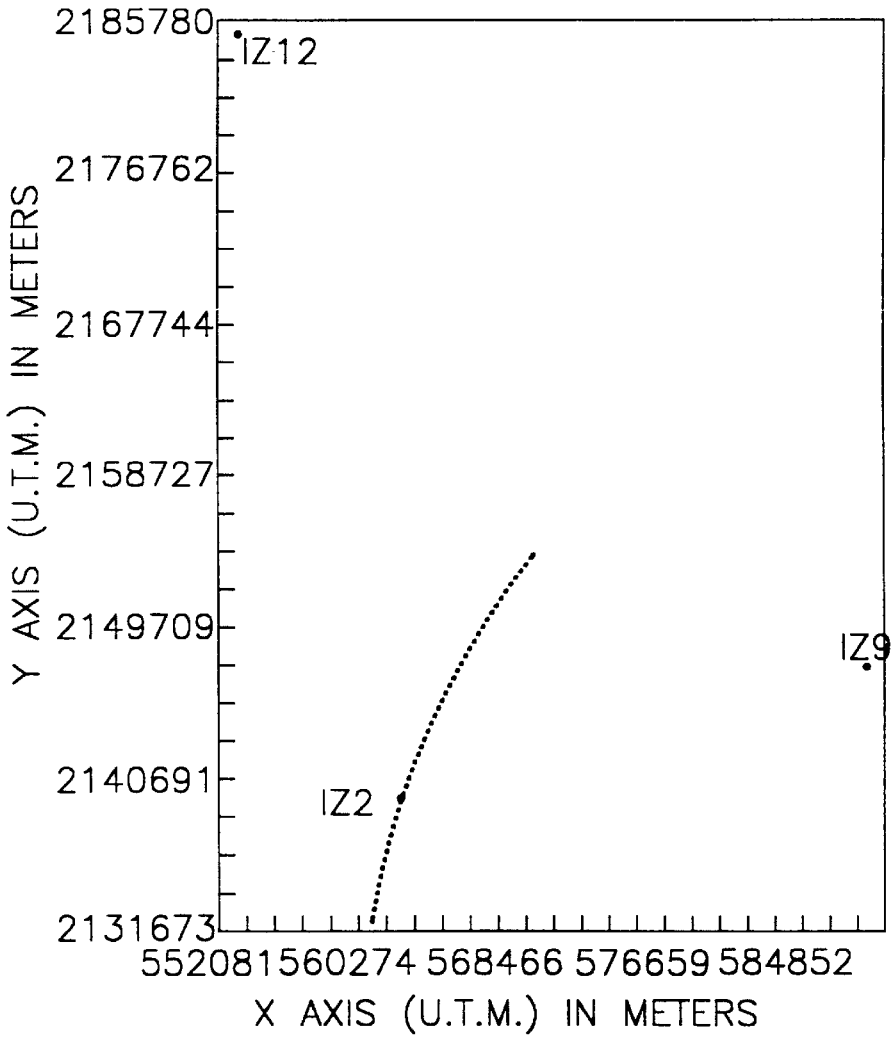
Figure 65:
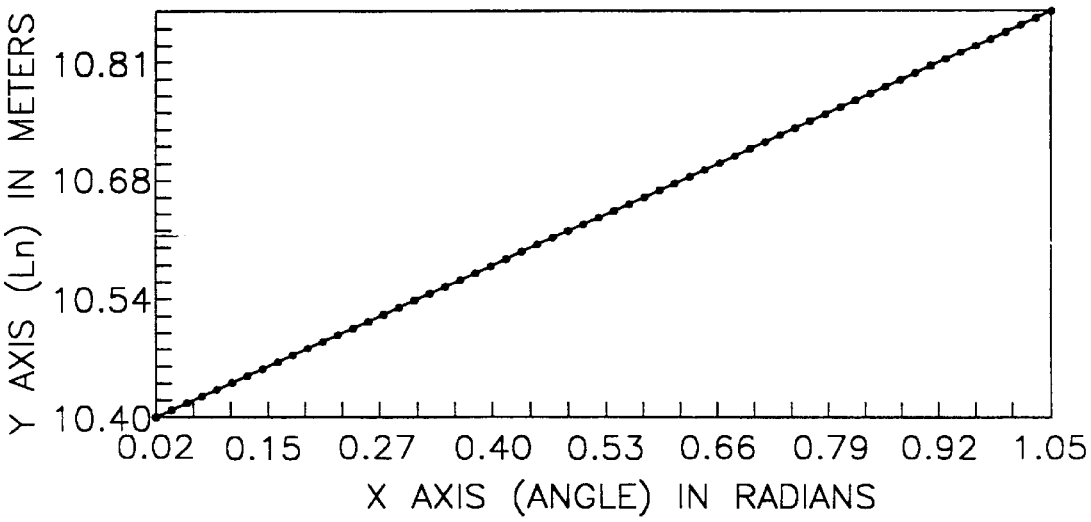

Finally, producing wells IZ12 an d IZ9 with coordinates (553081,2184780) and (590406,2147490) respectively, are selected. The distance between them is determined to be 52760 meters. Equations 2,3 and 2, ate then used to build a distribution of 60 points. Among these point 44 (again, with point 1 being the point nearest the line among the wells IZ12 and IZ9) with coordinates (562883,2139420) IZ2 coincides with the geographic location of a producing well with coordinated (562873,2139382). The difference between the point and the producing well is 39 meters. This can be observed in FIG. 63. Also the FIG. 64 and 65 illustrate the growing distances and angles that determine this distribution. This data can be used to obtain with an adjustment half logarithm an angle of $\alpha$=1.1400048 radians.

Figure 66:
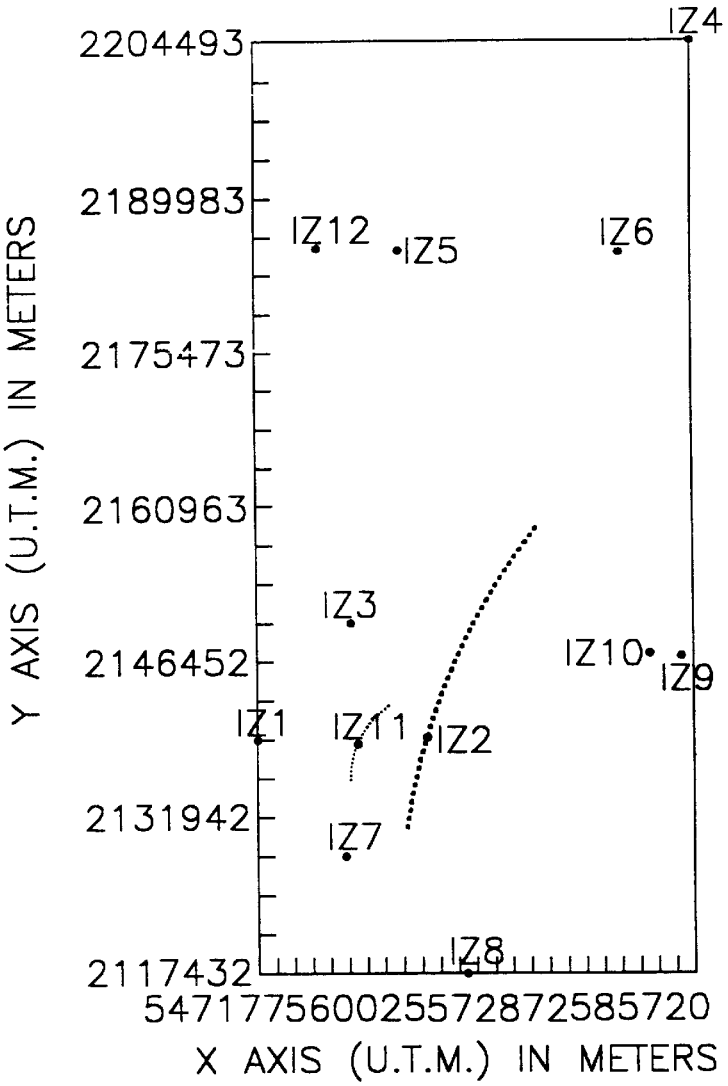

The FIG. 66 illustrates both distributions or trap slices to scale in the Izozog field. In summary, the Charts of FIG. 67 and 68 affirm that the angle α in the Equation 3, has a practically constant value of approximately, 1.139990 radians. Additionally, this value can be used to build the distributions of points that find the geographic locations of the conditions of trap producers of oil or gas in any Oil Field. It has also been demonstrated that the use of the Equation 3 with the constant value of α=1.139959 radians is invariable before any separation of two producing wells.

Gullfaks Oil Field Norway

Figure 69:
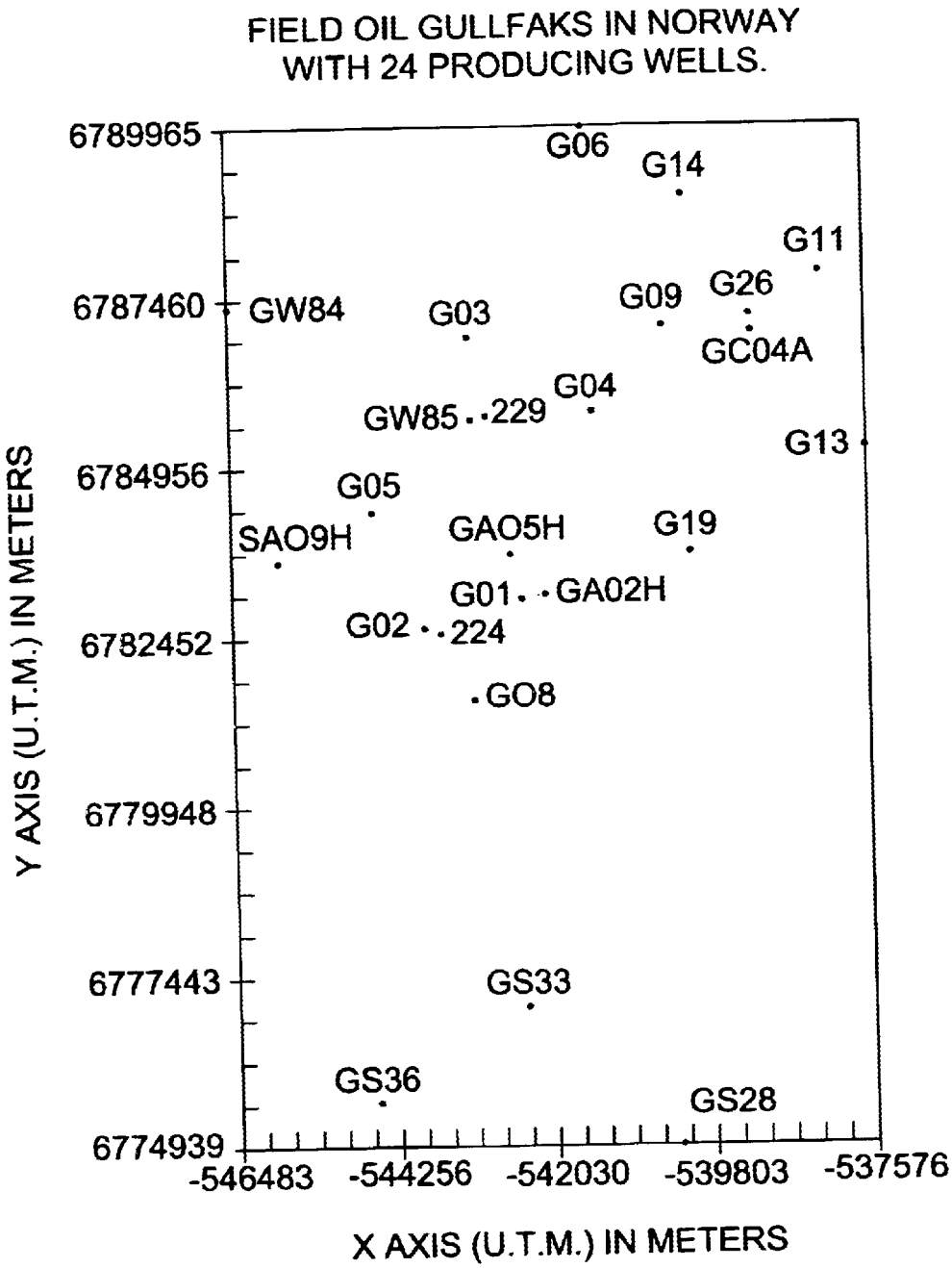

FIGS. 69–92 illustrate how the present invention is carried out in the Gullfaks oil field in the Viking Basin Of Norway. FIG. 69 illustrates the distribution of 24 producing wells in the Gullfaks field.

In general, for any couple of wells in the Gullfaks field, Equations 2,3 and 2 can be used to build four distributions of points or trap slices. These distributions are symmetrical at the line among the two selected producing wells. This is observed in FIG. 70 with points in the direction north to south west of all couple of wells. Additionally, FIGS. 71,72,73,74,75,76 and 77 illustrate trap slices with directions north to south west, north to south east, north to south east, south to north west, south to north west, south to north east, and south to north east, respectively. Also these FIG. 70,71,72,73,74,75,76,77 illustrate that distributions of points of different sizes, directions and with different number points, find the geographic place of most of the producing wells, or all the wells.

Figure 70:
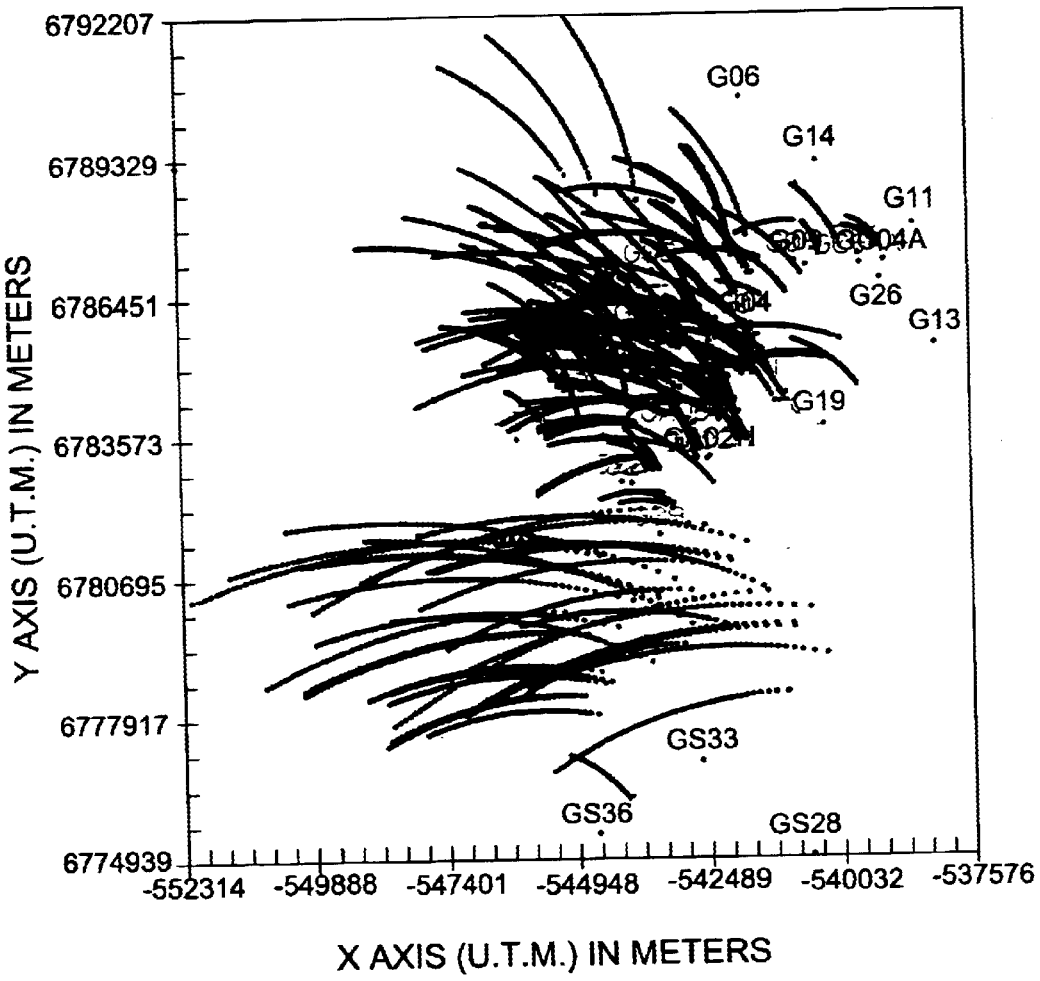
Figure 71:
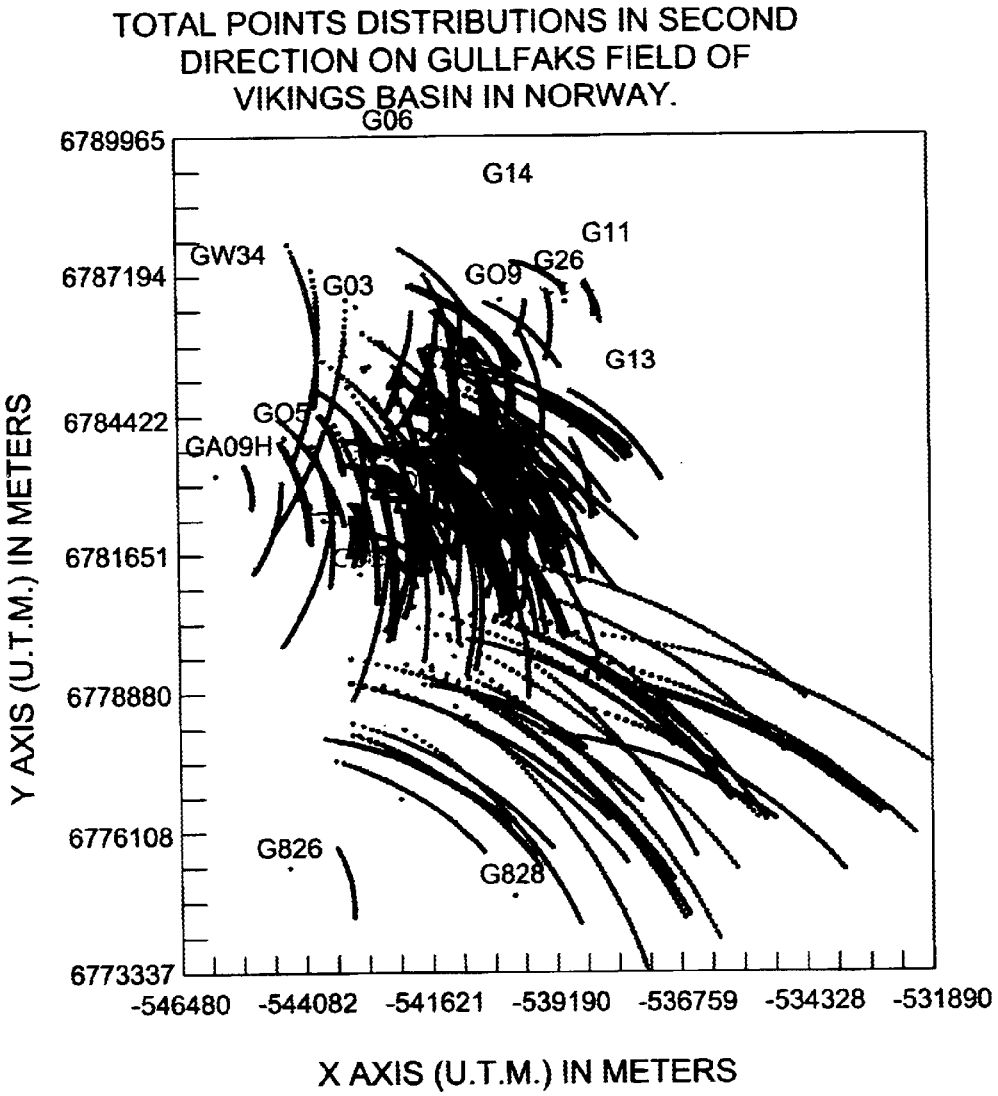
Figure 72:
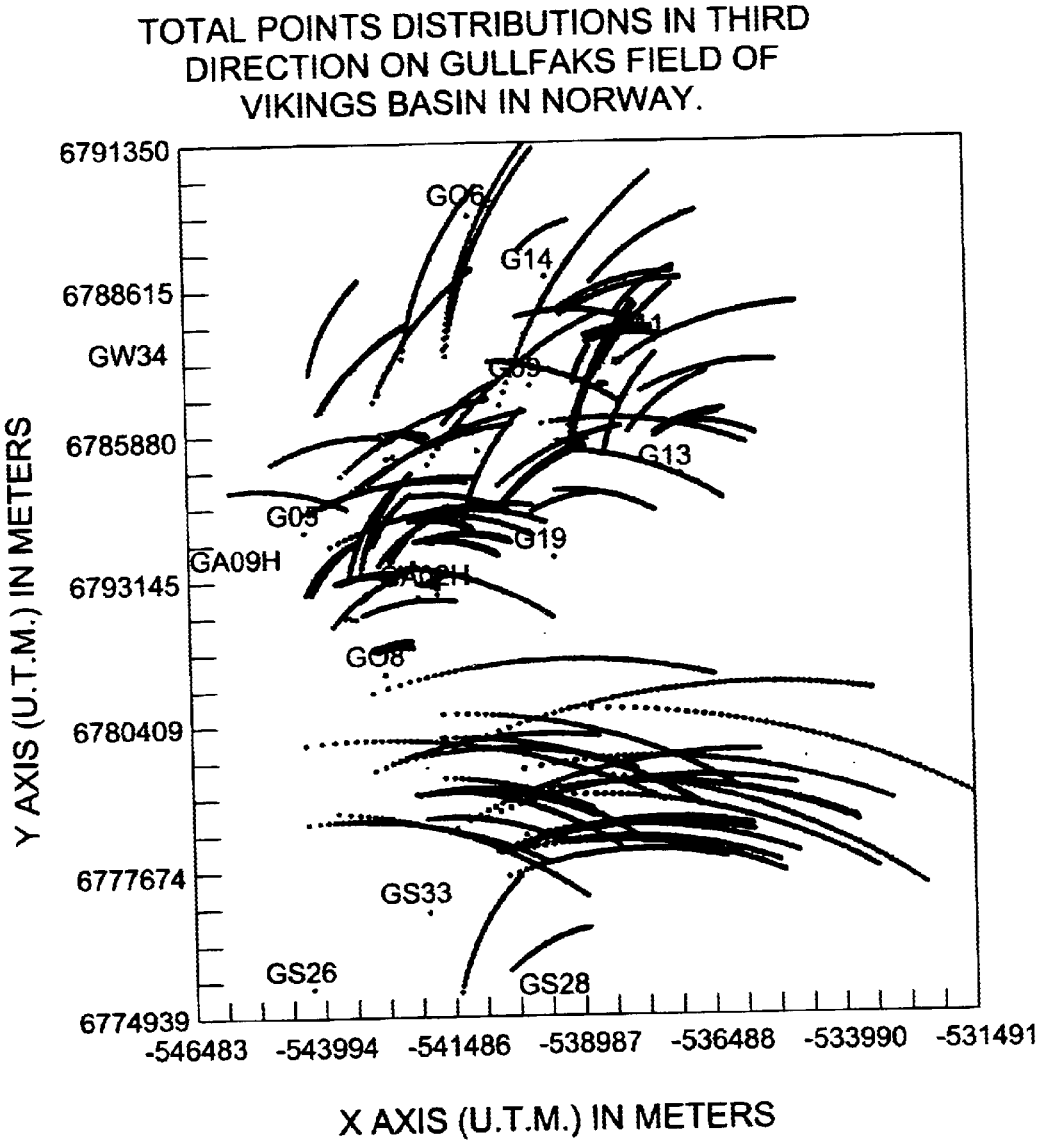
Figure 73:
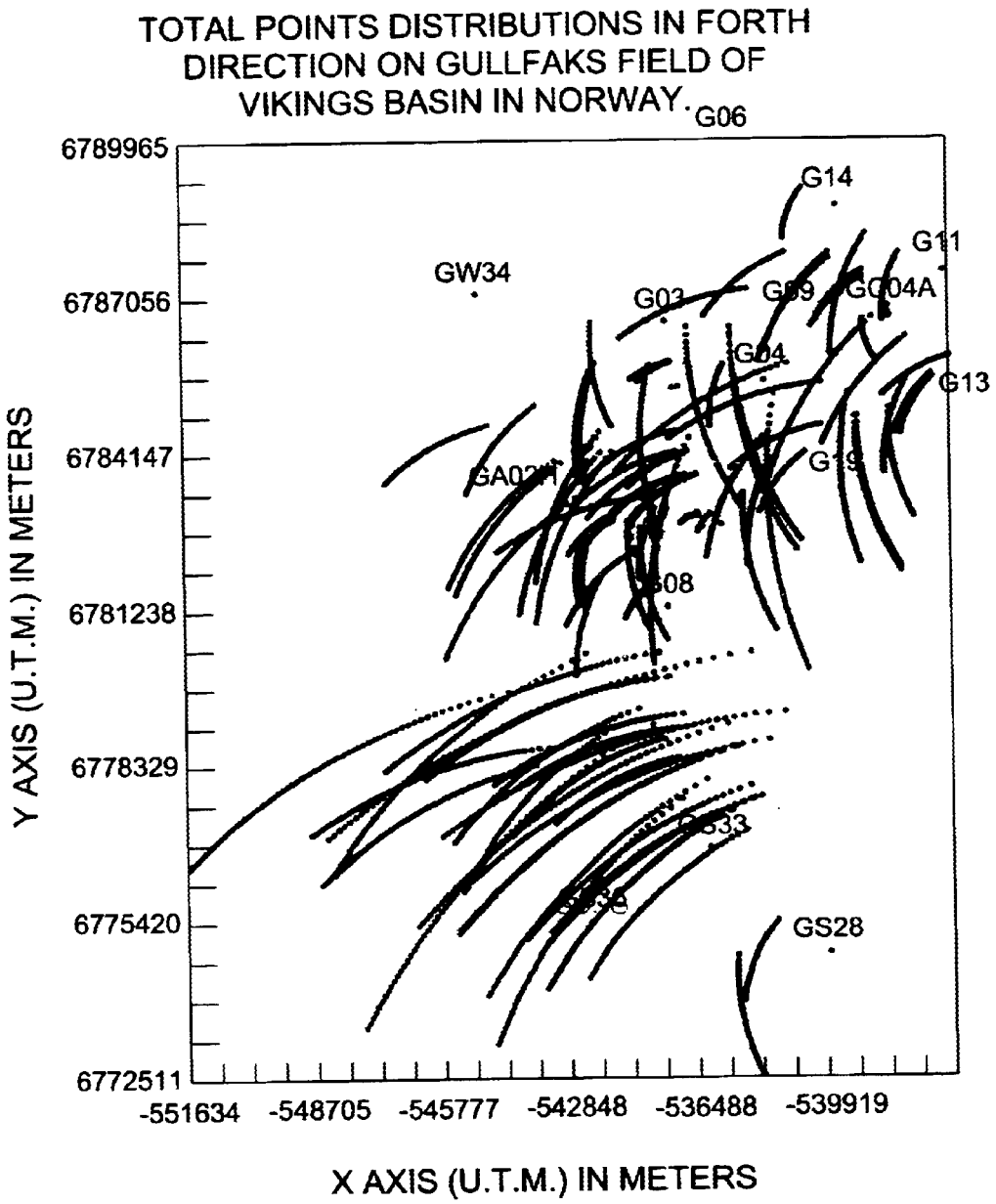
Figure 74:
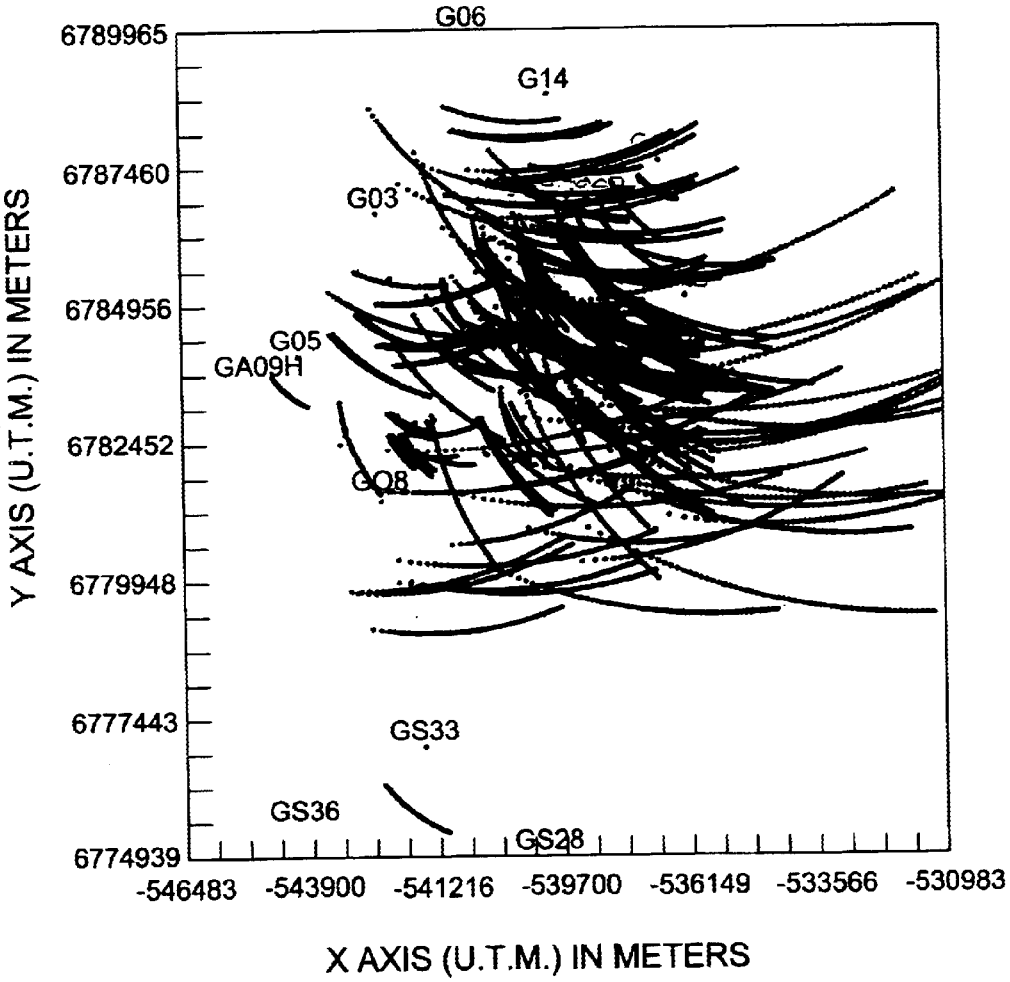
Figure 75:
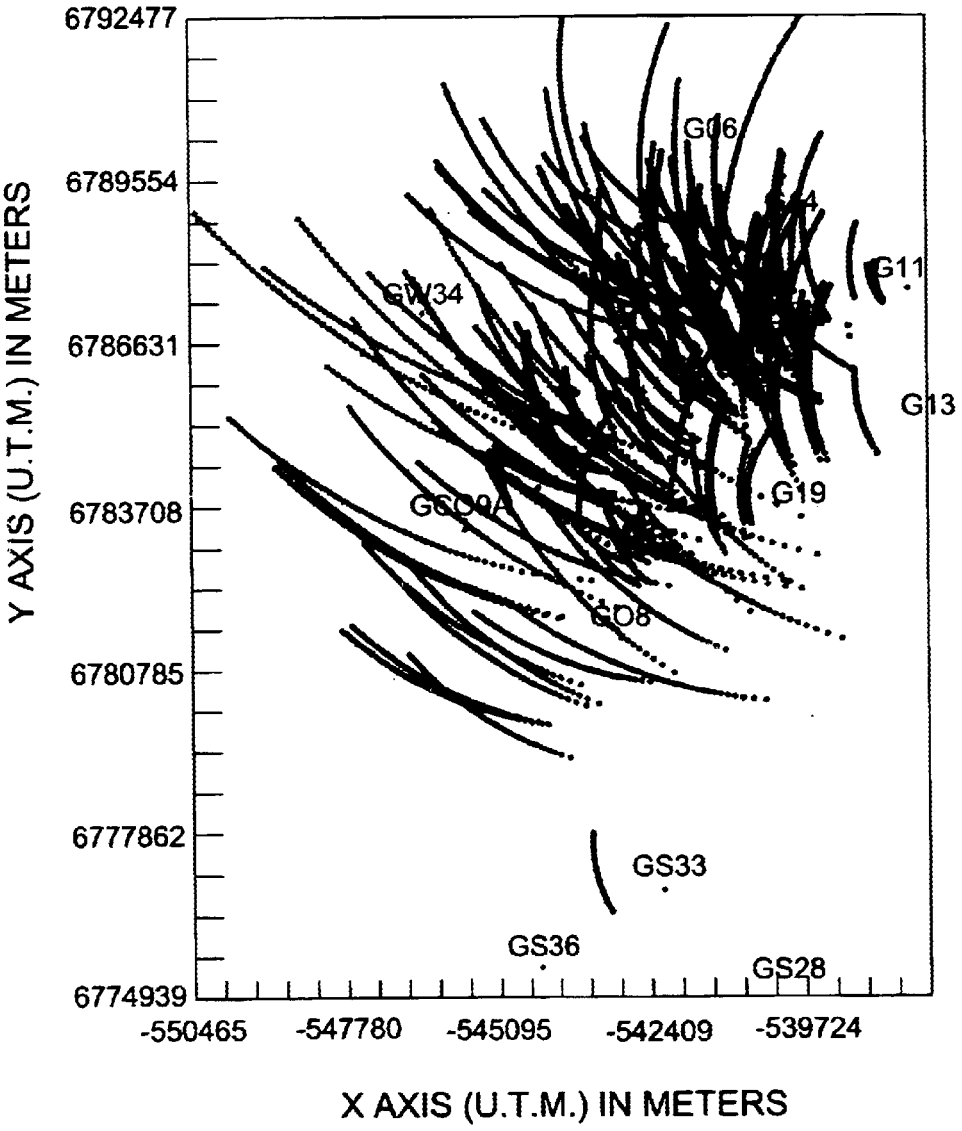
Figure 76:
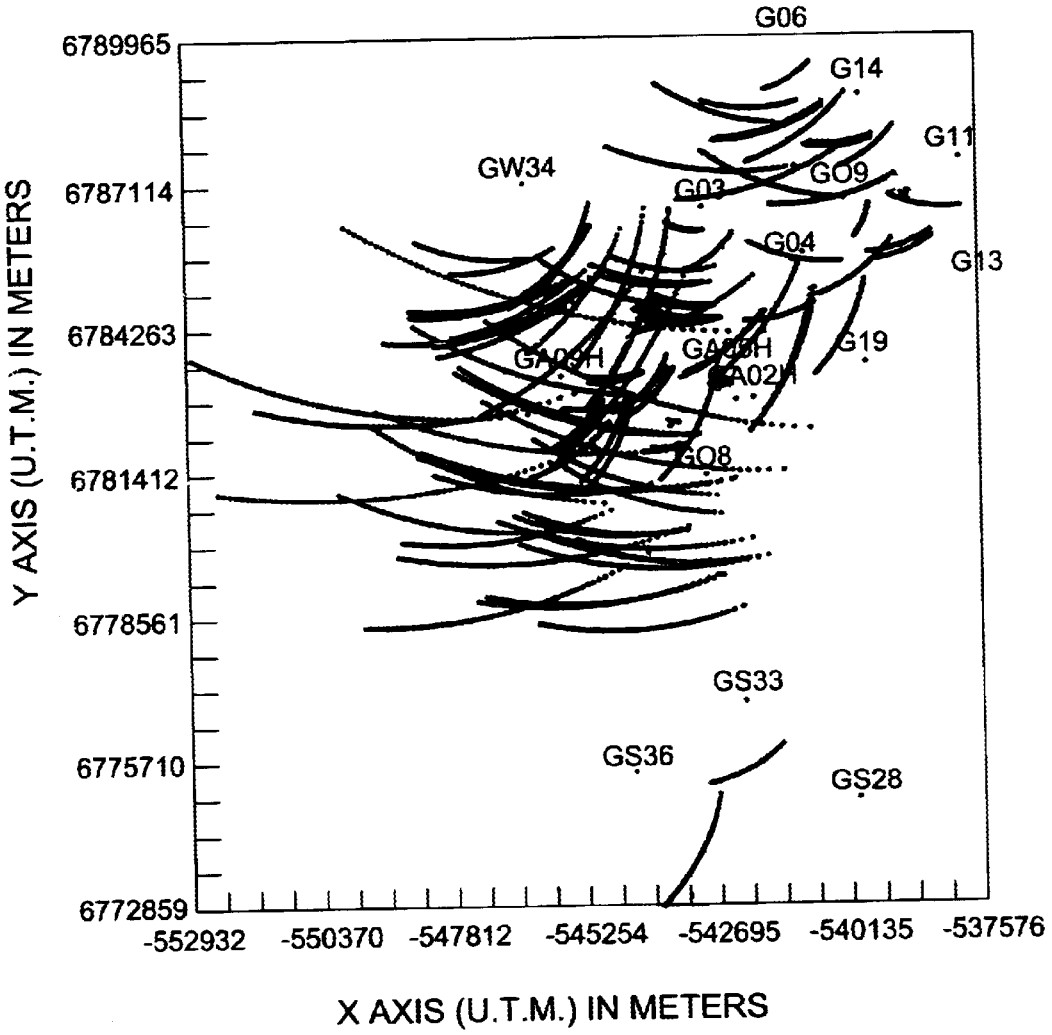
Figure 77:
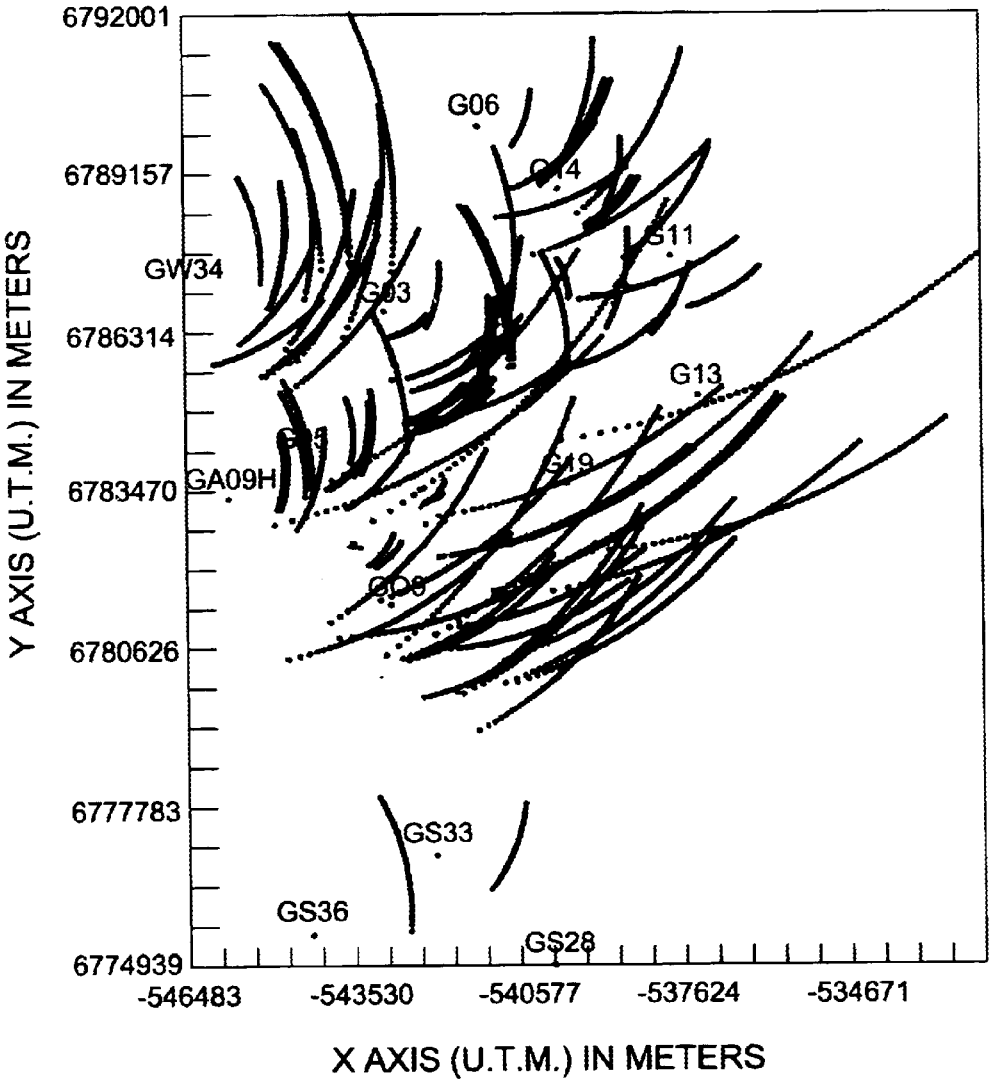

For example in FIG. 70, the producing wells GW34, GWb29 and G25 are located by more than one distributions of 60 points. The total distributions in the Gullfaks field with 24 producing wells are 1104 distinct distributions. Each of these distributions and should possess trap conditions with the probability of being producers of oil or gas. So the geographical places where several distributions coincide will have a good probability of producing gas or oil.

Figure 78:
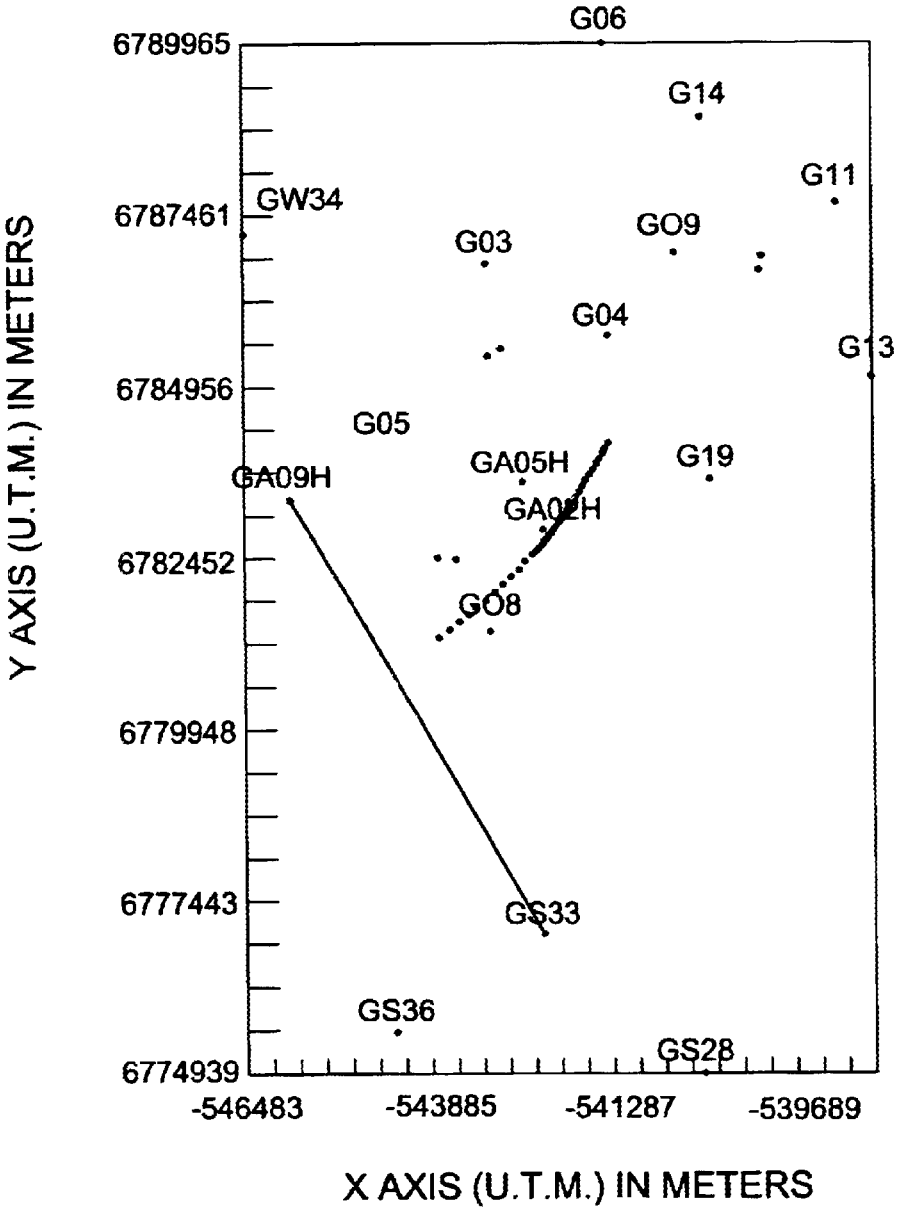

One particular case is the couple of producing wells GAO9H and GS33 with coordinates UTM (−545761, 6783339) and (−542243,6776895) respectively (indicated in the FIG. 78). The distance among these is measured using Equation 1, like one observes in the FIG. 78, obtaining 7341 meters between both wells. Thereafter, Equations 2,3 and 2, are used to build a distribution of points or a trap slice. Observing in FIG. 78 that point number 35 (again, with point 1 being the nearest point to the line among the wells GAO9H and GS33) with coordinates (−542074,6782901) one finds the geographic location of producing well GAO2H with coordinates (−542032,6782899). Only 42 meters separates point number 35 from the location of the producing well GAO2H.

Figure 79:
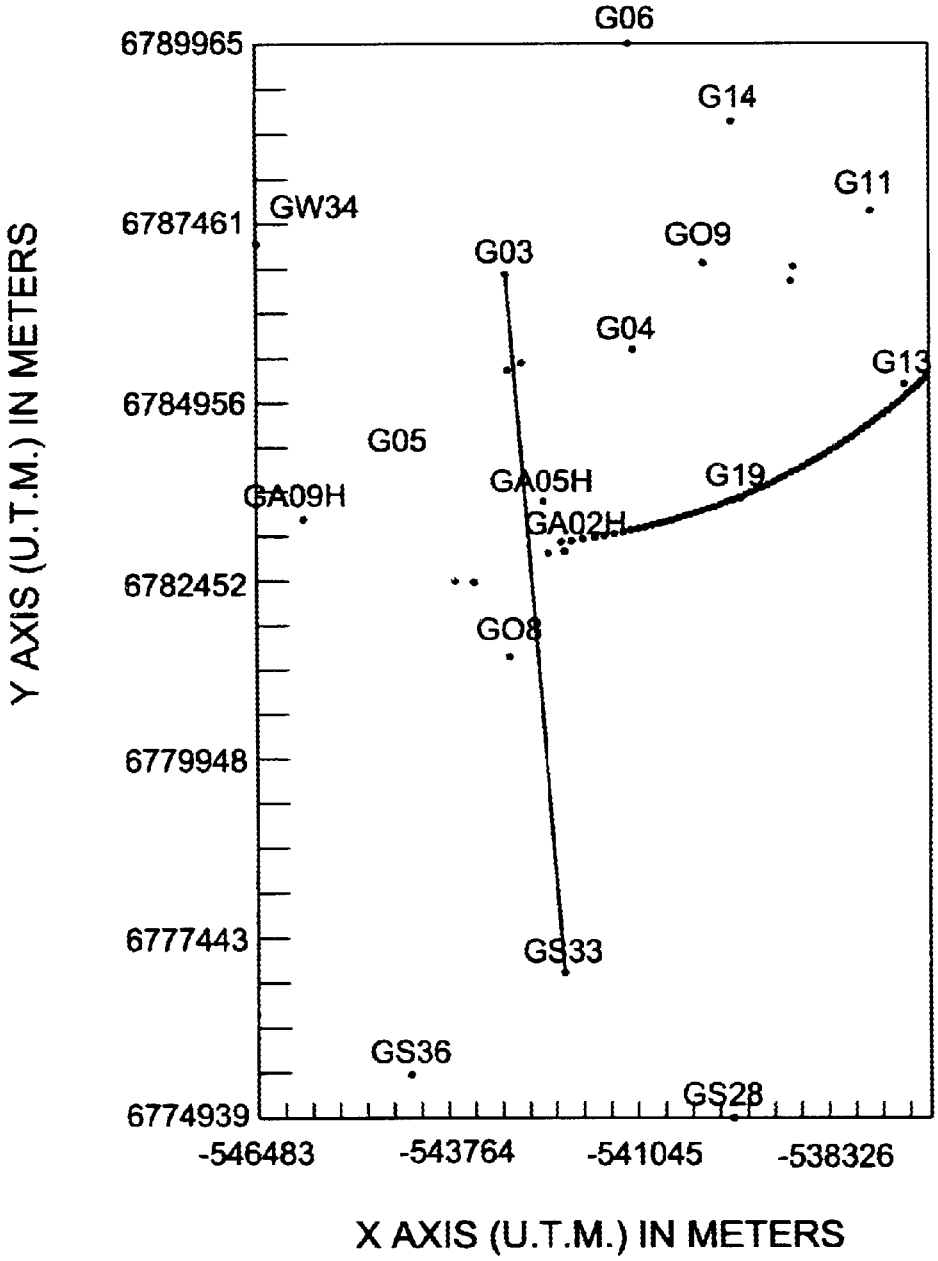

The FIG. 79 illustrates the producing wells G03 and GS33 with UTM coordinates (−543052,6786655) and (−542243, 6776895) respectively. The distance among these is determined by Equation 1, like one observes in FIG. 79, to obtain 9793 meters between both wells. Equations 2,3 and 2, are then used to determine a distribution of points or trap slice. Observing in FIG. 79 that the point number 20 of this distribution (again, with point 1 being nearest to the line among the wells G03 and GS33) with coordinated (−539895,6783602) one finds the geographic location of producing well G19 with coordinates (−539871,6783566). This distance between point number 20 and the producing well G19 is 43 meters. The distribution also finds well G13.

Figure 80:
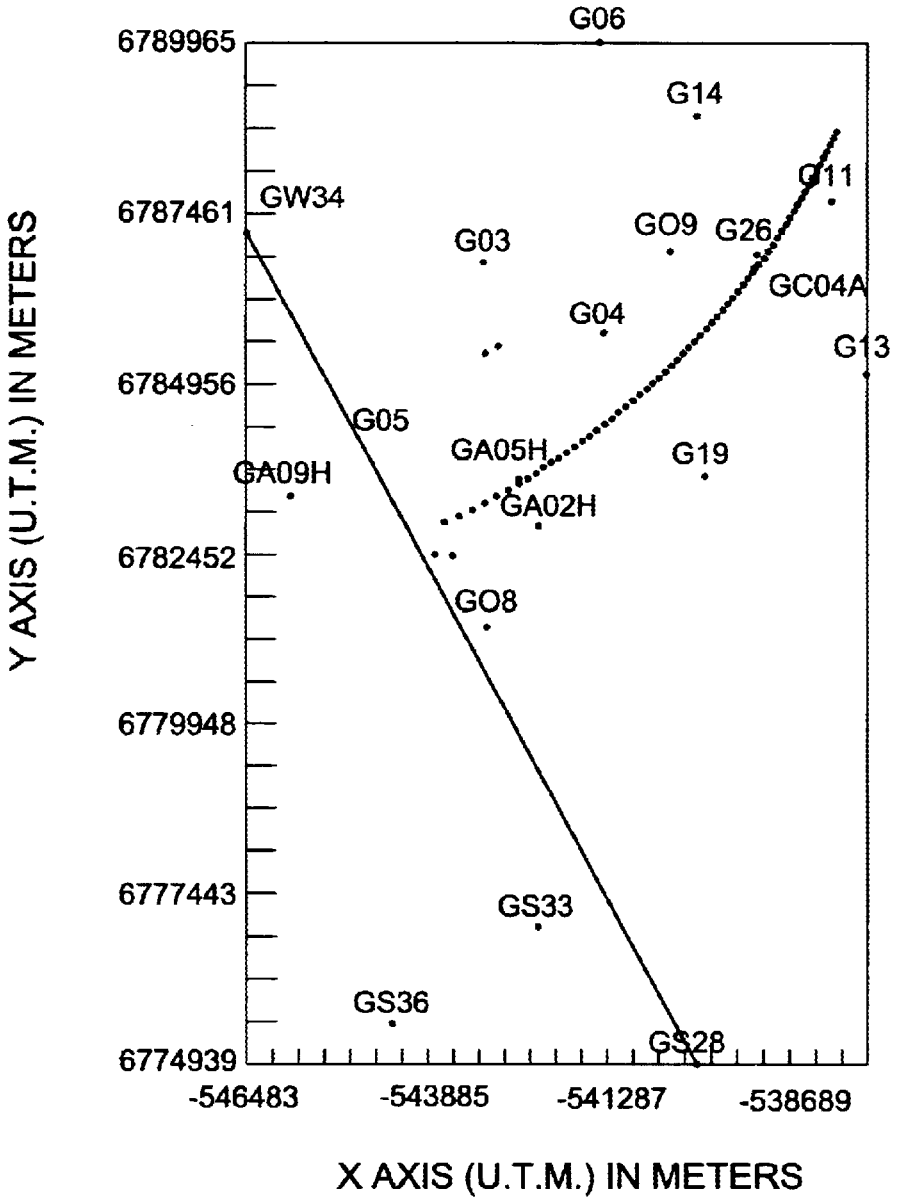
Figure 81:
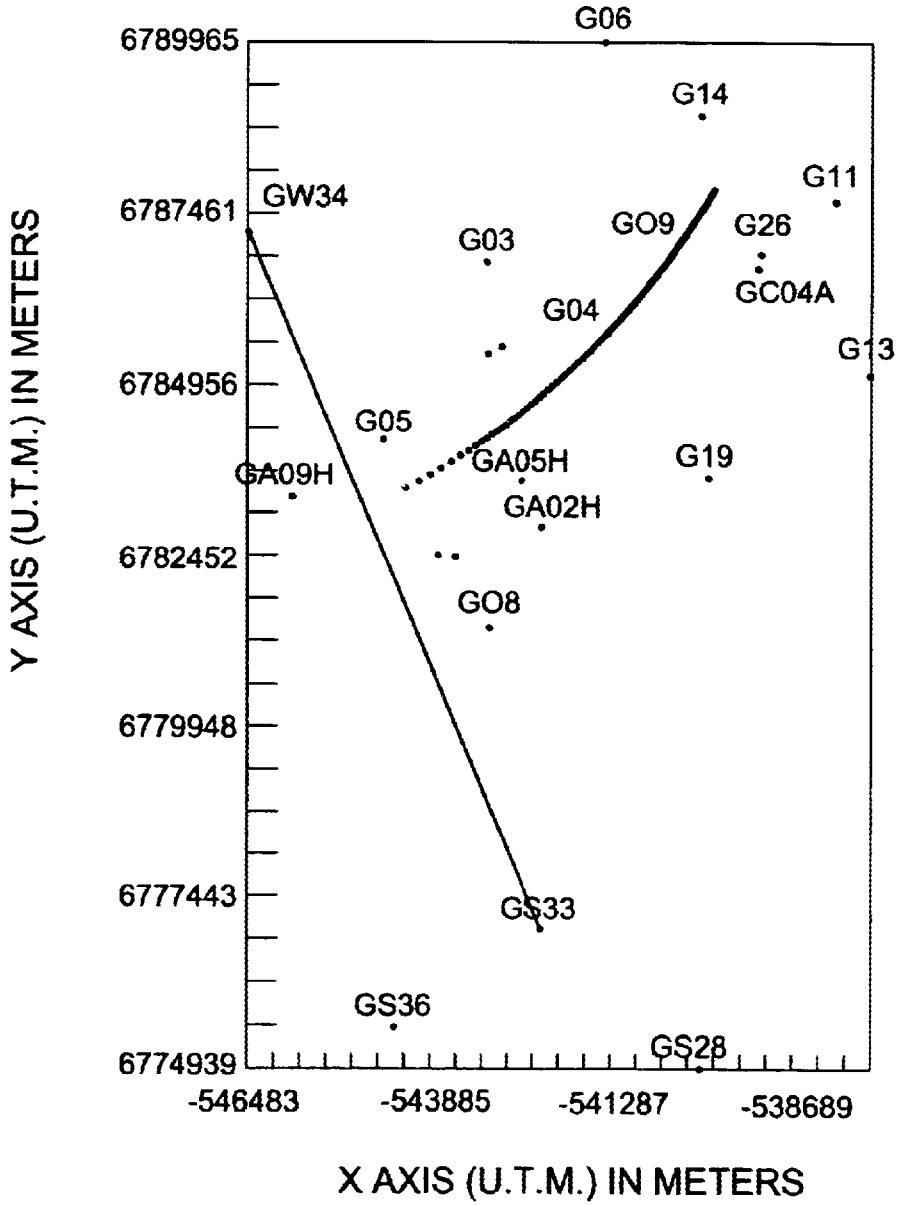

The FIG. 80 illustrates producing wells GW34 and GS28 with UTM coordinates (−546483,6787154) and (−540071, 6774939) respectively. This distance between these wells is determined by Equation 1 to obtain 13795 meters. Again, Equations 2,3 and 2, are employed to determine a distribution of points or trap slice. Observing in FIG. 80 that point number 43 of this distribution (again, with point 1 being the nearest point to the line among the wells GW34 and GS28) with coordinates (−539047,6786933) finds the geographic location of producing well G26 with coordinates (−539038, 6786931). The distance between the point 43 and well G26 is 9 meters. The FIG. 81 illustrates a special case where the distribution of points created by wells GW34 and GS33, finds the geographic location of two producing wells, G04 and G09. As such, the distances from G04 and G09 to anyone of the wells GW34 or GS33 are within a growing sequence.

Determining Cot α

Figure 81A:
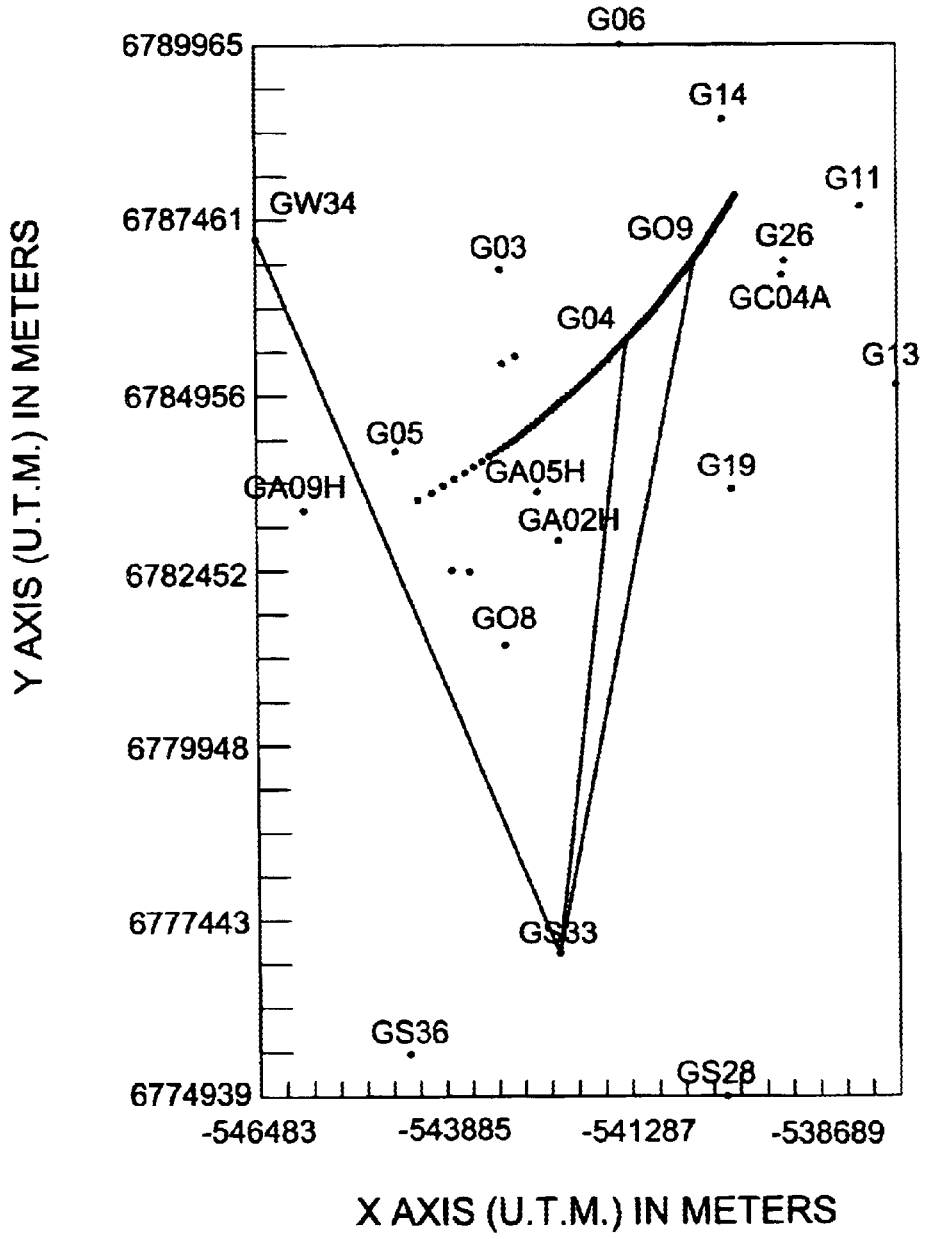
Figure 81B:
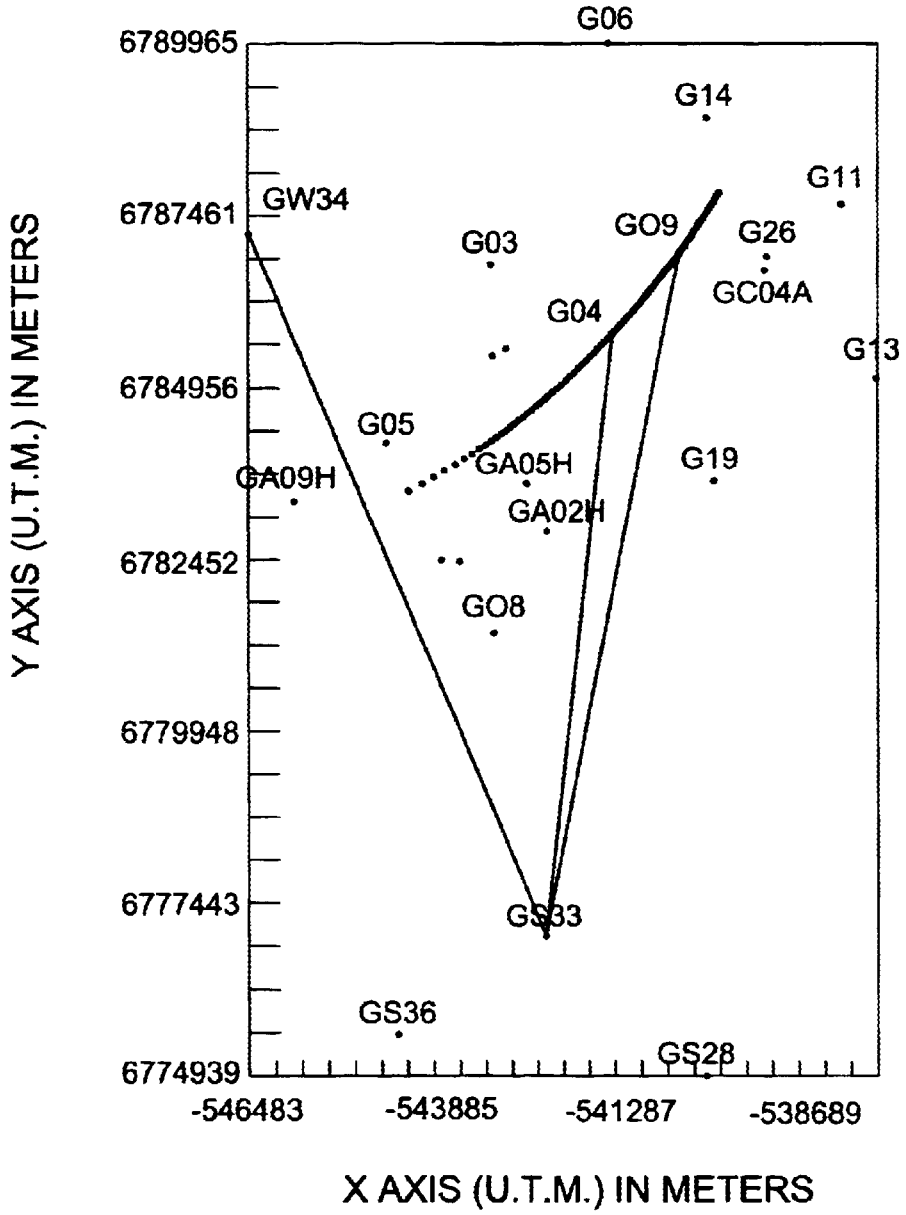

The cotangent of the angle α, of the Equation 3, again, can be determined in this experimental situation, with data from the Gullfaks field. For example, using producing wells GW34 and GS33 with coordinates (−546483,6787154) and (−542243,6776895) respectively, one can determine with Equation 1 the distance among these to be 11100 meters. Next, with Equation 2 a point A along the line between GW34 and GS33 is determined. Point A is determined to be a distance of 6860 meters from well GS33. Next, the UTM coordinates of point A, on the straight line among the producing wells GW34 and GS33, is determined. This point A, is a guide to observe producing wells near point A. These producing wells are found on a growing sequence of distances from the producing well GS33. For example, observing the producing wells G04 and G09 with coordinates (−541260,6785587) and (−540282,6786804) respectively. These are located geographically in a sequence of growing distances from the producing well GS33 (note FIG. 81A). The distance between the producing wells G04 and GS33 is 8747 meters and the distance between the producing wells G09 and GS33 is 10101 meters. Equation 3 produces growing distances as a function of the values of the angle θ. Thus, by measuring the angles among the distances of the wells G04-GS33, G09-GS33 and the distance among the wells GW34-GS33 (note FIG. 81B), we can obtain for the producing well G04 a value of θ of 31 grades and for the producing well G09 a value of θ of 48 grades. Therefore one has for the producing wells G04 and G09 a couple of values: angle-distance. These are determined to be (31,8747) and (48,10101) respectively.

Applying the natural logarithm to both sides of the Equation 3 one obtains:

$$Ln(A_n)=Ln(A)+\theta \cot \alpha Ln(e) \Rightarrow Ln(A_n)Ln(A)+\cot \alpha\theta \qquad \text{EQ. 4}$$

Where the Equation 4 is an equation lineal half logarithm that depends on the Angle θ in radians to produce the natural logarithm of the distances, but like one ignores the cotangent α, this will be calculated using the couples angle-distance, (31,8747) and (48,10101) of the wells producing G04 and G09 respectively, through the lineal regression:

$$slope = \frac{\sum \theta_i \mathrm{Ln}(A_i) - n\bar{\theta}\overline{\mathrm{Ln}}(A)}{\sum \theta_i^2 - n\bar{\theta}^2} \text{ and } \cap = \overline{\mathrm{Ln}}(A) \qquad \text{EQ. 5}$$

For the wells producing G04 and G09, the angles in grades are transformed into radians, and the natural logarithm is extracted at the distances, obtaining (0.5410,9.076466) and (0.83776,9.220389) respectively. Obtaining finally in a practical way the value of the angle $\alpha$=1.119176 radians, knowing that in the Equation 5 one has:

$$\tan\alpha = \frac{1}{slope} \Rightarrow \alpha = \text{Arctan}\alpha \qquad \text{EQ. 6}$$

Finally this value of the angle $\alpha$ is used under the function cot $\alpha$, as a fixed value in the Equation 3 and this will always be used given any distance between two wells producing of any oil field.

Figure 82:
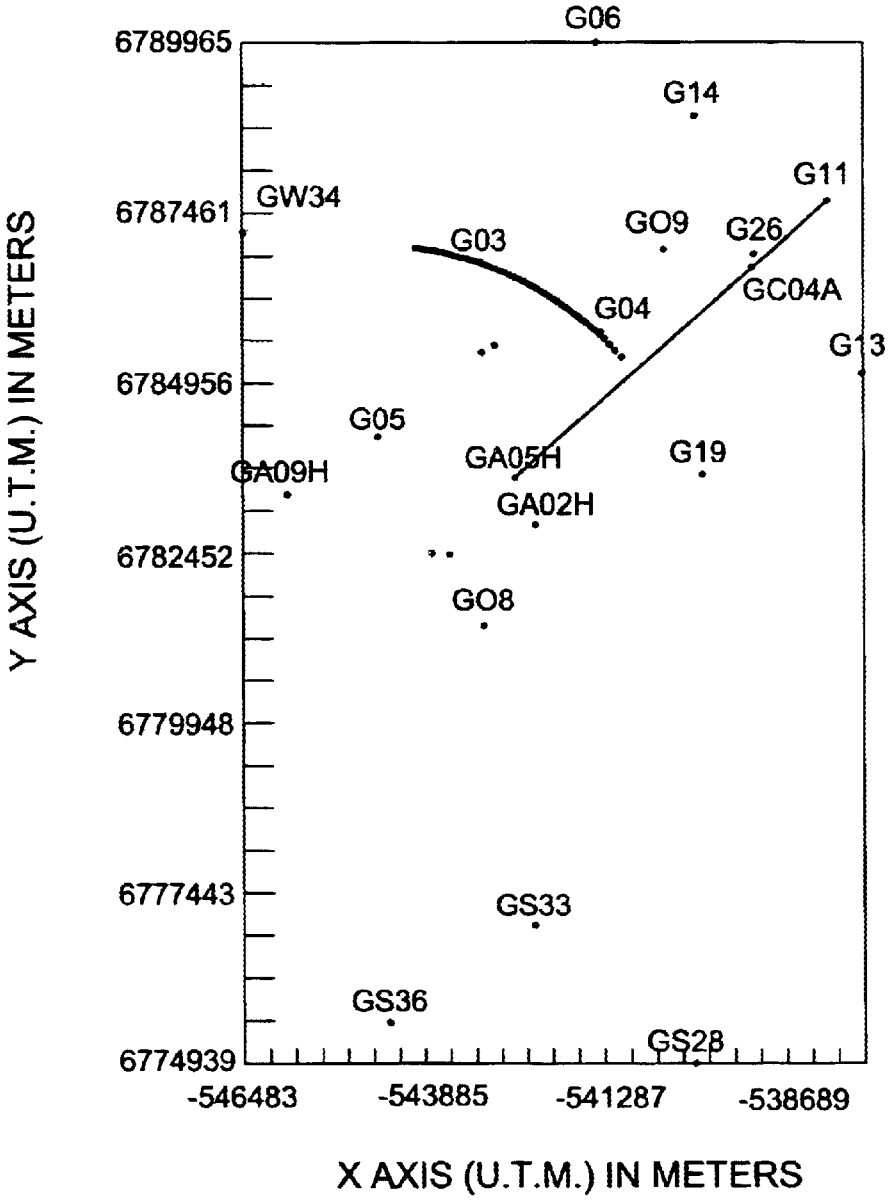
Figure 82A:
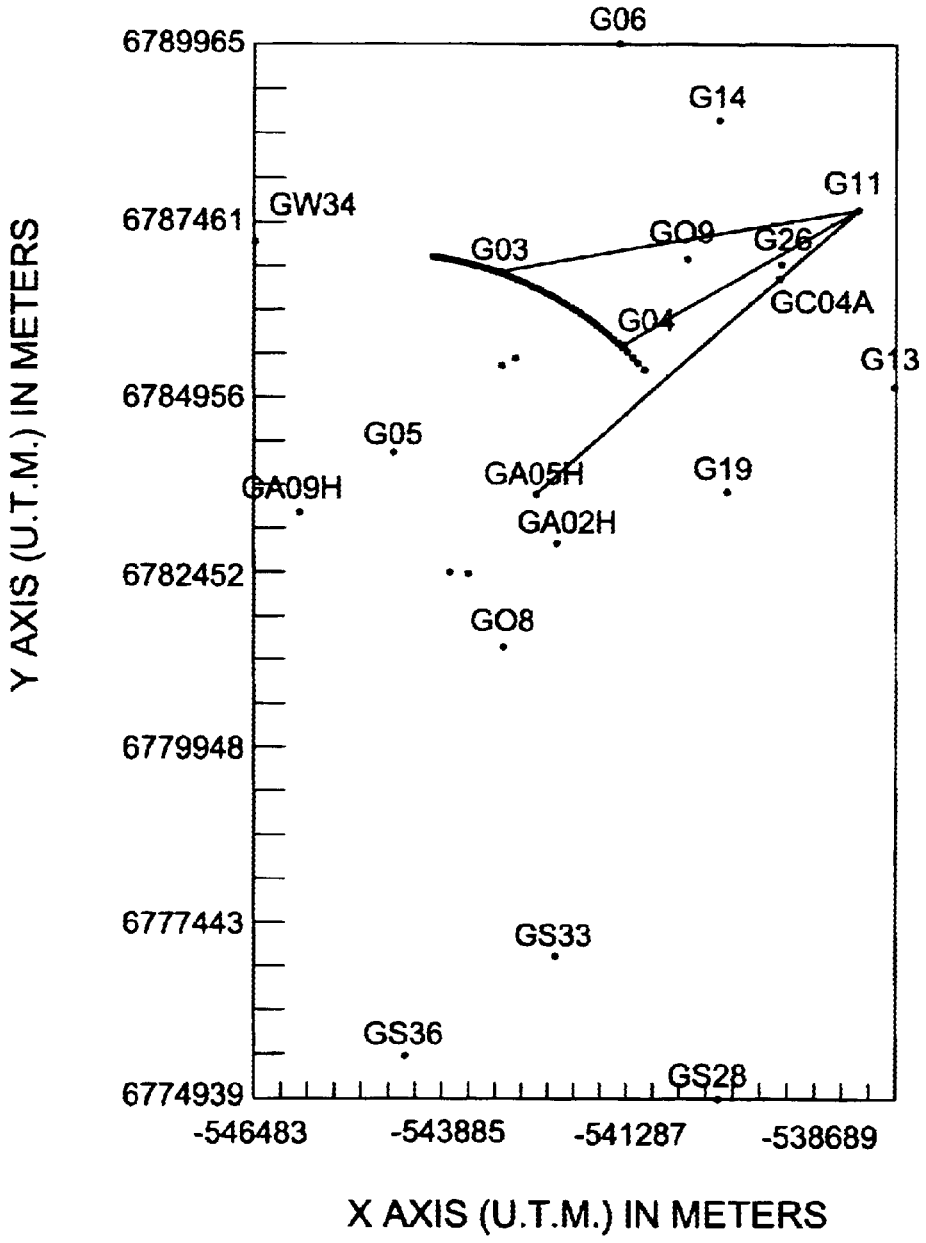
Figure 82B:
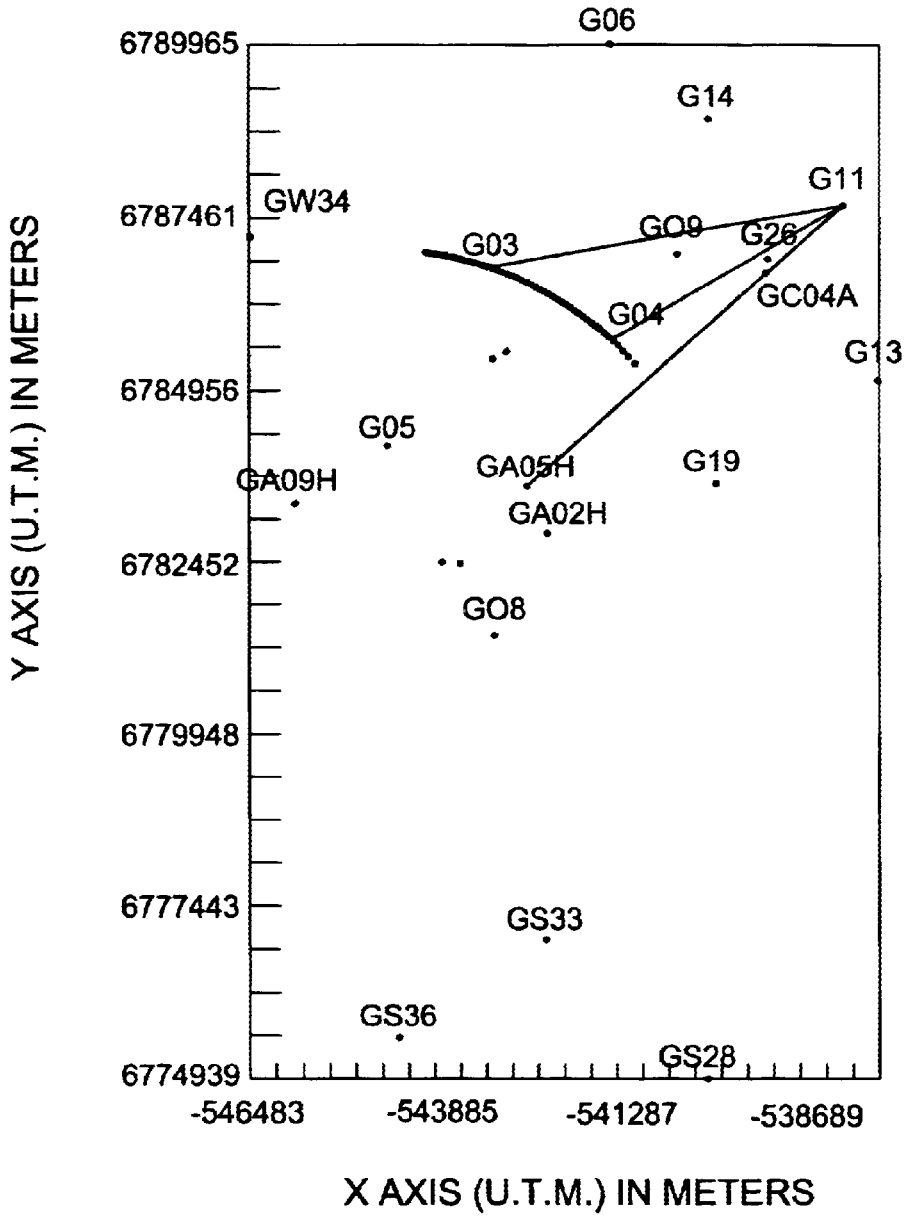
Figure 84:
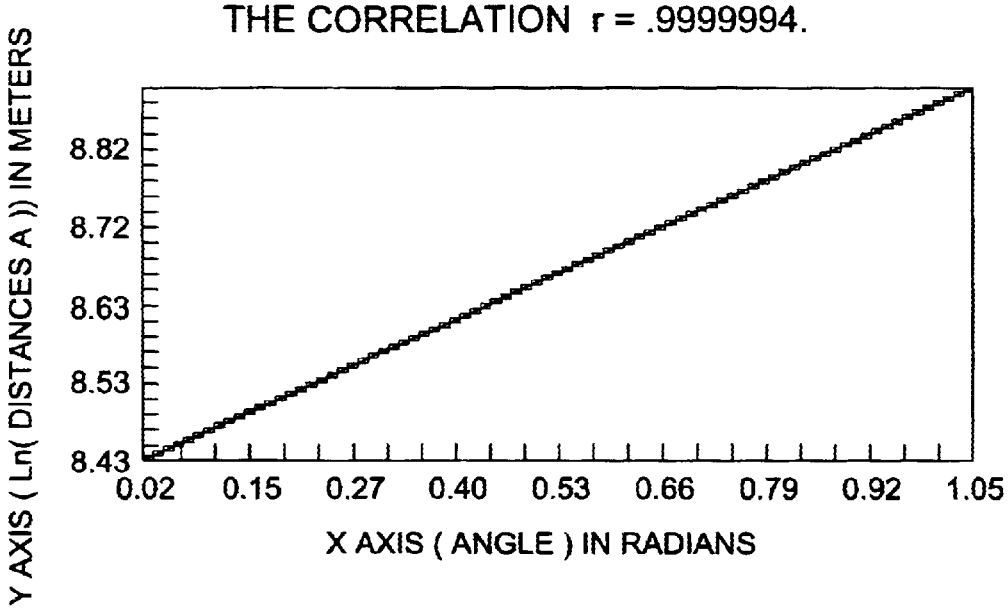
Figure 86:
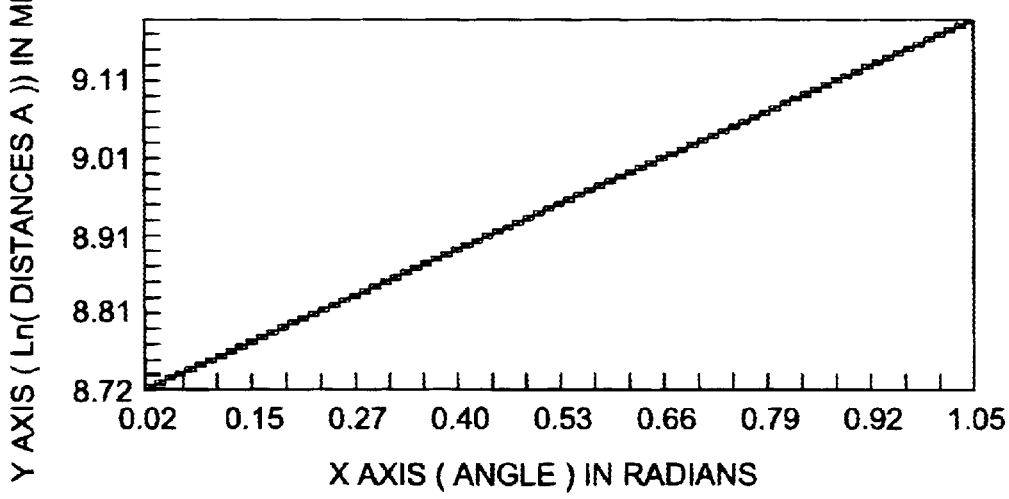
Figure 88:
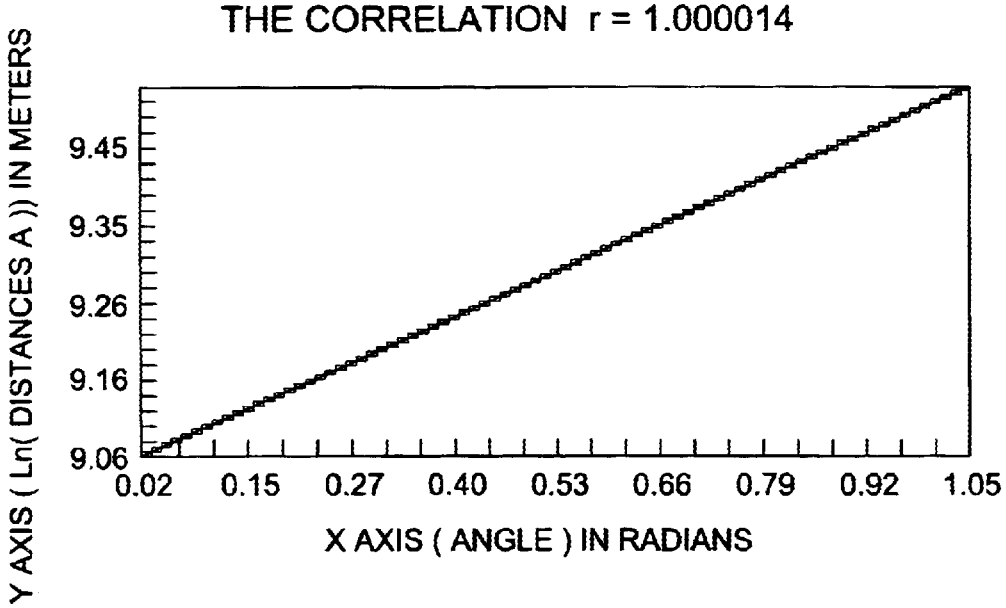
Figure 90:
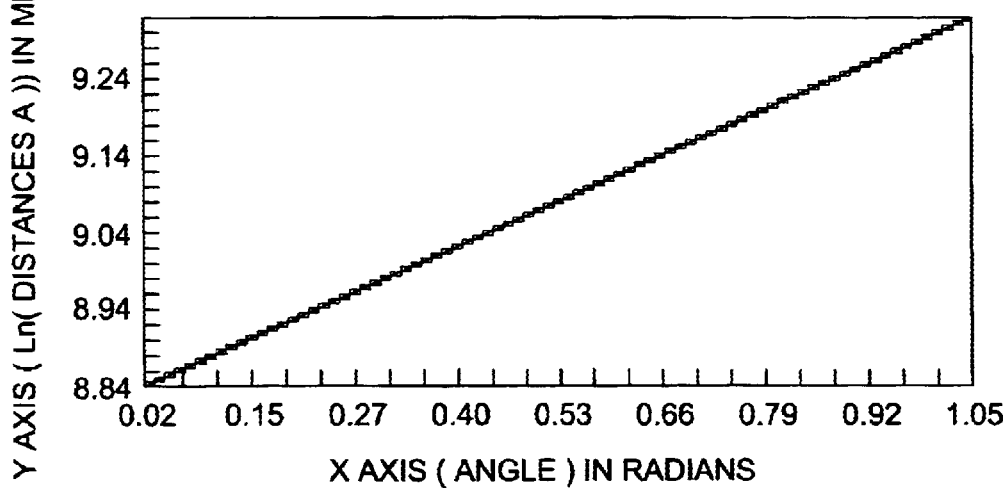
Figure 92:
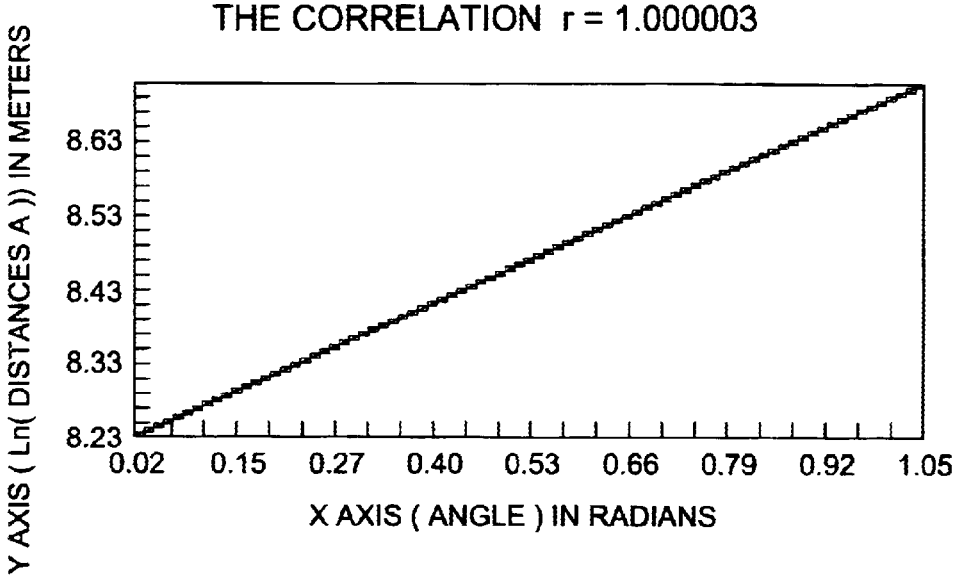

FIG. 82 illustrates another special case where the distribution of points of the couple of wells GAO5H and G11, finds the geographical position of two producing wells, the G04 and the G03, such that the distances of these to anyone of the wells GAO5H or G11 are in a growing sequence. The cotangent of the angle $\alpha$, of the Equation 3, again, can be determined in this experimental situation, with two data sets from the Gullfaks field. For example, using the producing wells GAO5H and G11 with coordinates (−542457, 6783482) and (−538029,6787591) respectively, one can measure with the Equation 1 the distance among these to be 6040 meters and to divide this with Equation 2 to obtain the point A, a distance of 3732 meters from the well G11. Then one determines the UTM coordinates of the point A, on the straight line among the producing wells GAO5H and GS33. This point A, is a guide to observe producing wells near the point A that are located in a growing sequence of distances from the producing well G11. For example, observing the producing wells G04 and G03 with coordinated (−541260, 6785587) and (−543052,6786655) respectively, these are located geographically in a sequence of growing distances from the producing well G11 (note FIG. 82A). The measured distance among the producing wells G04 and G11 is 3802 meters and the distance measured among the producing wells G03 and G11 is 5109 meters. Since the Equation 3 proposes produces growing distances as a function of the values of the angle $\theta$, measuring the angles among the distances of the wells G04–G11, G03–G11 and the distance among the wells GAO5H-G11 (note FIG. 82B), one obtains for the producing well G04 a value of $\theta$ of 4 grades and for the producing well G03 a value of $\theta$ 42 grades. Therefore one has for the producing wells G04 and G03 angle-distance values of (4,3802) and (42,5109) respectively.

Applying the natural logarithm to both members of the Equation 3 one obtains:

$$Ln(A_n)=Ln(A)+\theta \cot \alpha Ln(e) \Rightarrow Ln(A_n)=Ln(A)+\cot \alpha\theta \qquad \text{EQ. 4}$$

Where the Equation 4 is an equation lineal half logarithm that depends on the Angle $\theta$ in radians to produce the natural logarithm of the distances, but like one ignores the cotangent $\alpha$, this will be calculated using the couples angle-distance, (4,3802) and (42,5109) of the producing wells G04 and G03 respectively, through the lineal regression:

$$slope = \frac{\sum \theta_i \text{Ln}(A_i) - n\overline{\theta}\overline{\text{Ln}}(A)}{\sum \theta_i^2 - n\overline{\theta}^2} \text{ and } \cap = \overline{\text{Ln}}(A) \qquad \text{EQ. 5}$$

For the producing wells G04 and G03, the angles in grades are transformed into radians, and the natural logarithm is extracted at the distances, obtaining (0.06981,8.243282) and (0.73304,8.538759) respectively. Obtaining finally in a practical way the value of the angle $\alpha$=1.151678 radians, knowing that in the Equation 5 one has:

$$\tan\alpha = \frac{1}{slope} \Rightarrow \alpha = \text{Arctan}\alpha \qquad \text{EQ. 6}$$

Finally this value of the angle $\alpha$ is used under the function cot $\alpha$, as a fixed value in the Equation 3 and this will always be used given any distance between two wells producing of any oil field.

These two experimental situations are in this Gullfaks field can be used to find a more exact value of $\alpha$ as was getting in FIG. 68, that let build the same perfect curve in the FIGS. 81,82 and all the other Figures, in all the field oil considered, Captain, Gullfaks, Albacora, Izozog, Mecoacan, Oseberg, Troll.

The FIGS. 83, 85, 87, 89 and 91 illustrate the distances versus angles of the point distributions for FIGS. 78, 79, 80, 81 and 82 respectively. By adjusting with Equation 4, one gets the angles $\alpha$, 1.140025, 1.140034, 1.140039, 1.14002 and 1.140016 respectively, in the FIGS. 84, 86, 88, 90 and 92 respectively.

In synthesis the average value of the angles *60 is* 1.140023 radians in the Gullfaks field in Norway and this is practically the same average value, 1.139990 radians as in the other considered fields.

Though specific embodiments of the present invention are described herein, the invention is not intended to be so limited. Modifications and changes can be made to the described embodiments and yet fall within the scope and spirit of the present invention. The invention is intended to be limited only by the appended claims.

What is claimed is:

1. A method of finding the geographic location of one or more producing wells on the basis of the location of two other known producing wells, the method comprising the following steps:

selecting first and second producing wells and designating the location of such wells on an x-y coordinate system;

determining the distance X between the two wells in accordance with the equation $$X=\sqrt{(x_1-x_0)^2+(y_1-y_0)^2}$$

determining a smaller distance Y in accordance with the equation $$Y^2+XY-X^2=0$$

designating the distance Y from the first well as segment A and calculating a sequence of growing segments $A_n$ in accordance with the equation $$A_n=Ae^{\theta \cot \alpha}$$

wherein $\theta$ is varied by a number of degrees and wherein cot $\alpha$ is a fixed value;

computing a sequence $B_n$ which corresponds to the sequence $A_n$ in accordance with the equation $$A_n^2+A_nB_n-B_n^2=0$$

determining the intersection between the sequence of segments $A_n$ and $B_n$ with such intersection defining a trap slice upon which producing wells can be located.

2. The method set forth in claim 1 wherein each of the wells is a fossil fuel well.

3. The method set forth in claim 1 wherein the coordinate system employs Universal Transverse Mercator coordinates.

4. The method set forth in claim 1 wherein a second trap slice is generated by designating segment A as the distance Y from the second well and thereafter calculating a sequence of growing segments $A_n$ in accordance with the equation $$A_n = Ae^{\theta \cot \alpha}$$

and thereafter computing a corresponding sequence of values $B_n$ in accordance with the equation $$A_n^2 + A_n B_n - B_n^2 = 0$$

with the second trap slice being defined by the intersection of the segments $A_n$ and $B_n$.

5. The method as outlined in claim 1 wherein cot α is a constant value based upon data collected from the geometric relationships of existing wells.

6. A method of finding the geographic location of one or more producing wells comprising the following steps:

selecting first and second producing wells;

determining the distance X between the two wells;

determining a segment A measured from the first well;

determining a sequence of growing segments $A_n$ from the first well in accordance with the equation $$A_n = Ae^{\theta \cot \alpha}$$

wherein θ is incrementally varied and wherein cot α is a constant, and wherein one or more producing wells is located upon each segment $A_n$.

7. The method as outlined in claim 6 wherein cot α is a constant value based upon data collected from the geometric relationships of existing wells.

8. The method set forth in claim 6 wherein each of the wells is a fossil fuel well.

9. The method set forth in claim 7 wherein the coordinate system employs Universal Transverse Mercator coordinates.

* * * * *